US007550238B2

(12) United States Patent
Ohshima et al.

(10) Patent No.: US 7,550,238 B2
(45) **Date of Patent: *Jun. 23, 2009**

(54) PROCESS CARTRIDGE, IMAGE FORMING APPARATUS, AND IMAGE FORMING PROCESS

(75) Inventors: Kohichi Ohshima, Mishima (JP); Yasuo Suzuki, Fuji (JP); Tetsuro Suzuki, Fuji (JP); Michitaka Sasaki, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 311 days.

This patent is subject to a terminal disclaimer.

(21) Appl. No.: 11/110,937

(22) Filed: Apr. 21, 2005

(65) Prior Publication Data

US 2005/0238987 A1 Oct. 27, 2005

(30) Foreign Application Priority Data

Apr. 21, 2004 (JP) ..... 2004-125804

(51) Int. Cl.
*G03G 15/06* (2006.01)

(52) U.S. Cl. ..... 430/58.05; 430/125.3; 430/58.7; 430/66; 399/159

(58) Field of Classification Search ..... 430/125.3, 430/58.05, 58.7, 66; 399/159
See application file for complete search history.

(56) References Cited

U.S. PATENT DOCUMENTS 5,492,784 A 2/1996 Yoshikawa et al.
5,578,405 A 11/1996 Ikegami et al.
5,665,500 A 9/1997 Suzuki
5,871,876 A 2/1999 Ikuno et al.
5,928,828 A 7/1999 Suzuki
6,026,262 A 2/2000 Kinoshita et al.
6,030,733 A 2/2000 Kami et al.
6,066,428 A 5/2000 Katayama et al.

(Continued)

FOREIGN PATENT DOCUMENTS

JP 56-48637 5/1981

(Continued)

OTHER PUBLICATIONS

U.S. Appl. No. 09/679,480, filed Oct. 5, 2000, Yasuo Suzuki, et al.

(Continued)

*Primary Examiner*—Mark F Huff
*Assistant Examiner*—Rachel L Burney
(74) *Attorney, Agent, or Firm*—Oblon, Spivak, McClelland, Maier & Neustadt, P.C.

(57) ABSTRACT

An image forming process using an electrostatic latent image carrier containing a support and a photoconductive layer including: a charge generating layer, a charge transportable layer, and a cross-linked charge transportable layer which are disposed on the support in this order and the cross-linked charge transportable layer comprises a compound produced by the reaction between a trifunctional or more functional radical-polymerizable compound having no charge transportable structure, and a monofunctional radical-polymerizable compound having a charge transportable structure, and a toner produced in the form of particles by producing an adhesive base material through reacting a compound having an active hydrogen group with a polymer which can be reacted with the above-noted compound having an active hydrogen group in an aqueous medium.

12 Claims, 6 Drawing Sheets

U.S. PATENT DOCUMENTS

| | | | | |
|---|---|---|---|---|
| 6,136,483 | A | 10/2000 | Suzuki et al. | |
| 6,151,468 | A | 11/2000 | Kami et al. | |
| 6,194,535 | B1 | 2/2001 | Katayama et al. | |
| 6,210,848 | B1 | 4/2001 | Nagai et al. | |
| 6,416,915 | B1 * | 7/2002 | Kikuchi et al. | 430/56 |
| 6,819,892 | B2 | 11/2004 | Nakazato et al. | |
| 6,861,188 | B2 | 3/2005 | Ikegami et al. | |
| 6,936,390 | B2 | 8/2005 | Nanya et al. | |
| 7,251,437 | B2 | 7/2007 | Tamoto et al. | |
| 2003/0077531 | A1 | 4/2003 | Suzuki et al. | |
| 2003/0162112 | A1 * | 8/2003 | Yamashita et al. | 430/108.6 |
| 2004/0048177 | A1 | 3/2004 | Tamoto et al. | |
| 2004/0053152 | A1 | 3/2004 | Nagai et al. | |
| 2004/0126687 | A1 | 7/2004 | Ikegami et al. | |
| 2004/0170911 | A1 | 9/2004 | Shimada et al. | |
| 2004/0180280 | A1 | 9/2004 | Ikegami et al. | |
| 2004/0248024 | A1 | 12/2004 | Suzuki et al. | |
| 2004/0253527 | A1 | 12/2004 | Suzuki et al. | |
| 2005/0008957 | A1 | 1/2005 | Ikegami et al. | |
| 2005/0158641 | A1 | 7/2005 | Yanagawa et al. | |
| 2005/0175911 | A1 | 8/2005 | Tamoto et al. | |
| 2005/0221210 | A1 | 10/2005 | Suzuki et al. | |
| 2005/0238987 | A1 | 10/2005 | Ohshima et al. | |
| 2005/0266328 | A1 | 12/2005 | Yanagawa et al. | |
| 2007/0009818 | A1 | 1/2007 | Yanagawa et al. | |
| 2007/0031746 | A1 | 2/2007 | Toshine et al. | |
| 2007/0196749 | A1 | 8/2007 | Inaba et al. | |
| 2007/0196750 | A1 | 8/2007 | Fujiwara et al. | |

FOREIGN PATENT DOCUMENTS

| | | |
|---|---|---|
| JP | 64-1728 | 1/1989 |
| JP | 4-281461 | 10/1992 |
| JP | 6-118681 | 4/1994 |
| JP | 9-124943 | 5/1997 |
| JP | 9-190004 | 7/1997 |
| JP | 2000-66425 | 3/2000 |
| JP | 2001-175016 | 6/2001 |
| JP | 3194392 | 6/2001 |
| JP | 3262488 | 12/2001 |
| JP | 2003-280269 | 10/2003 |

OTHER PUBLICATIONS

U.S. Appl. No. 11/621,805, filed Jan. 10, 2007, Suzuki, et al.
U.S. Appl. No. 11/684,520, filed Mar. 9, 2007, Toshine, et al.
U.S. Appl. No. 11/685,441, filed Mar. 13, 2007, Yanagawa, et al.
U.S. Appl. No. 11/692,682, filed Mar. 28, 2007, Mori, et al.
U.S. Appl. No. 12/000,239, filed Dec. 11, 2007, Fujiwara, et al.
U.S. Appl. No. 12/035,016, filed Feb. 21, 2008, Iwamoto, et al.
U.S. Appl. No. 12/047,011, filed Mar. 12, 2008, Kami, et al.

* cited by examiner

PROCESS CARTRIDGE, IMAGE FORMING APPARATUS, AND IMAGE FORMING PROCESS

BACKGROUND OF THE INVENTION

1. Field of the Invention

The present invention relates to to a process cartridge used preferably for an electrophotography method, an electrostatic recording method and an electrostatic printing method, an image forming apparatus and an image forming process.

2. Description of the Related Art

Recently, the image forming technique in a copier, a primter and a facsimilie machine has been remarkably developed. Among them, a technique which is most frequently used is a technique belonging to an electrostatic image forming process represented by the electrophotography method. The reason therefore is considered to be such advantages, that according to the imge forming process represented by the electrophotography method, an image having a high quality can be obtained in a high speed and an image not only in monochrome but also in color can be obtained, and that the imge forming process has a durability for a long period and a stability.

The electrophotography method is an image forming process by charging entirely the surface of an electrostatic latent image carrier (hereinafter, sometimes referred to as "photoconductive body", "photoconductive body for the electrophotography" or "photoconductive insulating material"), by imparting to the electrostatic latent image carrier a light-exposure corresponding to an image which is to be formed, thereby forming an electrostatic latent image and by visualizing the electrostatic latent image with a toner.

As the photoconductive body for the electrophotography, an organic photoconductive body comprising an organic photo conductive substance is most widely used. The organic photoconductive body is more advantageous than another photoconductive body in that the organic photoconductive body can be easily developed as a material corresponding to various light sources for the light-exposure, such as from a visual light to an infrared light and can be produced with a low cost, and for the organic photoconductive body, a material causing no environmental pollution can be selected. On the contrary, the organic photoconductive body has such disadvantages that the organic photoconductive body has a low mechanical strength and that during the copying and printing in an amount of many sheets of the organic photoconductive body, a deterioration or a scratch is caused on the surface of the organic photoconductive body.

The organic photoconductive body is generally produced according to a method comprising disposing a charge generating layer on a conductive support comprising aluminum or an aluminum alloy by metallizing an organic charge generating substance over the support or by coating the support with a coating liquid in which an organic charge generating substance and an organic polymer compound which is used as an integrating agent are dispersed in a solvent and by disposing a charge transporting layer by coating the charge generating layer with a coating liquid in which an organic charge generating substance and an organic polymer compound which is used as an integrating agent.

Generally, in an electrophotography apparatus according to the Carlson method, after the photoconductive body is uniformly charged, an electrostatic latent image is formed by discharging the charged photoconductive body in the form of an image (i.e., a discharged portion of the photoconductive body forms the form of an image) by a light-exposure and the electrostatic latent image is developed and visualized with a toner, thereby fixing the resultant toner image through transferring the toner image to a paper or the like.

In this case, all toner on the photoconductive body are not transferred and a portion of the toner remains on the photoconductive body. When, while the toner remains, a new image-froming is performed, due to the remaining toner, the copying of an image having a high quality and no contamination cannot be obtained. Thus, a cleaning unit configured to remove the remaining toner becomes necessary. Representative examples of the cleaning unit include a fur brush, a magnetic brush and a blade. Among them, from the viewpoint of the performance and the composition of the apparatus, the blade is preferred. As the blade, an elastomeric gum rubber in the form of a plate is generally used.

Since thus, the surface of the photoconductive body for the electrophotography is directly subjected to an electrorical or mechanical external force by a condesator, a developing apparatus, a tranfering unit or a cleaning unit, the photoconductive body for the electrophotography is required to have durability against the external force, particularly mechanical durability against the causing of a wear or a scratch on the surface of the photoconductive body by the rubbing and against the film peeling of the photoconductive body by the invading of a foreign substance or by the shock during the coping with the paper clogging. Among them, the durability of the photoconductive body against the scratch and the film peeling by the shock is required to be improved to be higher.

For satiafying the above-noted required various properties, heretofore various trials have been studied. For example, with respect to the mechanicl durability, it is reported that by laminating on the surface of an organic photoconductive body a BPZ polycarbonate as a binder resin, the wearing properties and the toner filming properties of the surface of the photoconductive body can be improved. However, the above-noted photoconductive body comprising a BPZ polycarbonate laminated on the surface of the photoconductive body has yet unsatisfactory wearing properties and an unsatisfactory durability.

Further, it is reported that as the surface protective layer of the photoconductive body, a curable silicone resin containing a colloidal silica is laminated on the surface of the photoconductive body (see Japanese PatentApplication Laid-Open (JP-A) No. 06-118681). By the surface protective layer comprising a curable silicone resin containing a colloidal silica, the wearing properties of the photoconductive body can be improved. However, the electrophotographe property of the photoconductive body during the repeating use is yet unsatisfactory and a disadvantage is caused wherein not only the fog and the image blur are easily caused, but also the durability of the photoconductive body is unsatisfactory.

For improving these disadvantages, a photoconductive body comprising as the surface layer, a resin layer produced by bonding an electron-hole transportable compound modified by an organic silicone to a curable organic silicone polymer is proposed (see JP-A Nos. 09-124943 and JP-A 09-190004). In this proposal, since the surface layer is cured, the surface of the sensitive material is not abraded; however, the water adsorbed to the sensitive material in a high-temperature and high humidity atmosphere cannot be removed, so that an image blur and a filming of a paper powder or the toner are easily caused and a disadvantage is caused wherein an image failure in the form of a stripe or a dot is easily caused.

On the other hand, since not only the lessening of the diameter of the sensitive material is progressed by the downsize of the image forming apparatus, but also the movements of the speedup of the apparatus and of the maintainance-free are followed, it is desired that the photoconductive body has a further higher durability. From such a viewpoint, the organic photoconductive body has originally poor chemical stability and because the organic photoconductive body comprises mainly a charge transporting substance having a low molecuilar weight and an inactive polymer, the organic photoconductive body is generally soft, so that the organic photoconductive body has such a disadvantage that when the organic photoconductive body is repeatedly used in the electrophotography process, a wear due to a mechanical load applied by the developing system or the cleaning system is easily caused in the organic photoconductive body. Further, it is required that for improving the cleaning properties of the image forming apparatus according to the lessening of the diameter of tone particles for enhancing the image quality, the gum hardness and touching pressure of the cleaning blade are enlarged and such a requirement is a cause for accelerating the wear of the photoconductive body. The wear of the photoconductive body impaires the sensitivity and electrical properties (such as the charging properties) of the photoconductive body and becomes the cause for an anomalous image, such as the lowering of the image density and a dirty background. A scratch caused by a localized wear causes an image having a dirt in the form of a stripe due to an unsatisfactory cleaning and it is considered that in the present condition, the exhaustion of the life of the photoconductive body is rate-determined by the above-noted wear and scratch and the photoconductive body is led to the replacement.

Thus, for enhancing the durability of the photoconductive layer, it is indispensable to lower the wear degree of the photoconductive body and the lowering of the wear degree of the photoconductive body is most urgent problem to be solved in the present technical field.

Examples of the method for improving the hardwearing properties of the photoconductive layer include (1) a method in which a cross-linked charge transportable layer comprises a curing binder (see JP-A No. 56-48637), (2) a method in which a cross-linked charge transportable layer comprises a charge transportable polymer (see JP-A No. 64-1728) and (3) a method in which in the cross-linked charge transportable layer, an inorganic filler is dispersed (see JP-A No. 04-281461).

Among these methods, the method (1) using a curable binder has such a tendency that the compatibility of the curable binder with a charge transportable substance is poor and due to an impurity, such as a polymerization initiator and an unreacted residue, the residual electric potential of the charge transportable layer is elevated, so that the lowering of the image density is easily caused. In the method (2) using a charge transportable polymer, while the hardwearing properties of the photoconductive body can be improved to some extent, a photoconductive body which can fully satisfy the durability required for the organic photoconductive body is not yet obtained. Since the polymerization and purification of the materials for producing the charge transportable polymer is difficult and a charge transportable polymer having a high purity can be difficultly obtained, the electrical properties between the charge transportable polymer and another material can be difficultly stabilized. Further, a disadvantage in the production of the charge transportable polymer is sometimes caused wherein the viscosity of a coating liquid for producing the charge transportable layer becomes high. In the method (3) using an inorganic filler, the organic photoconductive body comprising a charge transportable layer in which an inorganic filler is dispersed can exhibit higher hardwearing properties than that of a photoconductive body produced by dispersing an usual charge transportable substance having a low molecular weight in an inactive polymer; however, the organic photoconductive body comprising an inorganic filler has such a tendency that due to a charge trap which is present on the surface of the inorganic filler, the residual electric potential of the charge transportable layer is elevated, so that the image density is easily lowered. Further, when the inorganic filler on the surface of the photoconductive body and the binder resin have a large unevenness, a cleaning-fault is caused and the cleaning-fault causes also the toner filming and the image delection sometimes.

Therefore, according to the methods (1), (2) and (3) heretofore, the general durability comprising the electrical durability and mechanical durability which is required for the organic photoconductive body is not yet fully satisfied.

For improving the hardwearing properties and scratch resistance of the photoconductive layer comprising a curing binder in the method (1), a photoconductive body comprising a multi-functional acrylate monomer cured form is proposed (see Japanese Patent (JP-B) No. 3262488). However, in this proposal, with respect to the above-noted photoconductive body, while it is described that a protective layer disposed on a photoconductive layer may comprise a charge transportable substance and comprises a multi-functional acrylate monomer cured form, there is no description explaining a specific improving method of the hardwearing properties and scratch resistance of the photoconductive layer. When the cross-linked charge transportable layer comprises a charge transportable substance having a low molecular weight, the compatibility of the charge transportable substance having a low molecular weight with the multi-functional acrylate monomer cured form is poor, so that in the photoconductive layer, the diposition of the charge transportable substance having a low molecular weight and the cloudiness are caused and a disadvantage is caused wherein not only the image density is lowered due to the elevation of the potential in a light-exposed portion, but also the mechanical strength of the charge transportable layer is lowered.

Moreover, since in the production of the above-noted photoconductive body, the material for the cross-linked charge transportable layer is reacted in the state of comprising a polymer binder with the monomer, the forming of a tree-dimensional network is not satisfactorily progressed and the cross linkage density becomes dilute, so that a rapid improvement of the hardwearing properties of the photoconductive body cannot have been yet obtained.

As a substitutional method of the above-noted methods for improving the hardwearing properties of the photoconductive layer, a method for disposing the charge transportable layer using a coating liquid comprising a monomer having a double bond of C═C, a charge transportable substance having a double bond of C═C and a binder resin is proposed (see JP-B No. 3194392). The binder resin has the function of improving the adhesion between the charge generating layer and the curable charge transportable layer and the function of relaxing the internal stress of the curable charge transportable layer during the curing thereof and is generally classified into two types, such as (1) a binder resin having a reactivity with the charge transportable substance through the C═C double bond and (2) a binder resin having no C═C double bond and no reactivity with the charge transportable substance.

The photoconductive body comprising the above-noted binder resin has the compatibility between the hardwearing properties and advantageous electrical properties thereof and attracts the attention; however, when a binder resin having no reactivity is used, the compatibility between the binder resin and the cured form produced according to the reaction between the monomer having a C=C bond and the charge transportable substance is poor and in the cross-linked charge transportable layer, a layer separation is caused, so that a scratch and an adhesion of an external additive in the toner or a paper powder are caused sometimes. Further, as noted above, the forming of a tree-dimensional network is not satisfactorily progressed and the cross linkage density becomes dilute, so that a rapid improvement of the hardwearing properties of the photoconductive body cannot have been yet obtained. Moreover, since the monomer described specifically in the above-noted patent document as a monomer having a C=C bond which is used for producing the photoconductive body is a bifunctional monomer, the photoconductive body comprisimg such a monomer has not yet satisfactory hardwearing properties. Even in the case where a reactive binder was used, while the molecular weight of the cured form was enlarged, the number of the intermolecular cross-linkage was small and the compatibility between the bond amount and cross-linkage density in the charge transportable substance was difficulty, so that the electrical properties and hardwearing proiperties of the photoconductive body were not satisfactory.

Further, a photoconductive layer comprising a cured form of an electron-hole transportable compound having plural chain polymerizable functional groups in one molecule is proposed (see JP-A No. 2000-66425). The photoconductive layer in which the cross-linkage density was enhanced had a high hardness; however, since a bulky electron-hole transportable compound had plural chain polymerizable functional groups, in the cured form, a strane was caused or an internal stress was enlarged, so that a disadvantage was caused wherein in the cross-linked surface layer, a cracking or a peeling is easily caused in the long-term using.

Accordingly, a photoconductive body comprising a cross-linked photoconductive layer to which a charge transportable structure is chemically bonded according to a conventional method, has not yet satisfactorily satisfiable general properties under the present condition and a further improvement and development have been desired.

SUMMARY OF THE INVENTION

The object of the present invention is to provide a process cartridge which can form a stable image for a long-term without the cause of an image blur, an image failure in the form of a stripe or a dot and an image deterioration due to an environmental fluctuation using a photoconductive body in which the photoconductive layer has an extremely low wear degree and a toner produced in the form of particles by producing an adhesive base material through reacting a compound having an active hydrogen group with a polymer which can be reacted with the above-noted compound having an active hydrogen group in an aqueous medium; an image forming apparatus and image forming process using the above-noted process cartridge.

The image forming process according to the present invention comprises forming an electrostatic latent image on an electrostatic latent image carrier, developing the electrostatic latent image using a toner, thereby forming a visible image, transferring the visible image to a recording medium and cleaning the electrostatic latent image carrier using a cleaning unit, wherein the electrostatic latent image carrier comprises a support and a photoconductive layer which comprises a charge generating layer, a charge transportable layer and a cross-linked charge transportable layer which are disposed on the support in this order and the cross-linked charge transportable layer comprises a compound produced by the reaction between a trifunctional or more functional radical-polymerizable compound having no charge transportable structure and a monofunctional radical-polymerizable compound having a charge transportable structure.

The electrostatic latent image carrier (photoconductive body for the elecrtography) is used under the condition repeating a series of the processings, such as the charging, the developing, the transferring, the cleaning and the distaticizing and in these processings, by the cause of the wear and the scratch in the photoconductive body, the photoconductive body causes an image deterioration and is led to the end of the life thereof. Examples of the cause of the wear and the scratch include (1) the decomposition of a surface composition of the photoconductive body due to a discharging during the charging and the destaticizing and the chemical deterioration of a surface composition of the photoconductive body due to an oxidative gas, (2) the attaching of the carrier to the photoconductive body during the developing, (3) the friction of the photoconductive body with the paper during the tranfereing and (4) the friction of the photoconductive body with a cleaning blush, a cleaning blade, a toner and an attached carrier during the cleaning. For desining a photoconductive body having a strong resistance aginst the above-noted hazards, it is important that the hardness and elasticity of the surface layer of the photoconductive body is enhanced and the surface layer is uniformized and a method in which a sophisticated and homogeneous three-demensional net work is formed as a film structure is promising. Since the cross-linked charge transportable layer which is the surface layer of the photoconductive body according to the present invention has a cross-linked structure produced by curing a trifunctional or more functional radical-polymerizable monomer, the surface layer of the photoconductive body having a high hardness due to an extremely high cross-linkage density, a high elasticity, high hardwearing properties and a high scratch resistance in which a three-demensional net work is developed can be obtained. Thus, it is important to increase the cross-linkage density, i.e. the number of the cross-linkage per an unit volume; however, since in the curing reaction, many linkages are formed instantly, an internal stress due to the volume contraction is caused in the charge transportable layer. The larger the thickness of the cross-linked charge transportable layer becomes, the larger the internal stress becomes, so that when the whole charge transportable layer is cured, a cracking or a film-peeling is easily caused. Even when the cracking or film-peeling is not caused in an initial period of the using of the photoconductive body, by subjecting the photoconductive body to the using in the electrophotography processing and to a hazard and a thermal fluctuation due to the charging, developing, transfering and cleaning, the cracking or film-peeling is easily caused sometimes during the aging. Examples of the method for solving the above-noted problem include a method for softening the cure resin layer, such as (1) a method for introducing a polymer component to the cross-linked layer or to the cross-linked structure, (2) a method for using a large amount of monofunctional- and bifunctional-radical-polymerizable monmers and (3) a method for using a multifunctional monomer having a flexible group. However, according to any one of the above-noted three methods, the cross-linkage density in the cross-linked layer becomes dilute and rapid hardwearing properties cannot be obtained.

On the other hand, with respect to the electrostatic latent image carrier (photoconductive body) according to the present invention, by disposing the cross-linked charge transportable layer having a thickness of 1 μm to 10 μm in which a three-dimansional net work is developed and the cross-linkage density is high on the charge transportable layer, not only the above-noted cracking and film-peeling are not caused, but also the electrostatic latent image carrier having extremely high hardwearing properties can be obtained. By disposing the cross-linked charge transportable layer having a thickness of 2 μm to 8 μm, in addition to the further improving of the allowance for the above-noted problem, a material for enhancing the cross-linkage density which leads the photoconductive body to improving hardwearing properties can be selected. Examples of the reason why the photoconductive body according to the present invention can suppress the cracking and film-peeling include that the cross-linked charge transportable layer can be disposed as a thin film, so that the internal stress becomes not large and that the photoconductive body comprises the charge transportable layer under the cross-linked charge transportable layer, so that the internal stress of the cross-linked charge transportable layer can be suppressed. Thus, it is not necessary that the cross-linked charge transportable layer comprises a large amount of a polymer material and the scratch and toner filming which would be caused by the incompatibility between the polymer material and the cured form caused by the reaction of the radical-polymerizable composition (radical-polymerizable compound comprising a radical-polymerizable monomer and a charge transportable structure), when the cross-linked charge transportable layer would comprise a large amount of a polymer material, are hardly caused. Further, the whole charge transportable layer is cured by irradiating a light energy, the light transmission into the inside of the whole charge transportable layer is suppressed by the absorption of the light by the whole charge transportable layer and a phenomenon in which the curing reaction does not progress satisfactorily is caused sometimes. With respect to the cross-linked charge transportable layer according to the present invention, from the cross-linked charge transportable layer having a thickness of 10 μm or less to the inside (i.e., to the charge transportable layer which is disposed under the cross-linked charge transportable layer), the curing reaction progresses homogeneously and in the inside, the same high hardwearing properties as those of the surface can be maintained. Further, in the disposing of the most outer layer according to the present invention, the most outer layer comprises not only the above-noted trifunctional radical-polymerizable monomer, but also a radical-polymerizable compound comprising a monofunctional charge transportable structure and this radical-polymerizable compound is incorporated in the cross-linkage during the curing of the above-noted trifunctional radical-polymerizable monomer. On the contrary, when the cross-linked charge transportable layer comprises a low molecular weight-charge transportable substance having no functional group, due to the poor compatibility thereof with the cured form of the above-noted trifunctional radical-polymerizable monomer, the diposition of the charge transportable substance having a low molecular weight and the cloudiness are caused and the mechanical strength of the charge transportable layer is impaired. On the other hand, when the cross-linked charge transportable layer comprises maily a bi- or more functional charge transportable compound, while the bi- or more functional charge transportable compound is fixed in the cross-linkage structure through plural linkages and the cross-linkage density in the cross-linked charge transportable layer is enhanced, due to the extremely bulky transportable structure of the bi- or more functional charge transportable compound, the strain of the cured resin structure becomes extremely large and the internal stress of the cross-linked charge transportable layer is enhanced.

Further, since the photoconductive body according to the present invention has advantageous electrical properties, a formed image maintaining a high quality for a long term can be obtained. The causes of this advantage are the using of a monofunctional radical-polymerizable compound having the charge transportable structure as a composition component of the cross-linked charge transportable layer and the fixing of the monofunctional radical-polymerizable compound among the cross-linkage in the form of a pendant. As noted above, when a charge transportable substance having no functional group is used, the diposition thereof and the cloudiness are caused, so that the lowering of the sensitivity and the impairement of the electrical properties during the repeated using (such as the elevation of the residual potential) become remarkable in the cross-linked charge transportable layer. When the cross-linked charge transportable layer comprises mainly a bi- or more functional charge tranprotable compound, the bi- or more functional charge tranprotable compound is fixed among the cross-linkage structure through plural linkages, so that an intermediate structure (cation radical) during the charge transportation cannot be stably maintained and the lowering of the sensitivity and elevation of the residual potential due to the charge trap are easily caused. These impairements of the electrical properties cause the lowering of the image density and the image having a thinned letter. Further, in the photoconductive body according to the present invention, to the charge tranprotable layer disposed under the cross-linked charge tranprotable layer, a design for a charge tranprotable layer having a little charge trap and a high mobility in a conventional photoconductive body can be applied, so that the electrical side effect of the cross-linked charge tranprotable layer can be suppressed to minimum.

The cross-linked charge transportable layer according to the present invention is produced by curing the trifunctional or more functional radical-polymerizable monomer having no charge transportable structure and the monofunctional radical-polymerizable compound having a charge transportable structure and in the whole charge transportable layer, the three-dimensional net work is developed and the cross-linkage density is high; however, depending on the presence of another component (e.g., an additive, such as a mono- or bi-functional monomer, a polymer binder, an antioxidant, a leveling agent and a platicizer, and a dissolved component invading from an under layer) than the above-noted radical-polymerizable compounds and the curing condition, in the cross-linked charge transportable layer, the cross-linkage density becomes locally dilute sometimes or the cross-linked charge transportable layer is produced sometimes as an integrated body of fine cured forms in which the density of the cross-linkage is high. Not only such a cross-linked charge transportable layer in which the bonding force among the above-noted fine cured forms is weak, exhibits a solubility in an organic solvent, but also during the repeated using of the photoconductive body for the electrophotography, a local wear or an elimination of a fine cured form unit from the abve-noted integrated body of fine cured forms is easily caused. According to the present invention, by rendering the cross-linked charge transportable layer insoluble in an organic solvent, not only the original three-dimensional net work is developed and the cross-linkage density becomes high, but also chain reactions progress in a wide range and the cured form becomes having a high molecular weight, so that rapid hardwearing properties of the photoconductive body can be obtained.

Thus, with respect to the photoconductive body according to the present invention, during the repeated image forming for a long term in an amount of 100,000 sheets of A4-sized plain paper which are used as a material for the transferring, the image having a high quality can be obtained. Particularly in a high temperature-high humidity atmosphere, the image deletion which is considered to be caused due to the filming can be effectively prevented. While the photoconductive body according to the present invention has high hardwearing propeties, in a long-termed using thereof, the photoconductive body has a tendency in which extremely slightly, the peeling of the photoconductive layer progresses and the photoconductive layer is subjected to the wear. This tendency is reversely advantageous. In other words, for example, in the case where the filming is caused by the attaching of a toner composition, while when the photoconductive layer is not peeled at all, a remarkable image deletion is frequently caused in a high temperature-high humidity atmosphere, it is assumed that when the photoconductive layer is peeled a little, the filming caused by the attaching of an electrification product, which is related to the image deletion, is difficultly formed.

Further, in the case where as the toner used for the developing, a toner produced according to a griding method is used, the toner has in the surface thereof many chemically active points which are assumed to adsorb water and in a high temperature-high humidity atmosphere, such a toner is further more disadvantage in the forming of the image deletion.

Accordingly, for maintaining an image having a high quality for a long term also in a high temperature-high humidity atmosphere, it is preferred that not only the photoconductive body has remarkably excellent hardwearing properties and the wear degree of the photoconductive body is appropriately controlled, but also the toner used for the developing is produced according to a liquid-phase method instead of a griding method as follows.

Since the toner comprises the above-noted adhesive base material produced by reacting the above-noted compound containing an active hydrogen group with a polymer which is reactive with the compound containing an active hydrogen group in an aqueous medium, the toner is excellent in various properties, such as resistance to agglomeration, electrification properties, fluidity, transfer properties and fixation properties. Further, since the toner comprises an adhesive base material containg at least one of an urea bond and an urethane bond, the surface of the toner is to some extent hard and accordingly, the toner can appropriately retain ultrafine particles of the toner fluidizing agent within the toner, so that the fusion-bonding of a component of the toner to the surface of the photoconductive body can be supressed.

Therefore, according to the image forming process according to the present invention, even in a high temperature-high humidity atmosphere, the cause of the image blur and the image failure in the form of a stripe or a dot (black dot) can be prevented and the image having high durability and a high quality can be obtained.

The process cartridge according to the present invention comprises an electrostatic latent image carrier and a developing unit configured to form a visible image by developing an electrostatic latent image formed on the electrostatic latent image carrier, wherein the electrostatic latent image carrier comprises a support and a photoconductive layer which comprises a charge generating layer, a charge transportable layer and a cross-linked charge transportable layer which are disposed on the support in this order and the cross-linked charge transportable layer comprises a compound produced by the reaction between a trifunctional or more functional radical-polymerizable compound having no charge transportable structure and a monofunctional radical-polymerizable compound having a charge transportable structure and the toner is produced in the form of particles by producing an adhesive base material through reacting a compound having an active hydrogen group with a polymer which can be reacted with the compound having an active hydrogen group in an aqueous medium. In the process cartridge, the developing unit configured to form a visible image by developing the electrostatic latent image formed on the electrostatic latent image carrier. At this time, since the electrostatic latent image carrier has rapid hardwearing properties and the above-noted toner is used, the image having high minuteness and a high quality can be obtained and even by a blade cleaning, the wear of the photoconductive body is suppressed to extremely slight, while the cleaning properties are advantageous.

The image forming apparatus according to the present invention comprises an electrostatic latent image carrier, an electrostatic latent image forming unit configured to form an electrostatic latent image on the electrostatic latent image carrier, a developing unit configured to form a visible image by developing the electrostatic latent image using a toner, a transferring unit configured to transfer the visible image to a recording medium and a cleaning unit configured to clean the electrostatic latent image carrier, wherein the electrostatic latent image carrier comprises a support and a photoconductive layer which comprises a charge generating layer, a charge transportable layer and a cross-linked charge transportable layer which are disposed on the support in this order and the cross-linked charge transportable layer comprises a compound produced by the reaction between a trifunctional or more functional radical-polymerizable compound having no charge transportable structure and a monofunctional radical-polymerizable compound having a charge transportable structure, and the toner is produced in the form of particles by producing an adhesive base material through reacting a compound having an active hydrogen group with a polymer which can be reacted with the compound having an active hydrogen group in an aqueous medium. In the image forming apparatus, the electrostatic latent image forming unit configured to form an electrostatic latent image on the electrostatic latent image carrier, the developing unit configured to form a visible image by developing the electrostatic latent image formed on the electrostatic latent image carrier using the toner and the transferring unit configured to transfer the visible image to a recording medium. Since the above-noted electrostatic latent image carrier and toner are used, as noted in the section of "image forming process" abve, even in a high temperature-high humidity atmosphere, the cause of the image blur and the image failure in the form of a stripe or a dot (black dot) can be prevented and an image having high durability and a high quality can be obtained.

Figure 1:
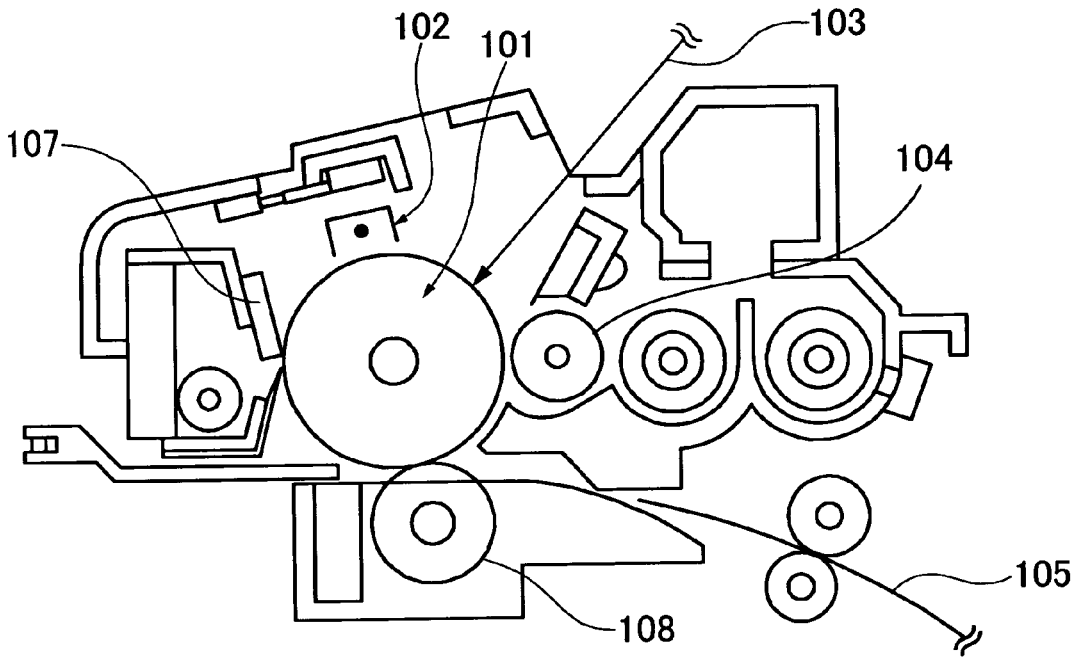
FIG. 1 is an explanatory view schematically showing an example of a process cartridge according to the present invention.

DESCRIPTION OF THE PREFERRED EMBODIMENTS (Image Forming Process and Image Forming Apparatus)

The image forming apparatus according to the present invention comprises the electrostatic latent image carrier, the latent electrostatic image forming unit, the developing unit, the transferring unit, the fixing unit, the cleaning unit and optionally other units properly selected depending on the application, such as a destaticizing unit, a recycling unit and a controlling unit.

The image forming process according to the present invention comprises the electrostatic latent image forming, the developing, the transferring, the fixing, the cleaning and optionally other steps properly selected depending on the application, such as a destaticizing, a recycling and a controlling.

The image forming process according to the present invention can be preferably performed using the image forming apparatus according to the present invention. The electrostatic latent image forming can be performed using the electrostatic latent image forming unit, the developing can be performed using the developing unit, the transferring can be performed using the transferring unit, the fixing can be performed using the fixing unit and the other steps can be performed using the other units.

—Electrostatic Latent Image Forming and Electrostatic Latent Image Forming Unit—

The electrostatic latent image forming is forming an electrostatic latent image on the electrostatic latent image carrier.

The material, form, structure, size of the electrostatic latent image carrier are not restricted and may be properly selected from those which are conventional. Preferred examples of the form include the form of a drum.

The electrostatic latent image carrier according to the present invention comprises the photoconductive layer comprising the support, the charge generating layer, the charge transportable layer and the cross-linked charge transportable layer in this order; and optionally other members.

—Support—

The support is not restricted so long as the support exhibits a conductivity of $10^{10}$ Ω-cm or less in terms of the volume resistance and may be selected depending on the application. Examples of the support include a plastic in the form of a film and cylinder, and a paper which are coated with a metal, such as aluminum, nickel, chromium, nichrome, copper, gold, silver, platinum, or with a metal oxide, such as tin oxide and indium oxide, by a metallizing or a sputtering; and a plate and pipe of aluminum, an aluminum alloy, nickel and a stainless steel, wherein the pipe of a metal or a metal alloy are produced by shaping the plate of a metal or metal alloy to a raw pipe according to an extrusion method or a drawing method and by subjecting the raw pipe to the surface treatment, such as a cutting, a super-finishing and a polishing. An endless nickel belt and an endless stainless steel belt disclosed in JP-A No. 52-36016 can be used as the support.

As others, a substance produced by coating the above-noted support with a dispersion in which conductive particles are dispersed in a proper binder resin can be also used as the support according to the present invention.

Examples of the conductive particles include particles of a carbon black; an acecylene black; a metal, such as aluminum, nickel, iron, nichrome, copper, zinc and silver; and a metal oxide, such as conductive tin oxide and ITO.

Examples of the binder include a thermoplastic resin, a thermosetting resin and a light curing resin, such as a polystyrene, a styrene-acrylonitrile copolymer, a styrene-butadiene copolymer, a styrene-maleic anhydride copolymer, a polyester, a polyvinyl chloride, a vinyl chloride-vinyl acetate copolymer, a polyvinyl acetate, a polyvinylidene chloride, a polyarylate resin, a phenoxy resin, a polycarbonate, a cellulose acetate resin, an ethyl cellulose resin, a polyvinyl butyral, a polyvinyl formal, a polyvinyl toluene, a poly-N-vinylcarbazole, an acrylic resin, a silicone resin, an epoxy resin, a melamine resin, an urethane resin, a phenolic resin and an alkyd resin. The conductive layer can be disposed by coating with a dispersion in which conductive particles and a binder resin are dispersed in a proper solvent, such as tetrahydrofuran, dichloromethane, methyl ethyl ketone and toluene.

Further, a substance produced by disposing the conductive layer on the proper support having the form of a cylinder using a heat-shrinkable tubing produced by incorporating conductive particles in a material, such as a polyvinyl chloride, a polypropylene, a polyester, a polystyrene, a polyvinylidene chloride, a polyethylene, a chloride rubber and Teflon (registered trade mark), can be also preferably used as the conductive support according to the present invention.

—Photoconductive Layer—

The photoconductive layer comprises the charge generating layer having a charge generating function, the charge transportable layer having a charge transporting function, the cross-linked charge transportable layer, which are disposed in this order, and optionally other layers.

—Charge Generating Layer—

The charge generating layer comprises mainly a charge generating substance having a charge generating function, a binder resin and optionally other components.

As the charge generating substance, both an inorganic and organic materials are preferably used.

Examples of the inorganic material include a crystalline selenium, an amorphous selenium, a selenium-tellurium-halogen compound, a selenium-arsenic compound and an amorphous silicone. As the amorphous silicone, an amorphous silicone in which the dangling bonds are terminated with hydrogen atoms or halogen atoms or a boron atom or a phosphorus is doped is preferably used.

Examples of the organic material include a conventional material, such as a phthalocyanine pigment (, such as a metal phthalocyanine and a phthalocyanine containing no metal), an azulenium salt pigment, a methine squarate pigment, an azo pigment having a carbazole skeleton, an azo pigment having a triphenylamine skeleton, an azo pigment having a diphenylamine skeleton, an azo pigment having a dibenzothiophene skeleton, an azo pigment having a fluorenone skeleton, an azo pigment having a oxadiazole skeleton, an azo pigment having a bis-stilbene skeleton, an azo pigment having a distilyloxadiazole skeleton, an azo pigment having a distilylcarbazole skeleton, a perylene pigment, anthraquinone and multicyclic quinone pigments, a quinoneimine pigment, diphenylmethane and triphenylmethane pigments, benzoquinone and naphthoquinone pigments, cyanine and azomethine pigments, an indigoido pigment and a bisbenzimidazole pigment. These charge generating substances may be used individually or in combination.

Among them, an oxytitaniumphthalocyanine represented by the following Formula (1) is one of preferred materials.

Formula (1)

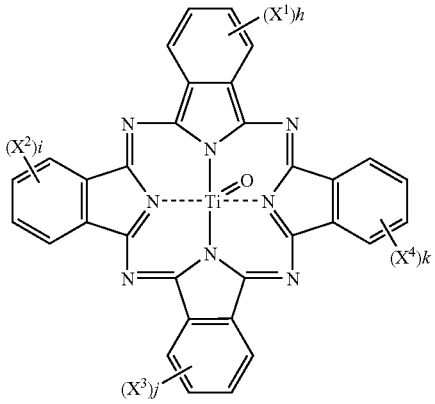

wherein $X^1$, $X^2$, $X^3$ and $X^4$ represent respectively a Cl atom or a Br atom and h, i, j and k are respectively an integer of 0 to 4.

The crystalline form of the oxytitaniumphthalocyanine is not restricted and may be properly selected depending on the application. As the oxytitaniumphthalocyanine, any one of an oxytitaniumphthalocyanine having a strong peak at 9.0°, 14.2°, 23.9° and 27.1° of the Bragg angle (2θ±0.2°) in the CuKα X-ray diffractometry and an oxytitaniumphthalocyanine having a strong peak at 9.6° and 27.3° of the Black angle (2θ±0.2°) in the CuKα X-ray diffractometry is more preferred from the viewpoint of sensitivity properties.

Example sof the binder resin include a polyamide resin, a polyurethane resin, a an epoxy resin, a polyketone resin, a polycarbonate resin, a silicone resin, an acrylic resin, a polyvinylbutylal resin, a polyvinylformal resin, a polyvinyl ketone resin, a a polystyrene resin, a poly-N-vinylcarbazol resin and a polyacrylamide resin. These binder resins may be used individually or in combination.

Specific examples of the binder resin include charge transportable polymer materials described in patent documents, such as JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085 and 09-328539.

Examples of the binder resin besides the above-noted binder resins include a charge transpotable polymer having a charge transporting function, such as a polycarbonate resin, polyester resin, polyurethane resin, polyether tresin, polisiloxane resin and acrylic resin which have an aryl amine skeleton, benzidine skeleton, carbazol skeleton, stilbene skeleton and pyrrazoline skeleton; and a polymer having a polysilane skeleton.

Specific examples of the charge transpotable polymer include polysilylene polymers described in patent documents, such as JP-A Nos. 63-285552, 05-19497, 05-70595 and 10-73944.

The charge generating layer may comprise a charge transpotable substance having a low molecular weight. Preferred examples of the charge transpotable substance having a low molecular weight include an electron-hole transportable substance and an electron transpotable substance.

Preferred examples of the electron transpotable substance include an electron acceptor substance, such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide and diphenoquinone derivative. These compounds may be used individually or in combination.

Preferred examples of the electron-hole transportable substance include an electron acceptor substance, such as an oxazole derivative, an oxadiazole derivative, an imidazole derivative, a monoaryl amine derivative, a diaryl amine derivative, a triaryl amine derivative, a stilbene derivative, an α-phenylstilbene derivative, a benzidine derivative, a diarylmethane derivative, a triarylmethane derivative, a 9-styrylanthracene derivative, a pyrazoline derivative, a divinylbenzene derivative, a hydrazone derivative, an indene derivative, a butadiene derivative, a pyrene derivative, a bis-stilbene derivative and an enamine derivative. These ion-hole transportable substances may be used individually or in combination.

The disposing method of the charge transportable layer is not restricted and may be selected depending on the application. Examples of the disposing method include a vacuum thin-film formation method and a casting method using a dispersion.

Preferred examples of the vacuum thin-film formation method include a vacuum metallizing method, a glow discharge decomposition method, an ion plating method, a sputtering method, a reactive sputtering method and a CVD method.

The method for disposing the charge generating layer by the casting method comprises, for example, dispersing the organic or inorganic charge generating substance and optionally together with a binder resin in a solvent using an apparatus, such as a ball mill, an attritor, a sand mill and a beads mill, thereby obtaining a dispersion, and coating with a coating liquid prepared by diluting properly the obtained dispersion. Examples of the above-noted solvent include tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate and butyl acetate. The above-note dispersion may optionally comprise a leveling agent, such as a dimethyl silicone oil and a methylphenyl silicone oil. Examples of the method for the above-noted coating include a dip coating method, a spray coating method, a bead coating method and a ring coating method.

The charge generating layer has a thickeness of preferably 0.01 μm to 5 μm, more preferably 0.05 μm to 2 μm.

—Charge Transportable Layer—

The charge transportable layer has a charge transporting function and is disposed according to a method comprising dissolving or dispersimg a charge transportable substance having a charge transporting function and a binder resin in a proper solvent, thereby preparing a coating liquid (solution or dispersion), coating the charge generating layer with the above-prepared coating liquid and drying the resultant coating.

Examples of the charge transportable substance include the electron transportable substance, the electron-hole transportable substance and the charge transportable polymer, which are noted in the section of "Charge Generating Layer" above. As noted above, it is particularly useful that the charge transportable polymer is used, because the solbility of a layer under the cross-linked charge transportable layer can be lowered during the disposing of the cross-linked charge transportable layer.

Examples of the binder resin include a polystyrene resin, a styrene-acrylonitrile copolymer, a styrene-butadiene copolymer, a styrene-maleic anhydride copolymer, a polyester resin, a polyvinyl chloride resin, a vinyl chloride-vinyl acetate copolymer, a polyvinyl acetate resin, a polyvinylidene chloride resin, a polyarylate resin, a phenoxy resin, a polycarbonate resin, a cellulose acetate resin, an ethyl cellulose resin, a polyvinylbutyral resin, a polyvinylformal resin, a polyvinyltoluene resin, a poly-N-vinylcarbazole resin, an acrylic resin, a silicone resin, an epoxy resin, a melamine resin, an urethane resin, a phenol resin and an alkyd resin.

The amount of the charge transportable substance is preferably 20 parts by mass to 300 parts by mass, more preferably 40 parts by mass to 150 parts by mass, relative to 100 parts by mass of the mass of the binder resin, with proviso that when a charge transportable polymer is used as the charge transportable substance, the charge transportable polymer may be used individually or in combination with the binder resin.

As the solvent used for disporsing the charge transportable layer by the coating, the same solvent as that used for disporsing the charge generating layer may be used. Preferred examples of the solvent include solvents which can advantageously dissolve the charge transportable substance and the binder resin. These solvents may be used individually or in combination. Examples of the method for disposing a layer under the charge transportable layer include the same coating method as that used for disposing the charge generating layer.

The charge transportable layer may optionally comprise a plasticizer and a leveling agent.

Examples of the plasticizer include a plasticizer used generally as a plasticizer for the resin, sach as a dibutylphthalate and a dioctylphthalate. The amount of the plasticizer is properly around 0 part by mass to 30 parts by mass, relative to 100 parts by mass of the mass of the binder resin.

Examples of the leveling agent include a silicone oil, such as a dimethylsilicone oil and a methylphenyl silicone oil and a polymer or oligomer which have a perfluoroalkyl group in the side chain. The amount of the leveling agent is properly around 0 part by mass to 1 part by mass, relative to 100 parts by mass of the mass of the binder resin.

The thickness of the charge transportable layer is not restricted an d may be selected depending on the application. The thickness is preferably 5 μm to 40 μm, more preferably 10 μm to 30 μm.

—Cross-Linked Charge Transportable Layer—

On the charge transportable layer, the cross-linked charge transportable layer is disposed according to a method comprising coating the below-noted coating liquid for disposing the cross-linked charge transportable layer, optionally drying the resultant coating and curing the coating using an outernal energy, such as a heat and an irradiated light.

The cross-linked charge transportable layer comprises the cross-linkage structure having a charge transporting function and is disposed according to a method comprising dissolving or dispersing at least trifunctional or more functional radical-polymerizable monomer comprising no charge transportable structure and a monofunctional radical-polymerizable compound comprising a charge transportable structure in a proper solvent, thereby preparing a coating liquid (solution or dispersion), coating the charge transportable layer with the prepared coating and drying the resultant coating.

Next, with respect to the composition component of a coating liquid used for disposing the cross-linked charge transportable layer according to the present invention, explanations are given.

The trifunctional or more functional radical-polymerizable monomer having no charge transporting function according to the present invention means a monomer not only comprising no electron-hole transportable structure, such as a triarylamine, a hydrazone, a pyrrazoline and a carbazol and no electron transportable structure, such as an electron attractive aromatic ring having a condensated polycyclic quinone group, a diphenoquinone group, a cyano group and a nitro group, but also having three or more radical polymerizable functional groups. The radical-polymerizable functional group is not restricted so long as the radical-polymerizable functional group is a radical-polymerizable group having a carbon-carbon double bond. Examples of the radical-polymerizable functional group include the below-noted 1-substituted ethylene functional groups and 1,1-substituted ethylene functional groups.

(1) Preferred examples of the 1-substituted ethylene functional group include a functional group represented by the following Formula (2):

$$CH_2{=}CH{-}X^1{-} \qquad \text{Formula (2)}$$

wherein $X^1$ represents any one of an arylene group, such as a phenylene group and a naphthylene group, which may have a substituent; an alkenylene group which may have a substituent; a —CO— group; a —COO— group; a —CON($R^{10}$)— group (wherein $R^{10}$ represents any one of an alkyl group, such as a hydrogen atom, a methyl group and an ethyl group; an alalkyl group, such as a benzyl group, a naphthylmethyl group and a phenetyl group; and an aryl group, such as a phenyl group and a naphthyl group); and a —S— group.

Examples of the above-noted substituent include a vinyl group, a stylyl group, a 2-methyl-1,3-butadienyl group, an acryloyloxy group, an acryloylamide group and a vinylthioether group.

(2) Preferred examples of the 1,1-substituted ethylene functional group include a functional group represented by the following Formula (3):

$$CH_2{=}CH(Y){-}X^2{-} \qquad \text{Formula (3)}$$

wherein Y represents any one of an alkyl group which may have a substituent; an alalkyl group which may have a substituent; an aryl group, such as a phenyl group and a naphthyl group, which may have substituent; a halogen atom; a cyano group; a nitro group; an alkoxy group, such as a methoxy group and an ethoxy group; and a —COOR$^{11}$ group ((wherein $R^{11}$ represents any one of a hydrogen atom; an alkyl group, such as a methyl group and an ethyl group, which may have substituent; an alalkyl group, such as a benzyl group and a phenetyl group, which may have substituent; an aryl group, such as a phenyl group and a naphthyl group, which may have substituent; and a —CONR$^{12}$R$^{13}$ group (wherein $R^{12}$ and $R^{13}$ independently represent any one of a hydrogen atom; an alkyl group, such as a methyl group and an ethyl group, which may have substituent; an alalkyl group, such as a benzyl group, a naphthylmethyl group and a phenetyl group, which may have substituent; an aryl group, such as a phenyl group and a naphthyl group, which may have substituent)): and $X^2$ represents any one of the same group as $X^1$, a group having a single bond, and an alkylene group: with proviso that at least any one of Y and $X^2$ represents any one of an oxycarbonyl group, a cyano group, an alkenylene group and an aromatic cyclic group.

Examples of the above-noted substituent include α-chloride acrylolyoxy group, a methacrylolyoxy group, a α-cyanoethylene group, a α-cyanoacryloyloxy group, a α-cyanophenylene group and a methacryloylamino group.

Examples of the substituent by which the substituent of X or Y is substituted include a halogen atom; a nitro group; a cyano group; an alkyl group, such as a methyl group and a ethyl group; an alkoxy group, such as a methoxy group and an ethoxy group; an aryloxy group, such as a phenoxy group; a aryl group, such as a phenyl group and a naphthyl group; and an alalkyl group, such as a benzyl group and a phenetyl group.

Among these radical-polymerizable functional groups, particularly an acryloyloxy group and a methacryloyloxy group are useful and a compound having three or more acryloyloxy groups can be obtained, for example by subjecting a compound having three or more hydroxyl groups in the molecule, an acrylic acid (or a salt thereof), a halide acrylic acid and an acrylate ester to an esterification reaction or an ester exchange reaction. A compound having three or more methacryloyloxy groups can be obtained in the same manner as the above-noted manner for obtaining the a compound having three or more acryloyloxy groups. Three or more radical-polymerizable functional groups in the monomer before the polymerization may be the same as or different from each other.

Examples of the three or more radical-polymerizable monomer having no charge transportable structure include the following monomers, which should not be construed as limiting the scope of the present invention.

Examples of the above-noted radical-polymerizable monomer include a trimethylolpropanetriacrylate (TMPTA), a trimethylolpropanetrimethacrylate, a HPA modified trimethylolpropanetriacrylate, a PO modified trimethylolpropanetriacrylate, a caprolactone modified trimethylolpropanetriacrylate, a HPA modified trimethylolprop anetriacrylate, a pentaerythritoltriacrylate, a pentaerythritoltetraacrylate (PETTA), a glyceroltriacrylate, a ECH modified glyceroltriacrylate, a EO modified glyceroltriacrylate, a PO modified glyceroltriacrylate, a tris(acryloxyethyl)isocyanulate, a dipentaerythritol hexaacrylate (DPHA), a caprolactone modified dipentaerythritolhexaacrylate, a dipentaerythritolhydroxyp entaacrylate, an alkyl modified pentaerythritolpentaacrylate, an alkyl modified pentaerythritoltetraacrylate, an alkyl modified dipentaerythritoltriacrylate, a dimethylolprop anetetraacrylate (DTMPTA), a pentaerythritolethoxyteteraacrylate, an EO modified phosphoric acid triacrylate and 2,2,5,5-tetrahydroxymethylcyclopentanone.

These monomers may be used individually or in combination.

In the trifunctional or more functional radical-polymerizable monomer having no charge transportable structure, for forming a dense cross-linkage in the cross-linked charge transportable layer, the ratio of the molecular weight of the monomer to the number of the functional groups in the monomer (molecular weight/number of functional groups) is preferably 250 or less. When the ratio is more than 250, the cross-linked charge transportable layer becomes flexible and the hardwearing properties of the cross-linked charge transportable layer becomes lower to some extent, so that it is not preferred that among the above-exemplified monomers, a monomer having a modifying group, such as HPA, EO and PO which is extremely large is used individually. The amount of the trifunctional or more functional radical-polymerizable monomer having no charge transportable structure which is used for disposing the cross-linked charge transportable layer is preferably 20% by mass to 80% by mass, more preferably 30% by mass to 70% by mass, based on the mass of the cross-linked charge transportable layer. When the amount is less than 20% by mass, the three-dimensional cross-linkage density of the cross-linked charge transportable layer is low, so that rapid improving of the hardwearing properties of the photoconductive body cannot be obtained sometimes in comparison with the case where a conventional thermoplastic resin is used. On the other hand, when the amount is more than 80% by mass, the amount of the charge transportable compound is lowered, so that the electrical properties of the photoconductive body are impaired. Since the electrical properties and hardwearing properties required for the photoconductive body vary depending on the process in which the photoconductive body is used and accordingly, the thickness of the charge transportable layer of the photoconductive body according to the present invention should be varied, it cannot be sweepingly mentioned that taking into consideration the balance between the above-noted two properties, the above-noted amount is most preferably 30% by mass to 70% by mass.

The monofunctional radical-polymerizable monomer having a charge transporting function, which is used for disposing the cross-linked charge transportable layer according to the present invention means a monomer not only comprising an electron-hole transportable structure, such as a triarylamine, a hydrazone, a pyrrazoline and a carbazol and an electron transportable structure, such as an electron attractive aromatic ring having a condensated polycyclic quinone group, a diphenoquinone group, a cyano group and a nitro group, but also having one radical polymerizable functional group. Examples of the radical polymerizable functional group include the radical polymerizable functional groups exemplified in the above section of 1-substituted ethylene functional groups and 1,1-substituted ethylene functional groups. Among them, particularly an acryloyloxy group and a methacryloyloxy group are useful. Further, as the charge transportable structure, a triarylamine structure is highly effective and when a compound represented by the following structural Formula (4) or (5) is used, the electrical properties, such as sensitivity and residual potential can be advantageously maintained.

Formula (4)

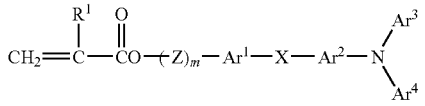

Formula (5)

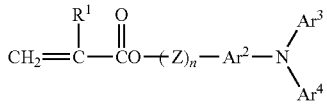

In the above Formulae (4) and (5), $R^1$ represents any one of a hydrogen atom, a halogen atom, an alkyl group which may have a substituent, an alalkyl group which may have a substituent, an aryl group which may have a substituent, a cyano group, a nitro group, an alkoxy group, a —$COOR^7$ group (wherein $R^7$ represents any one of a hydrogen atom, an alkyl group which may have a substituent, an alalkyl group which may have a substituent and an aryl group which may have a substituent), a halogenated carbonyl group and —$CONR^8R^9$ (wherein $R^8$ and $R^9$ represent independently any one of a hydrogen atom, a halogen atom, an alkyl group which may have a substituent, an alalkyl group which may have a substituent, an aryl group which may have a substituent); $Ar^1$ and $Ar^2$ represent independently an unsubstituted or substituted arylene group; $Ar^3$ and $Ar^4$ represent independently an unsubstituted or substituted aryl group; X represents any one of a single bond, an unsubstituted or substituted alkylene group, an unsubstituted or substituted cycloalkylene group, an unsubstituted or substituted alkyleneether group, an oxygen atom, a sulfur atom and a vinylene group; Z represents any one of an unsubstituted or substituted alkylene group, an unsubstituted or substituted alkyleneether group and an alkyleneoxycarbonyl group; and m and n are independently an integer of 0 to 3.

In the above Formulae (4) and (5), examples of the substituent of the alkyl group as $R^1$ which may have a substituent include a methyl group, an ethyl group, a propyl group and a butyl group, examples of the substituent of the aryl group as $R^1$ which may have a substituent include a phenyl group and a naphthyl group, examples of the substituent of the alalkyl group as $R^1$ which may have a substituent include a benzyl group, a phenetyl group and a naphthylmethyl group, examples of the substituent of the alkoxy group as $R^1$ which may have a substituent include a methoxy group, an ethoxy group and a propoxy group. These substituents may be also substituted by a substituent, for example a halogen atom; a nitro group; a cyano group; an alkyl group, such as a methyl group and an ethyl group; an alkoxy group, such as a methoxy group and an ethoxy group; an aryloxy group, such as a phenoxy group; an aryl group, such as a phenyl group and a naphthyl group; and an alalkyl group, such as a benzyl group and a phenetyl group.

Among the substituents of $R^1$, particularly preferred are a hydrogen atom and a methyl group.

Examples of the unsubstituted or substituted aryl group as $Ar^3$ or $Ar^4$ include a condensated multicyclic hydrocarbon group, a none-condensated cyclic hydrocarbon group and a heterocyclic group.

Examples of the multicyclic hydrocarbon group in which the ring has the number of carbon atoms of preferably 18 or less include a pentanyl group, an indenyl group, a naphthyl group, an azulenyl group, a heptanyl group, a biphenylenyl group, an as-indacenyl group, a s-indacenyl group, a fluorenyl grouip, an acenaphthylenyl group, a pleiadenyl group, a acenaphthenyl group, a phenalenyl group, a phenanthryl group, an anthryl group, a fluoranthenyl group, an acetophenanthrylenyl group, an acetoantrylenyl group, a triphenylenyl group, a pyrrenyl group, a chrysenyl group and a naphthacenyl group.

Examples of the none-condensated cyclic hydrocarbon group include a monovalent group of a monocyclic hydrocarbon compound, such as benzene, diphenyl ether, a polyethylene dipheny ether, diphenylthio ether and diphenyl sulfon; a monovalent group of a none-condensated multicyclic hydrocarbon compound, such as a biphenyl, a polyphenyl, a diphenylalkane, a a diphenylalkene, a diphenylalkine, triphenylmethane, distyrylbenzene, a 1,1-diphenylcycloalkane, a polyphenylalkane and a polyphenylalkene; and a monovalent group of a collected-cyclic hydrocarbon compound, such as 9,9-diphenylfluorane.

Examples of the heterocyclic group include a monovalent group of a compound, such as carbazol, dibenzofuran, dibenzothiophene, oxyadiazole and thiadiazole.

Further, the aryl group represented by $Ar^3$ or $Ar^4$ may have the following substituents (1) to (8):

(1) a halogen atom, a cyano group and a nitro group, (2) an alkyl group (, preferably a $C_1$ to $C_{12}$ linear or branched alkyl group, more preferably a $C_1$ to $C_8$ linear or branched alkyl group, most preferably a $C_1$ to $C_4$ linear or branched alkyl group), wherein the alkyl group may have any one of a fluorine atom, a hydroxyl group, a cyano group, a $C_1$ to $C_4$ alkoxy group, a phenyl group and a phenyl group substituted by a halogen atom, a $C_1$ to $C_4$ alkyl group or a $C_1$ to $C_4$ alkoxy group and specific examples thereof include a methyl group, an ethyl group, a n-butyl group, an isopropyl group, a t-butyl group, a s-butyl group, a n-propyl group, a trifluoromethyl group, a 2-hydroxyethyl group, a 2-ethoxyethyl group, a 2-cyanoethyl group, a 2-methoxyethyl group, a benzyl group, a 4-chlorobenzyl group, a 4-methylbenzyl group and a 4-phenylbenzyl group, (3) an alkoxy group (represented by —$OR_2$, wherein $R_2$ represents an alkyl group defined in the above (2)), wherein specific examples of the alkoxy group include a methoxy group, an ethoxy group, a n-propoxy group, an isopropoxy group, a t-butoxy group, a n-butoxy group, a s-butoxy group, an isobutoxy group, a 2-hydroxyethoxy group, a benzyloxy group and a trifluoromethoxy group, (4) an aryloxy group (in which the aryl group is any one of a phenyl group and a naphthyl group), wherein the aryloxy group may have any one of a $C_1$ to $C_4$ alkoxy group, $C_1$ to $C_4$ alkyl group and a halogen atom as a substituent and specific examples thereof include a phenoxy group, a 1-naphthyloxy group, a 2-naphthyloxy group, a 4-methoxyphenoxy group and a 4-methylphenoxy group, (5) any one of an alkylmercapto group and an arylmercapto group, wherein specific examples thereof include a methylthio group, a ethylthio group, a phenylthio group and a p-methylphenylthio group, (6) a group represented by the following Formula (6):

Formula (6)

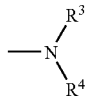

wherein $R^3$ and $R^4$ represent independently any one of a hydrogen atom, an alkyl group defined in (2) and an aryl group (examples of the aryl group include a phenyl group, a biphenyl group and a naphthyl group and the aryl group may have any one of a $C_1$ to $C_4$ alkoxy group, $C_1$ to $C_4$ alkyl group and a halogen atom as a substituent) and $R^3$ and $R^4$ may form a ring together with each other;

wherein specific examples of the group represented by the Formula (6) include an amino group, a diethylamino group, a N-methyl-N-phenyl amino group, a N,N-diphenylamino group, a N,N-ditolylamino group, a dibenzylamino group, a piperidino group, a morpholino group and a pyrrolidino group, (7) any one of an alkylenedioxy group and an alkylenedithio group, such as a methylenedioxy group and a methylenedithio group, and (8) any one of an unsubstituted or substituted styryl group, an unsubstituted or substituted β-styryl group, a diphenylaminophenyl group and a ditolylaminophenyl group.

The arylene group represented by $Ar^1$ or $Ar^2$ is a divalent group derived from the aryl group represented by $Ar^3$ or $Ar^4$.

The above-noted X represents any one of a single bond, an unsubstituted or substituted alkylene group, an unsubstituted or substituted cycloalkylene group, an unsubstituted or substituted alkylene ether group, an oxygen atom, a sulfur atom and a vinylene group.

The above-noted unsubstituted or substituted alkylene group is preferably a $C_1$ to $C_{12}$ linear or branched alkylene group, more preferably a $C_1$ to $C_8$ linear or branched alkylene group, still more preferably a $C_1$ to $C_4$ linear or branched alkylene group, wherein the alkylene group may have any one of a fluorine atom, a hydroxyl group, a cyano group, a $C_1$ to $C_4$ alkoxy group, a phenyl group and a phenyl group substituted by a halogen atom, a $C_1$ to $C_4$ alkyl group or a $C_1$ to $C_4$ alkoxy group; and specific examples of the alkylene group include a methylene group, an ethylene group, a n-butylene group, an isopropylene group, a t-butylene group, a s-butylene group, a n-propylene group, a trifluoromethylene group, a 2-hydroxyethylene group, a 2-ethoxyethylene group, a 2-cyanoethylene group, a 2-methoxyethylene group, a benzylidene group, a phenylethylene group, a 4-chlorophenylethylene group, a 4-methylphenylethylene group and a 4-biphenylethylene group.

The above-noted unsubstituted or substituted cycloalkylene group is a $C_5$ to $C_7$ cyclicalkylene group which may have any one of a fluorine atom, a hydroxyl group, a $C_1$ to $C_4$ alkyl group and a $C_1$ to $C_4$ alkoxy group, wherein examples of the unsubstituted or substituted cycloalkylene group include a cyclohexylidene group, a cyclohexylene group and 3,3-dimethylcyclohexylidene group.

Examples of the above-noted unsubstituted or substituted alkylene ether group include an ethyleneoxy group, a propyleneoxy group, an ethyleneglycol group, a propyleneglycol group, a diethyleneglycol group, a tetraethyleneglycol group and a tripropyleneglycol group and the alkylene group of the alkylene ether group may have a substituent, such as a methyl group and an ethyl group.

The above-noted vinylene group is preferably a group represented by the following formula:

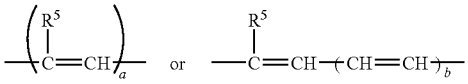

wherein $R^5$ represents any one of a hydrogen atom, an alkyl group (the same group as the alkyl group defined in the above (2)) and an aryl group (the same group as the aryl group represented by the above $Ar^3$ or $Ar^4$) and a is an integer of 1 or 2, b is an integer of 1 to 3.

The above-noted Z represents any one of an unsubstituted or substituted alkylene group, an unsubstituted or substituted alkylene ether group and an unsubstituted or substituted alkyleneoxycarbonyl group, wherein examples of the unsubstituted or substituted alkylene group and the unsubstituted or substituted alkylene ether group include respectively the same alkylene group as the alkylene group in the above X and the same alkylene ether group as the alkylene ether group in the above X and examples of the alkyleneoxycarbonyl group include a caprolactone-modified group.

More preferred examples of the above-noted monofunctional radical-polymerizable compound having a charge transportable structure include the following Formula (7):

Formula (7)

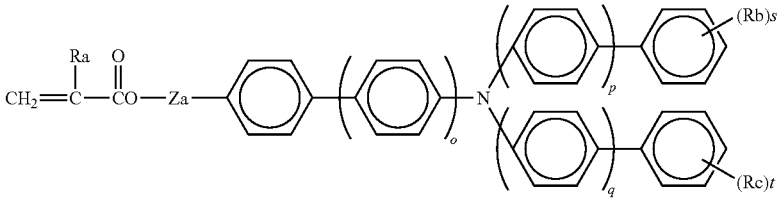

wherein o, p and q are individually an integer of 0 or 1, Ra represents any one of a hydrogen atom and a methyl group, Rb and Rc represent individually a $C_1$ to $C_6$ alkyl group, s and t are individually an integer of 0 to 3, Za represents any one of a single bond, a methylene group, a ethylene group and a group represented by the following formulae:

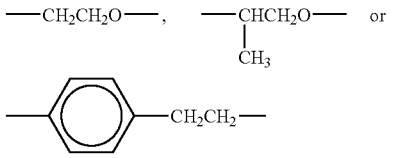

As the compound represented by the formulae (7), the compound in which the substituents Rb and Rc are individually any one of a methyl group and an ethyl group is particularly preferred.

When a radical-polymerizable monofunctional compound having a charge transportable structure, which is represented by the above-noted formula (4), (5) or (7) is polymerized, the double bonding of C═C is opened for the both side, so that the above-noted compound does not become a terminal structure and become incorporated in a chain polymer. When the above-noted compound is copolymerized with a trifunctional or more functional radical-polymerizable monomer, in the polymer formed by the cross-linking, the above-noted compound is present either in a backbone chain of the formed macromolecule or in a cross-linking chain between a backbone chain and another backbone chain (this cross-linking chain has two types, such as the intermolecular cross-linking chain between a macromolecule and another macromolecule; and the intramolecular cross-linking chain which cross-links a portion of a bended backbone chain with another portion thereof in one macromolecule). Whether the above-noted compound is present in the above-noted backbone chain or in the above-noted cross-linking chain, the triethanolamine structure pending from the chain has at least three aryl groups arranged in the radiation direction from the nitrogen atom and is bulky; however since the triethanolamine structure is bonded to the chain not directly but through the carbonyl group and is accordingly fixed in a three-dimensionally flexible state, the triethanolamine structure can be arranged in the macromolecule in such a manner that the triethanolamine structure adjoins properly to another structure and accordingly in the macromolecule containing the triethanolamine structure, the structural strain is small. Therefore, it is assumed that when the triethanolamine structure is incorporated in the surface layer of the photoconductive body for the electrophotography, the triethanolamine structure can take an intramolecular structure which is relative free from the extinction of the charge transporting path.

Specific examples of the monofunctional radical-polymerizable compound having a charge transportable structure according to the present invention include the compounds represented by the following formulae No. 1 to 160, which should not be construed as limiting the scope of the present invention.
No. 1
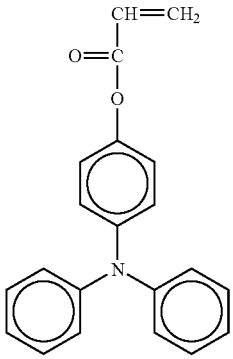
No. 2
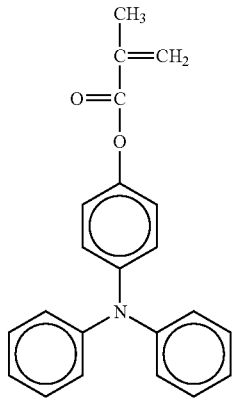
No. 3
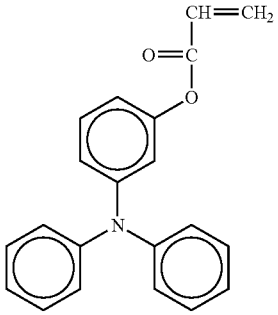
No. 4
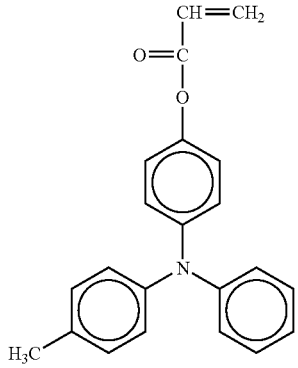
No. 5
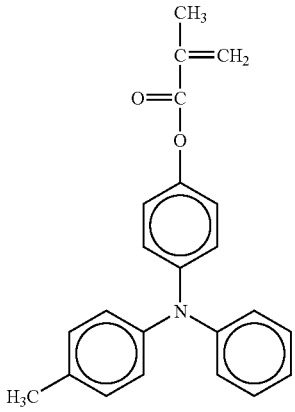
No. 6
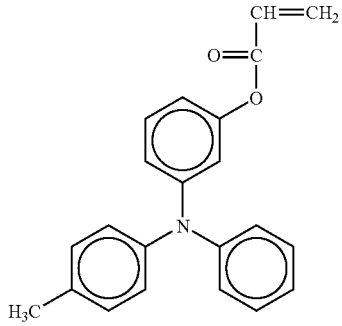

-continued
No. 7
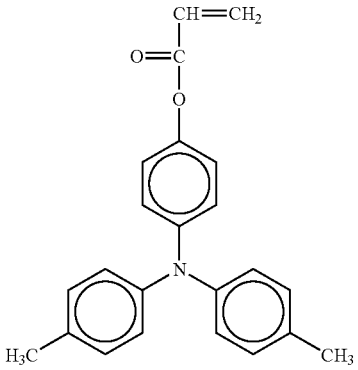
No. 8
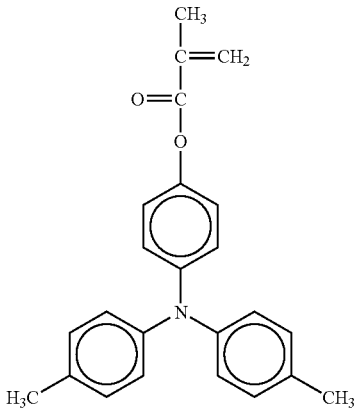
No. 9
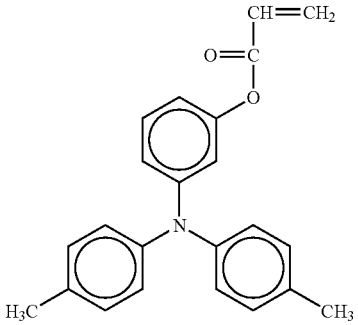
No. 10
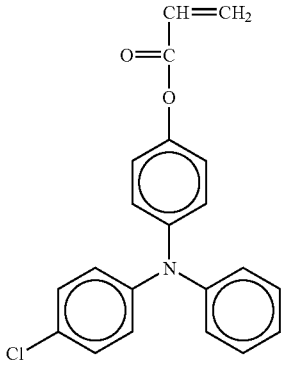
No. 11
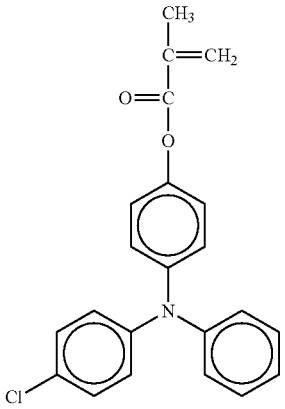
No. 12
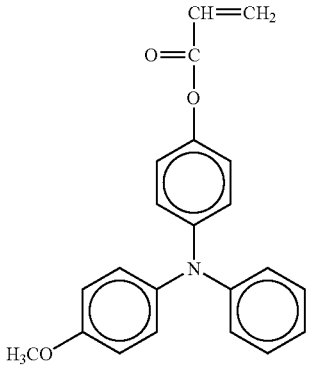
No. 13
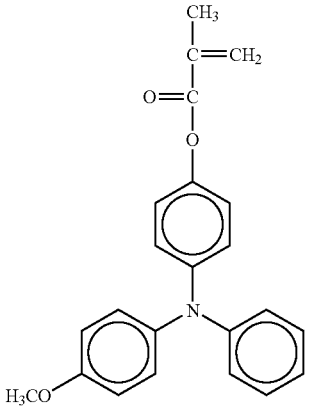
No. 14
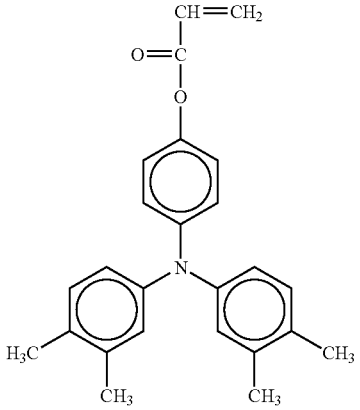

-continued
No. 15
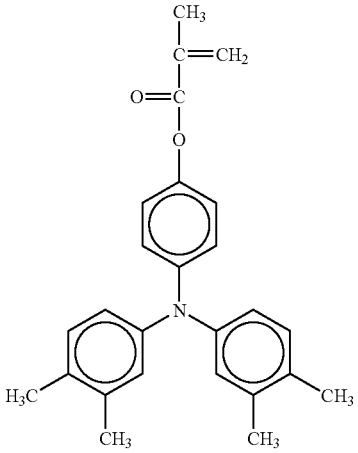
No. 16
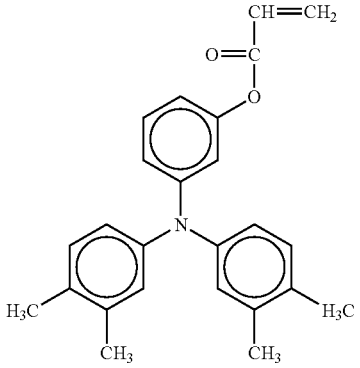
No. 17
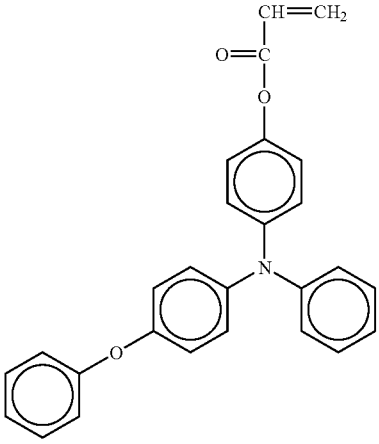
No. 18
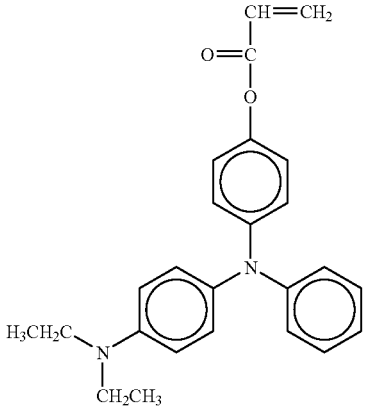
No. 19
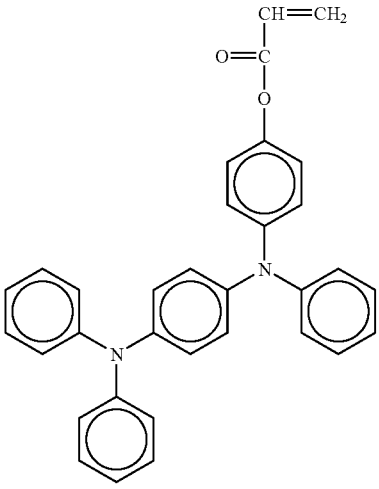
No. 20
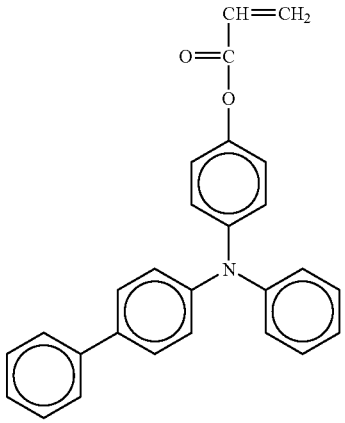

-continued
No. 21
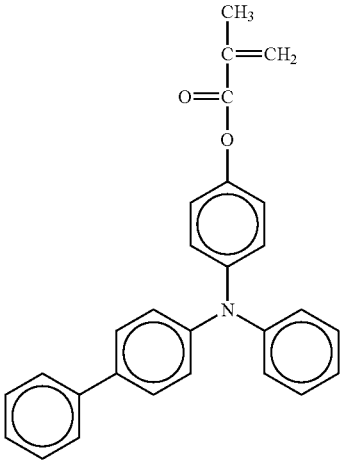
No. 22
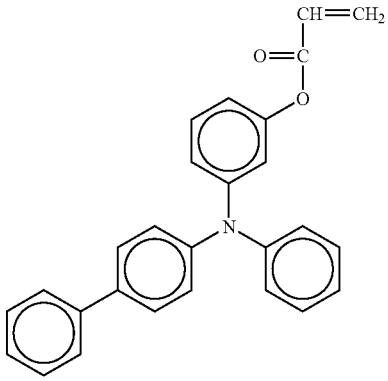
No. 23
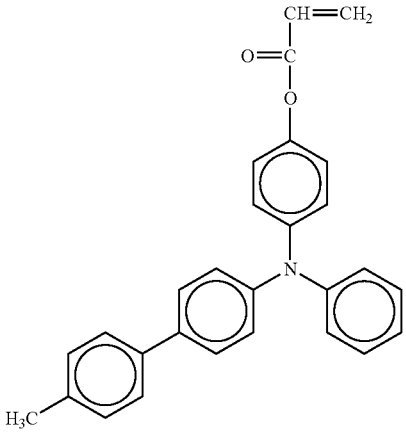
No. 24
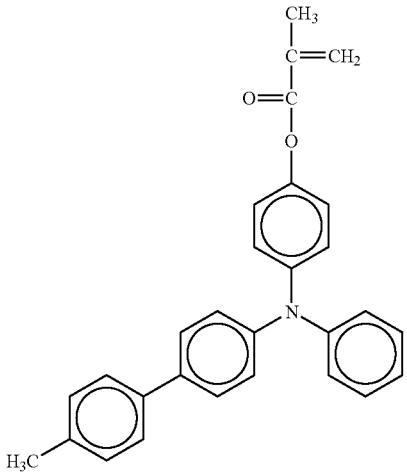
No. 25
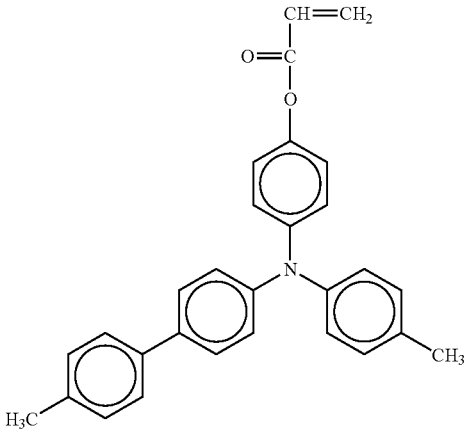
No. 26
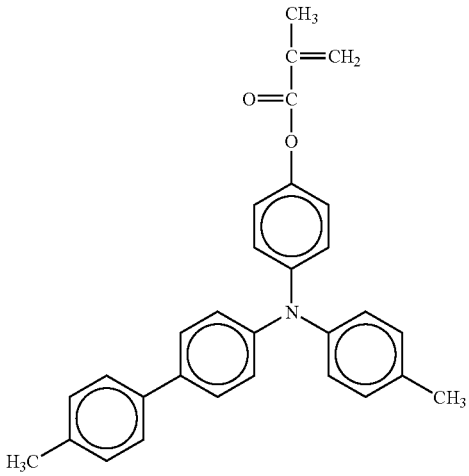

-continued
No. 27
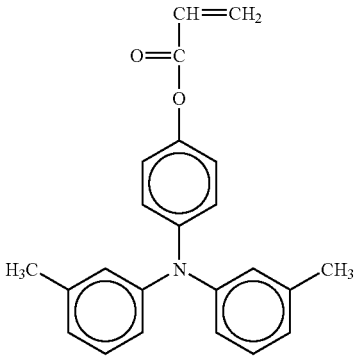
No. 28
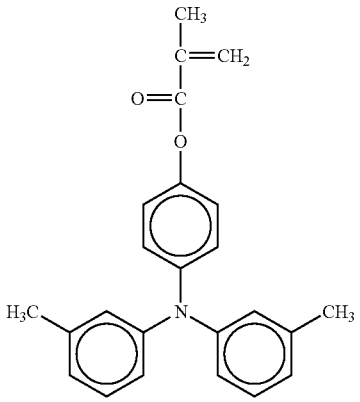
No. 29
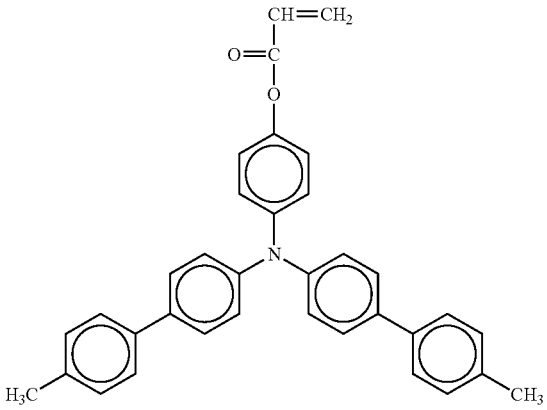
No. 30
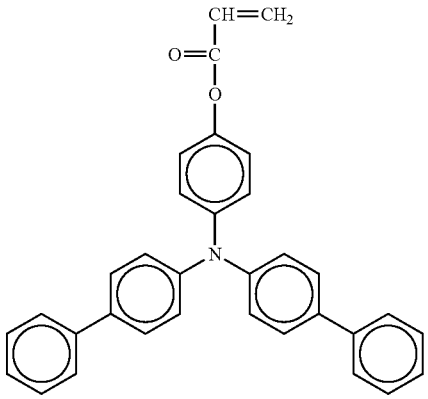
No. 31
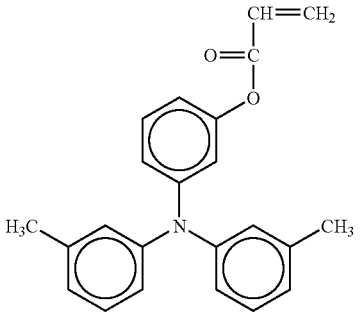
No. 32
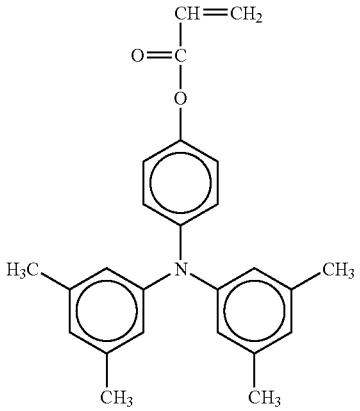

-continued
No. 33
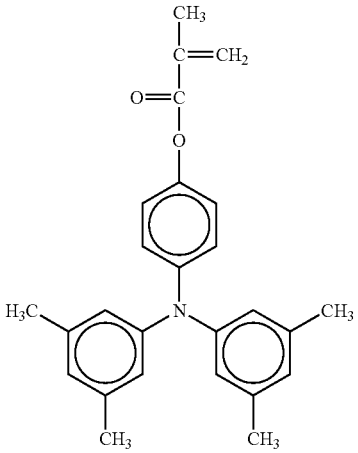
No. 34
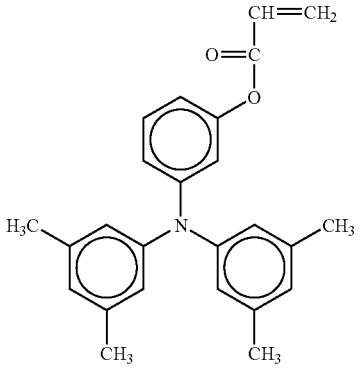
No. 35
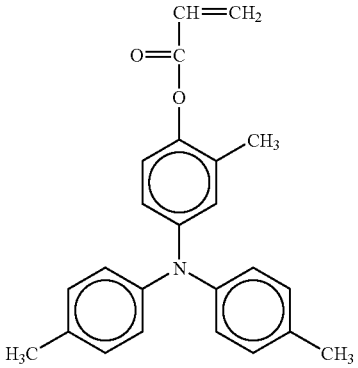
No. 36
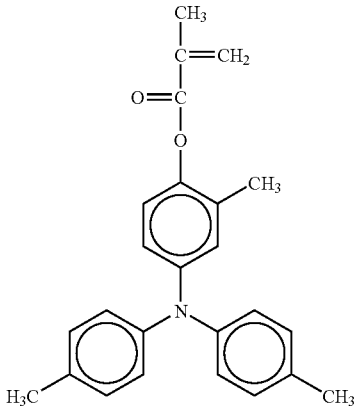
No. 37
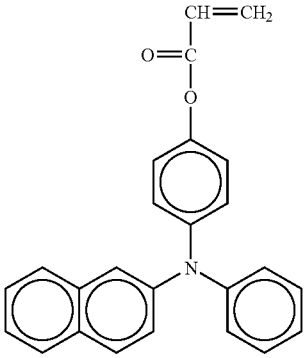
No. 38
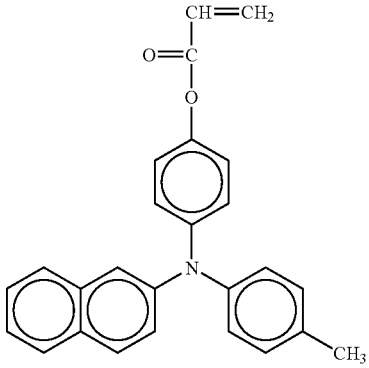
No. 39
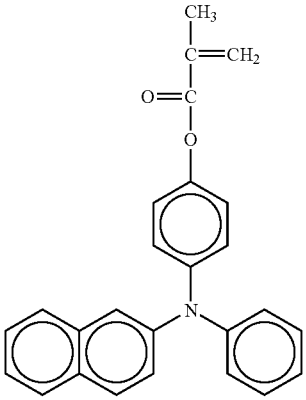
No. 40
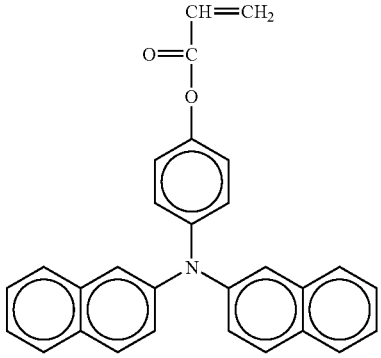

-continued
No. 41
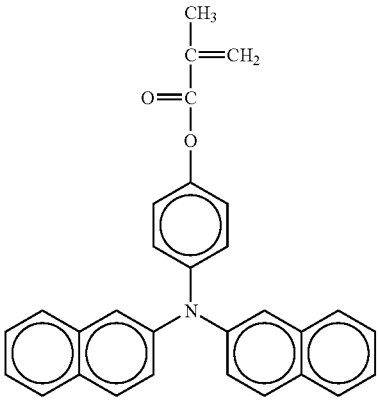
No. 42
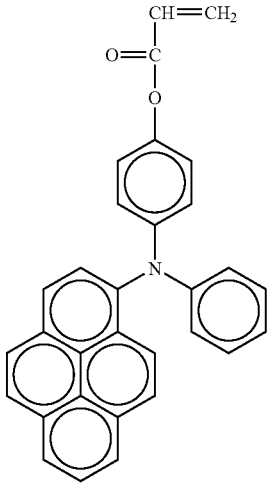
No. 43
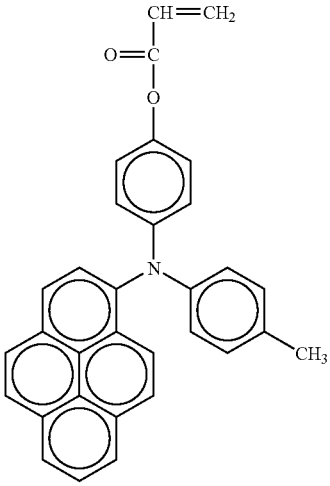
No. 44
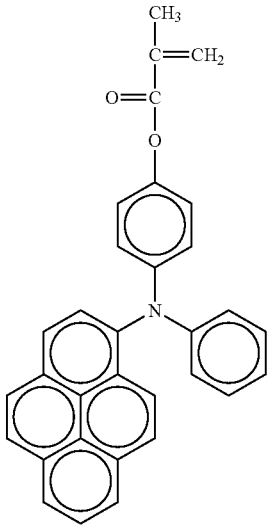
No. 45
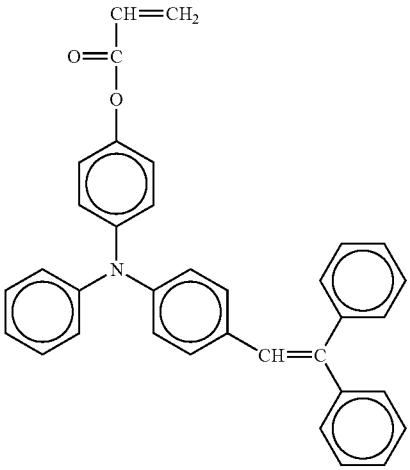
No. 46
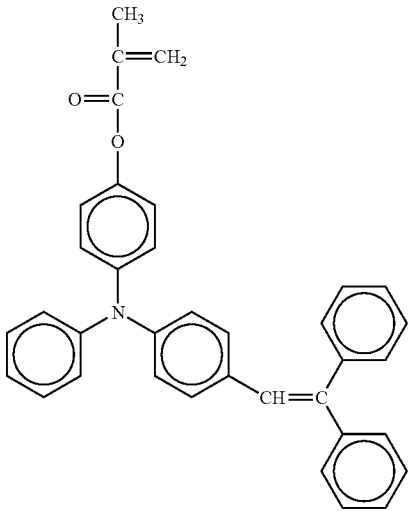

-continued
No. 47
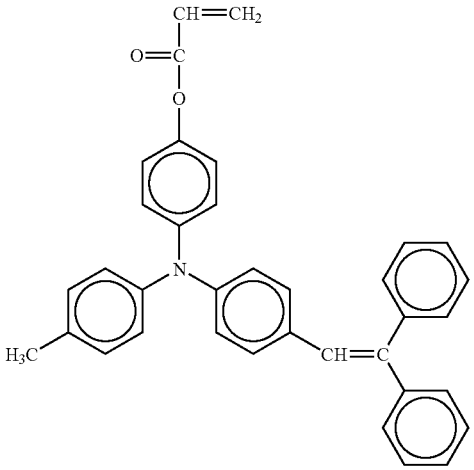
No. 48
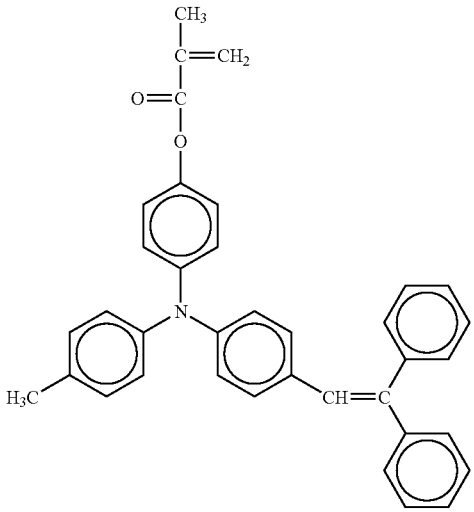
No. 49
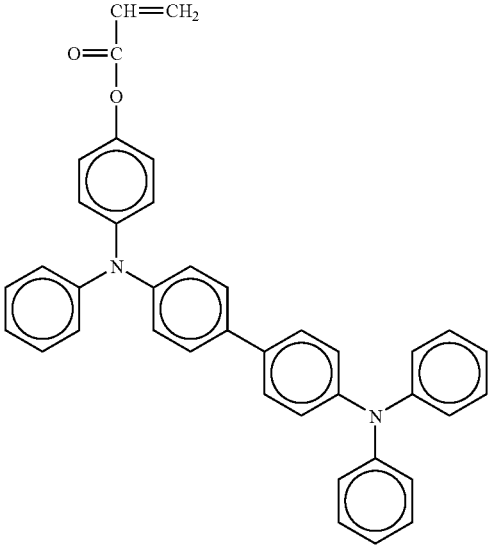
No. 50
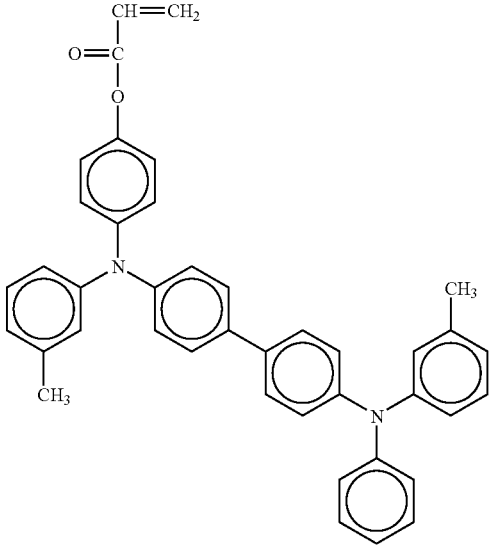
No. 51
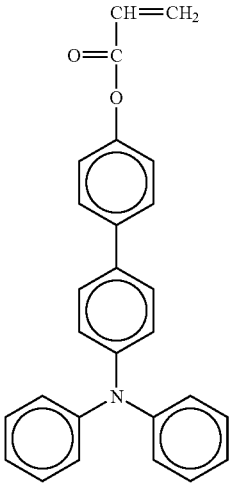
No. 52
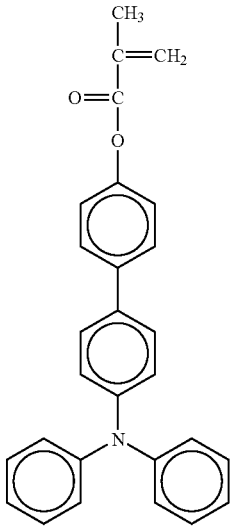

-continued
No. 53
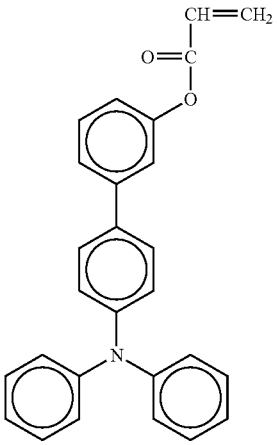
No. 54
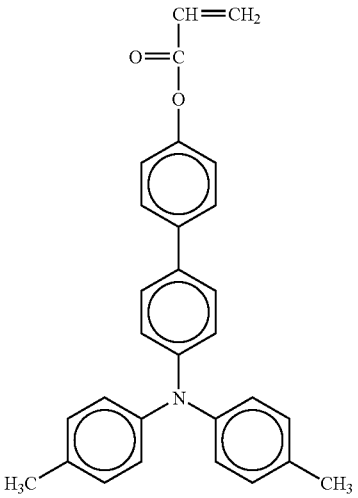
No. 55
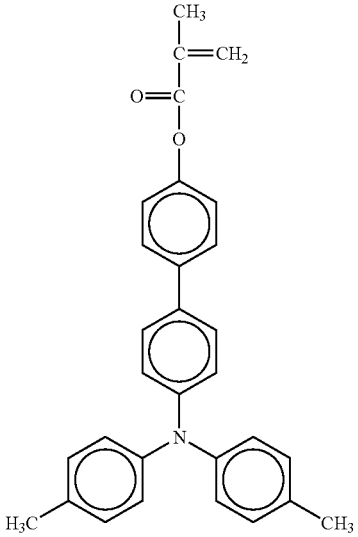
No. 56
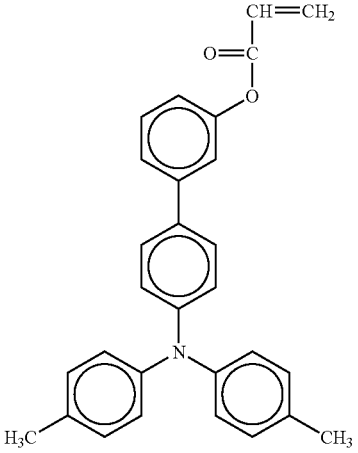
No. 57
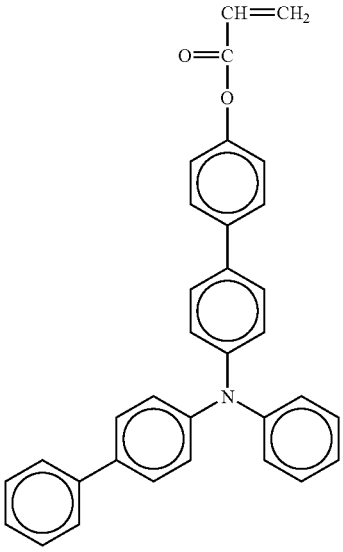
No. 58
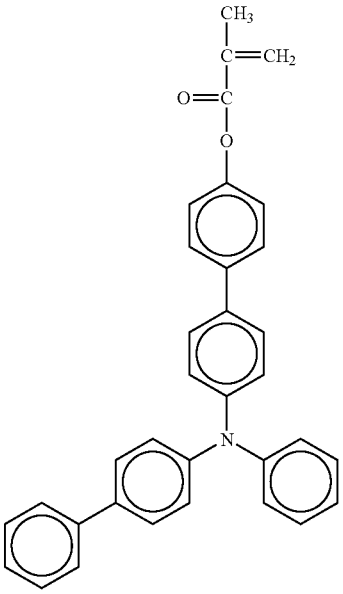

-continued
No. 59
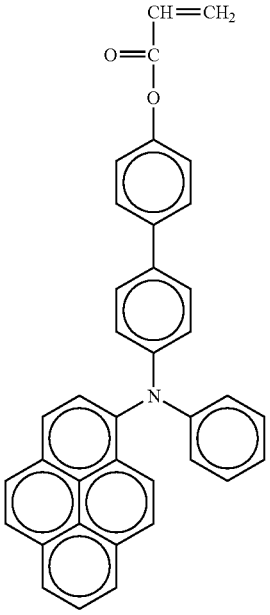
No. 60
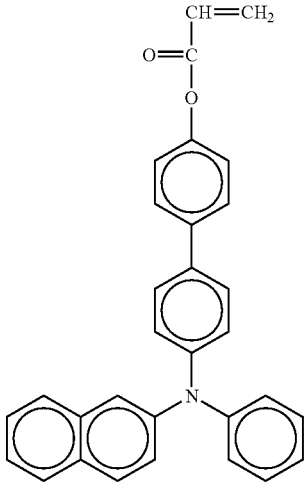
No. 61
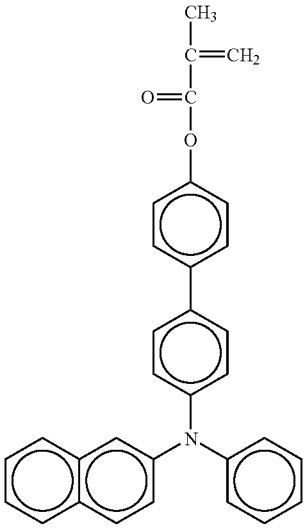
No. 62
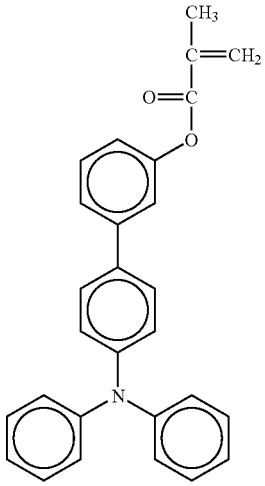

-continued
No. 63
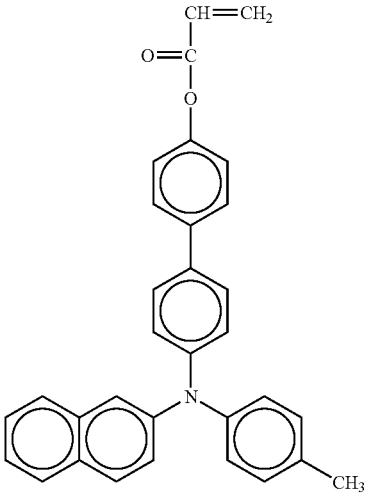
No. 64
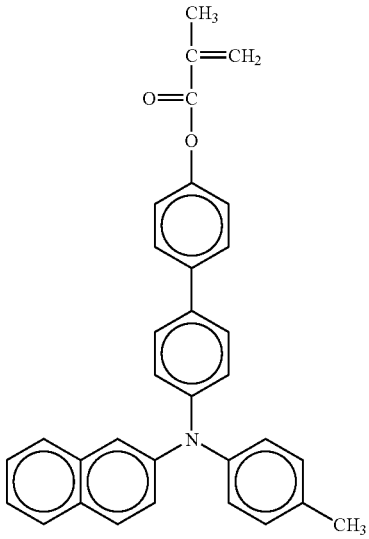
No. 65
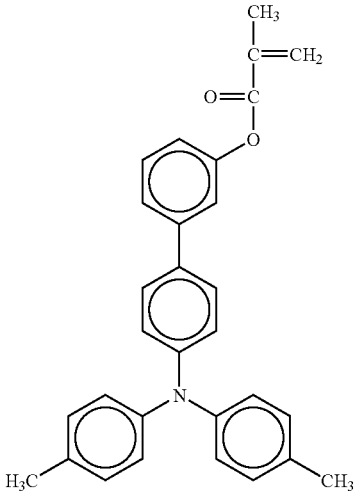
No. 66
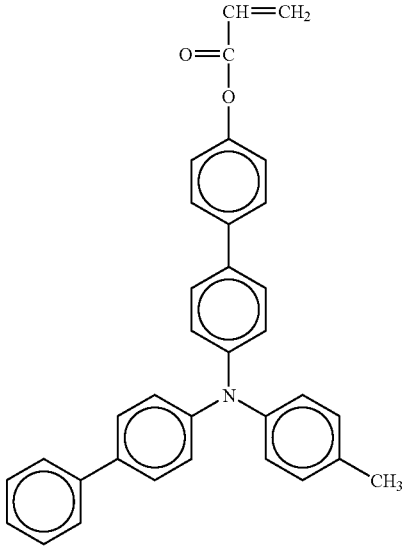

-continued
No. 67
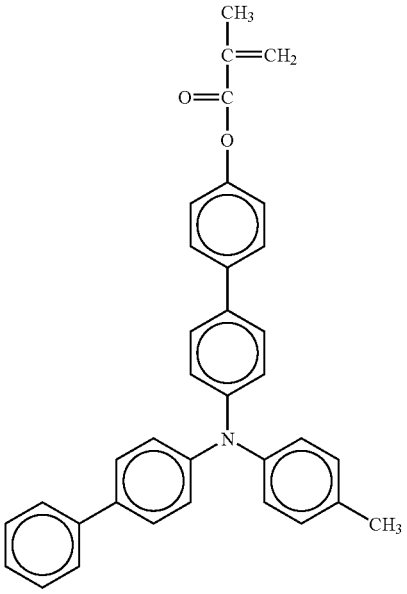
No. 68
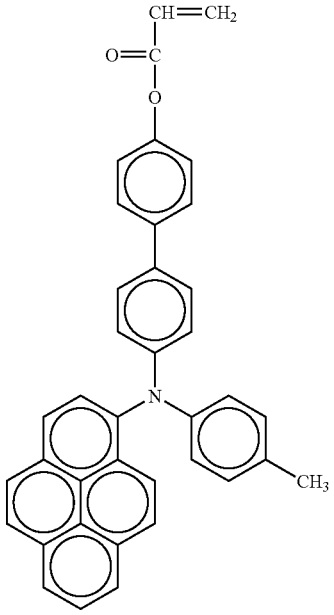
No. 69
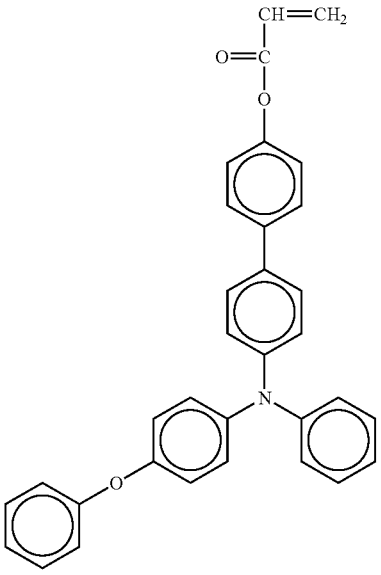
No. 70
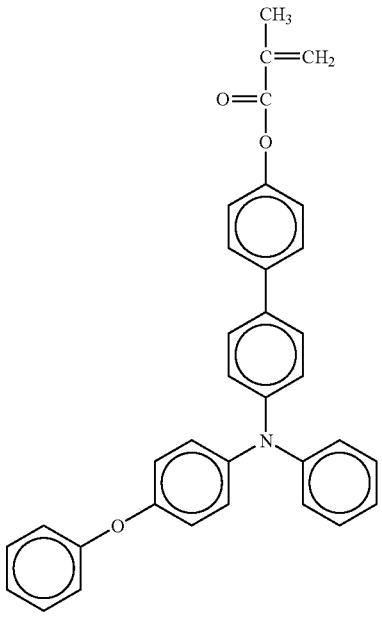

-continued
No. 71
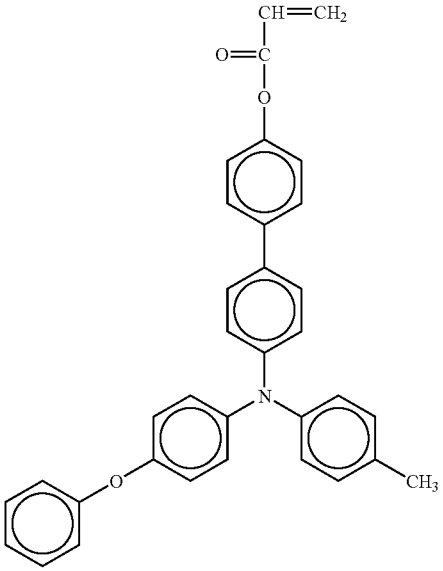
No. 72
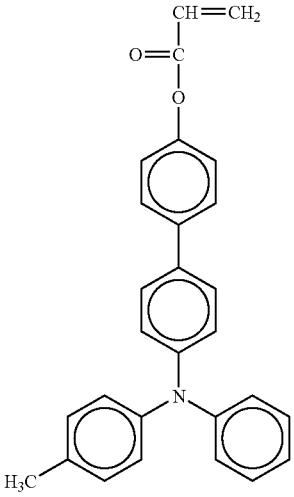
No. 73
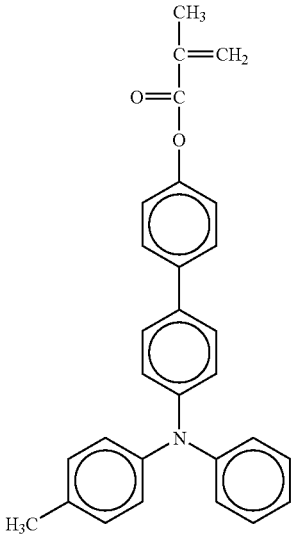
No. 74
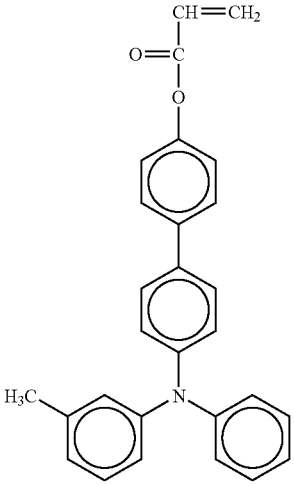
No. 75
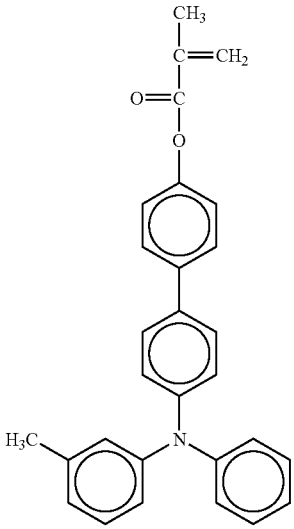
No. 76
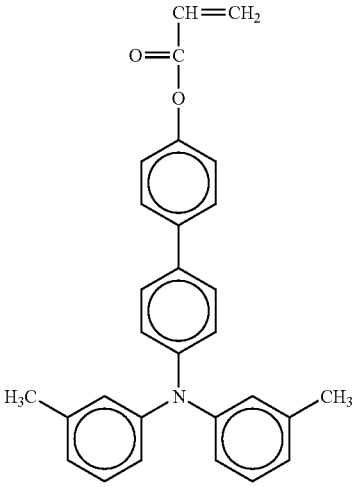

-continued
No. 77
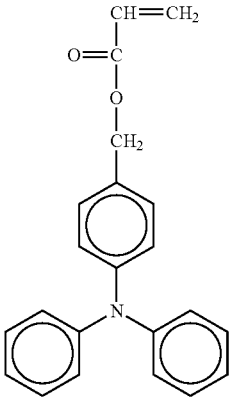
No. 78
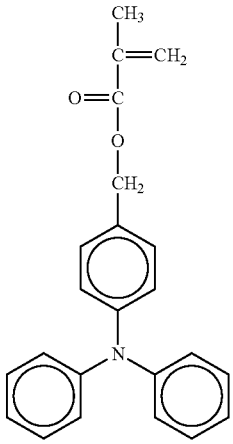
No. 79
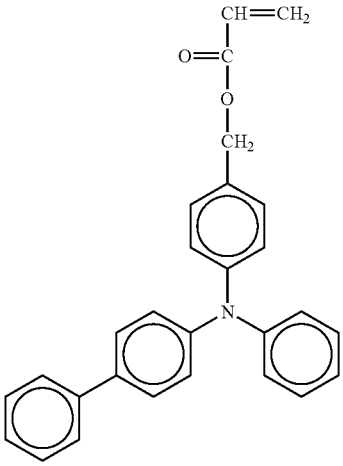
No. 80
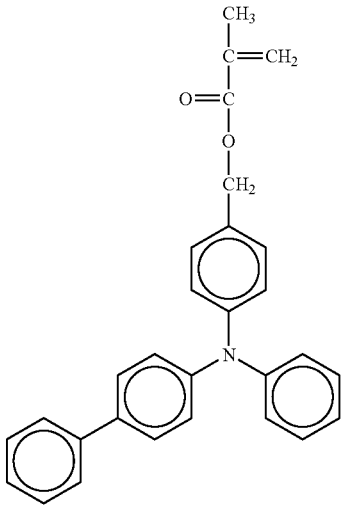
No. 81
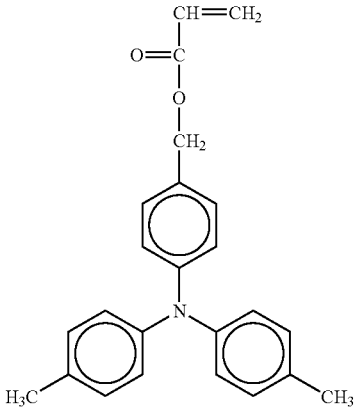
No. 82
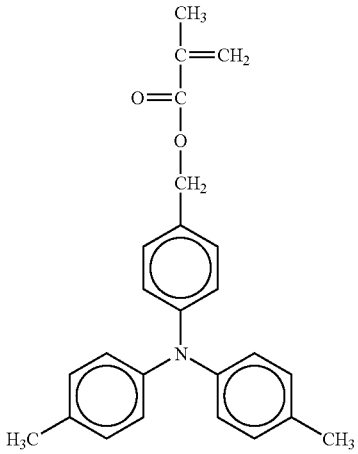

-continued
No. 83
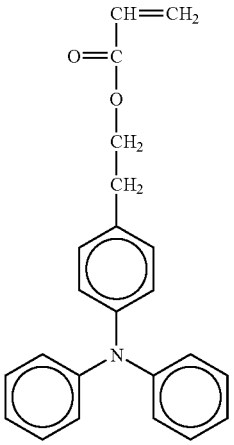
No. 84
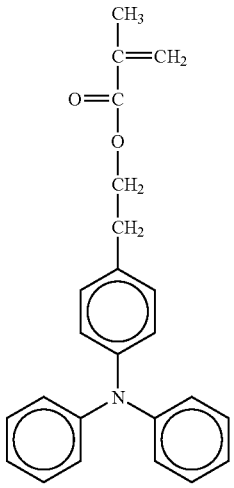
No. 85
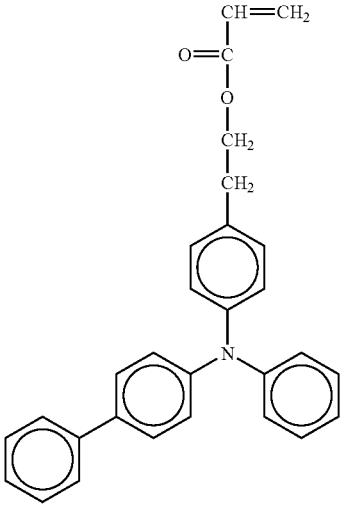
No. 86
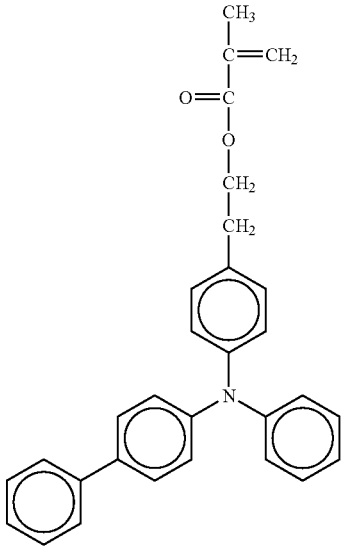
No. 87
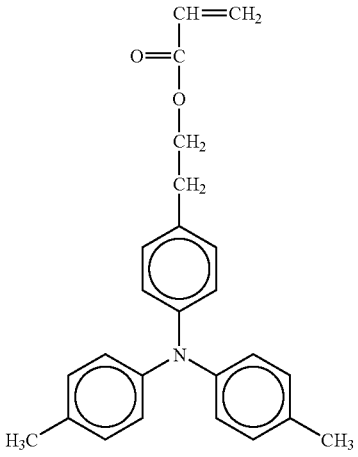
No. 88
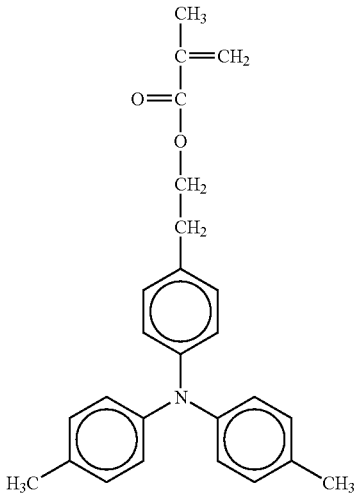

-continued
No. 89
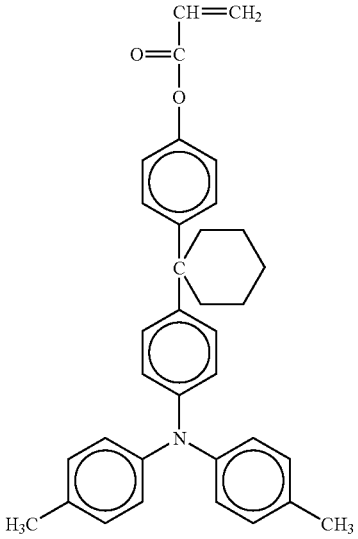
No. 90
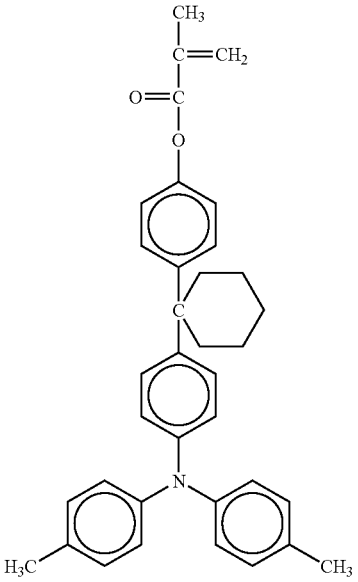
No. 91
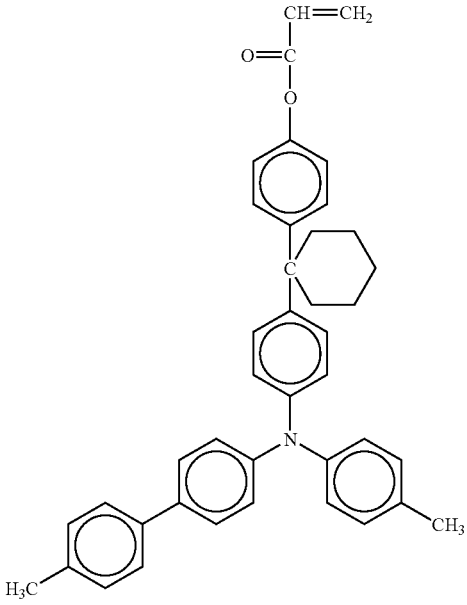
No. 92
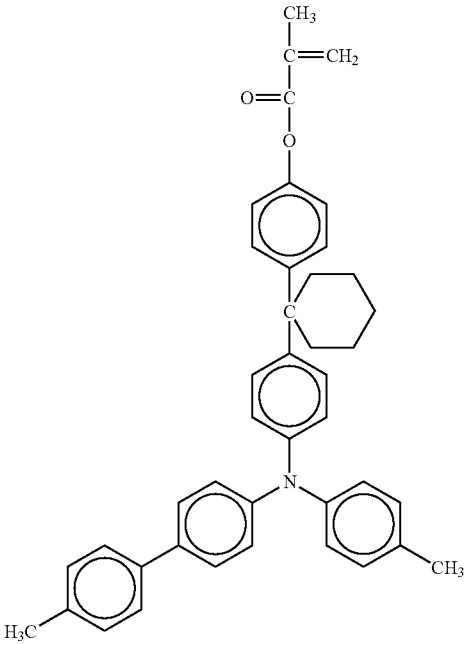

-continued
No. 93
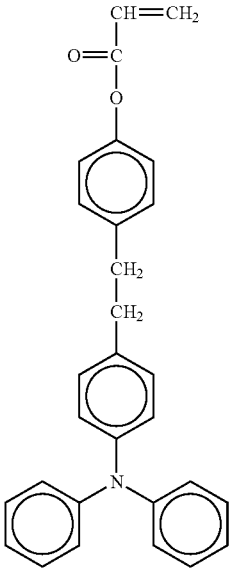
No. 94
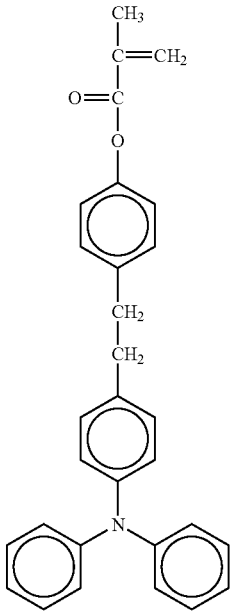
No. 95
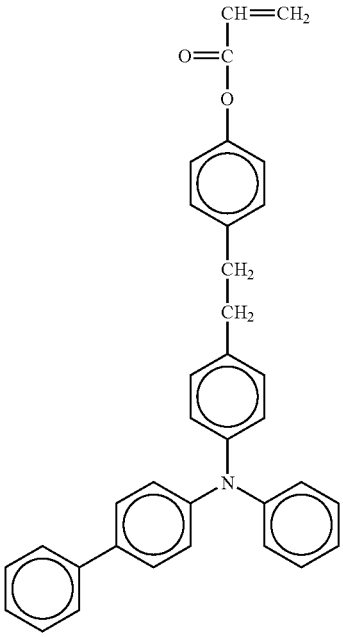
No. 96
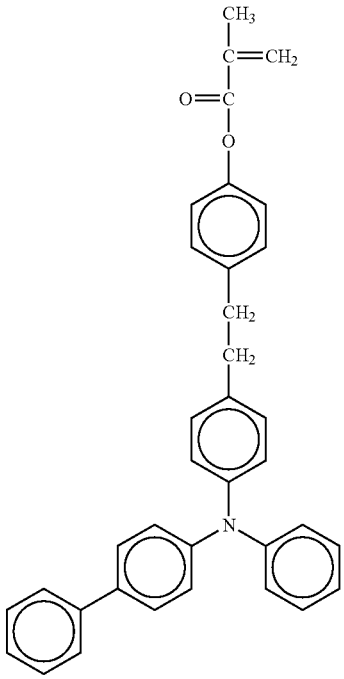

-continued
No. 97
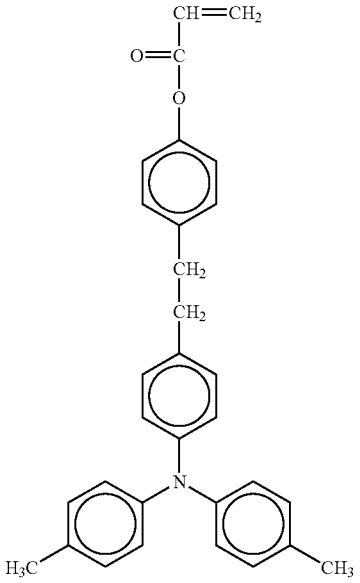
No. 98
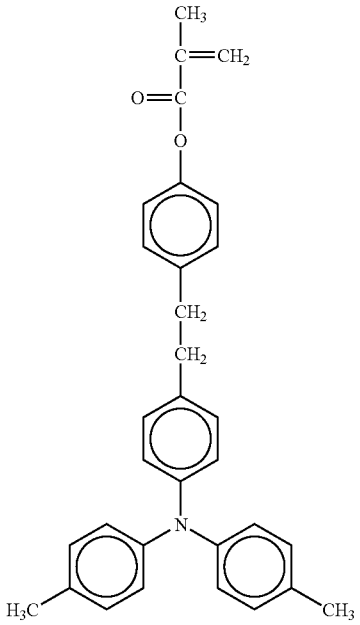
No. 99
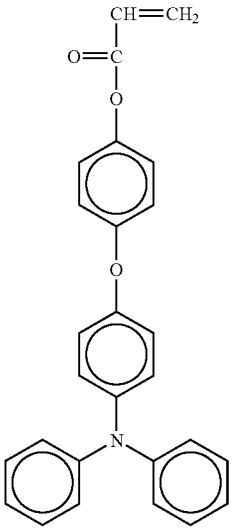
No. 100
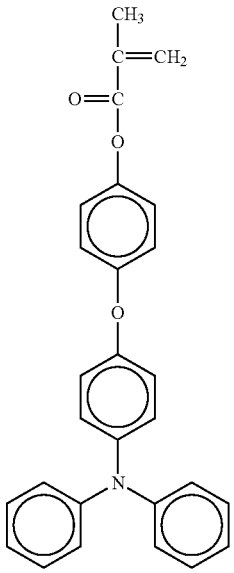

-continued
No. 101
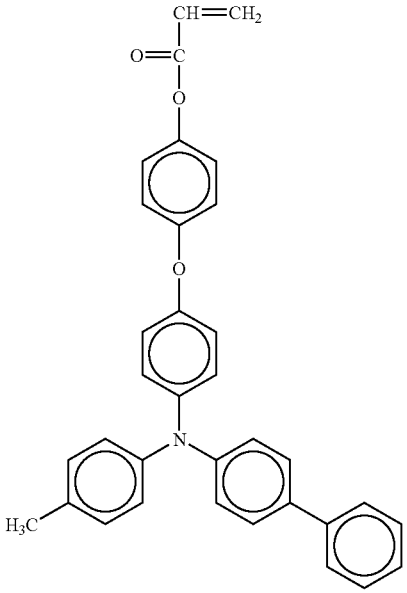
No. 102
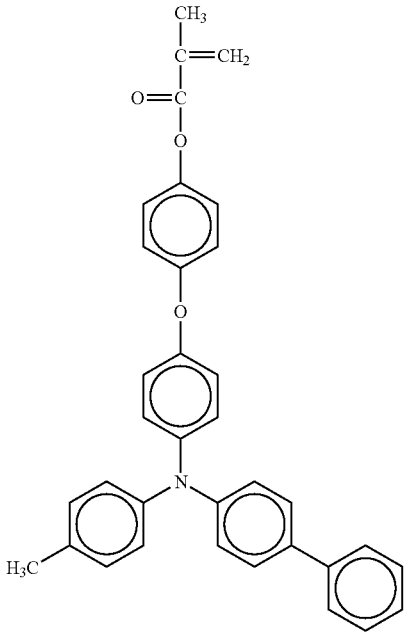
No. 103
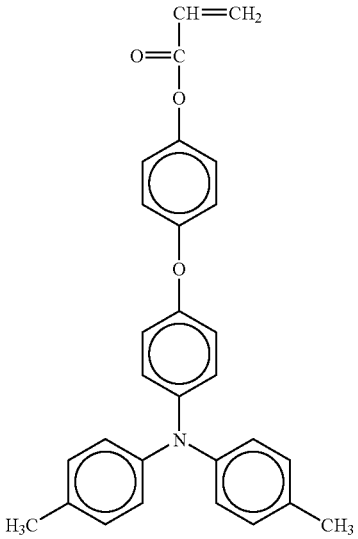
No. 104
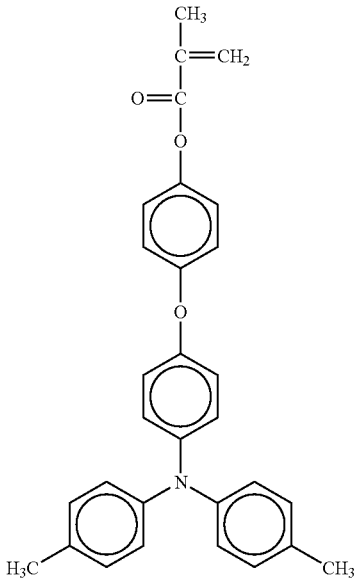

-continued
No. 105
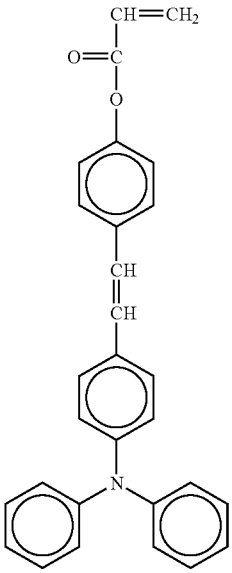
No. 106
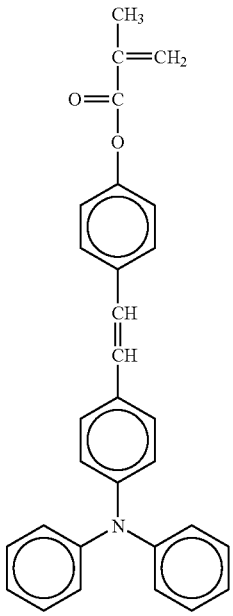
No. 107
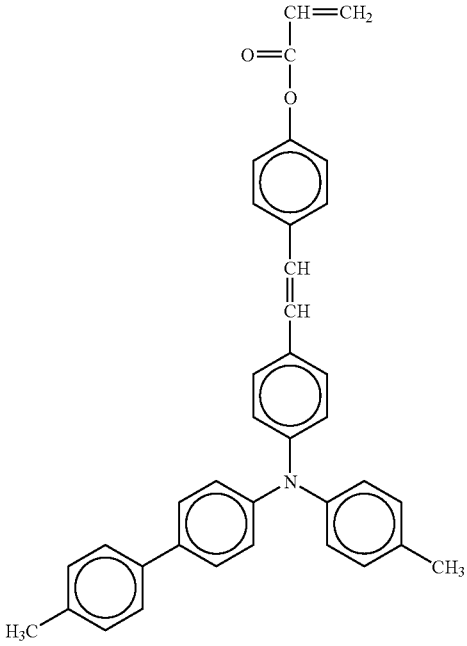
No. 108
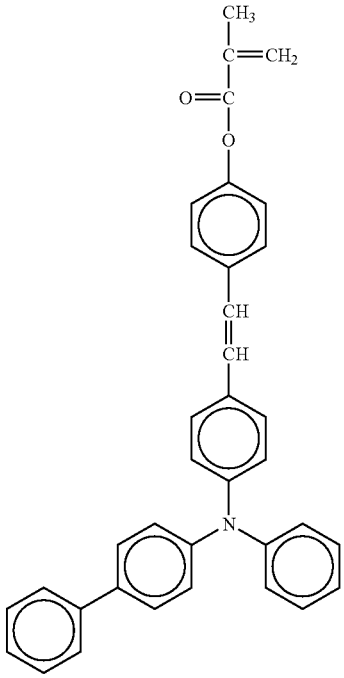

-continued
No. 109
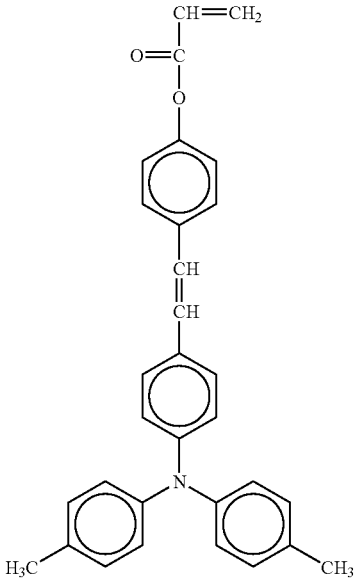
No. 110
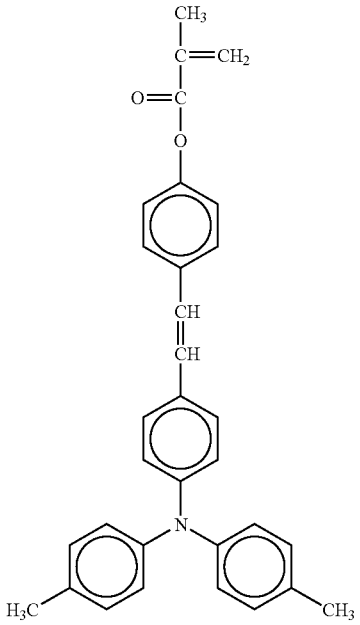
No. 111
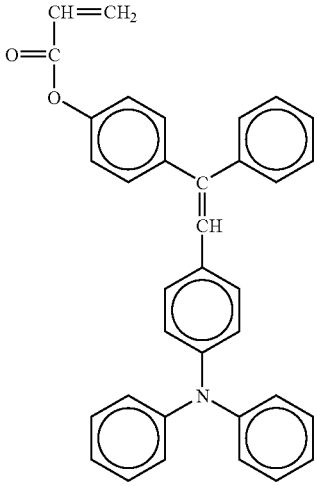
No. 112
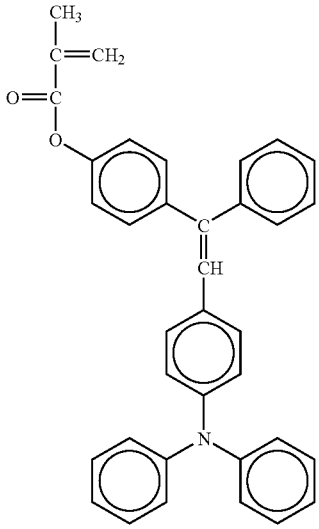

-continued
No. 113
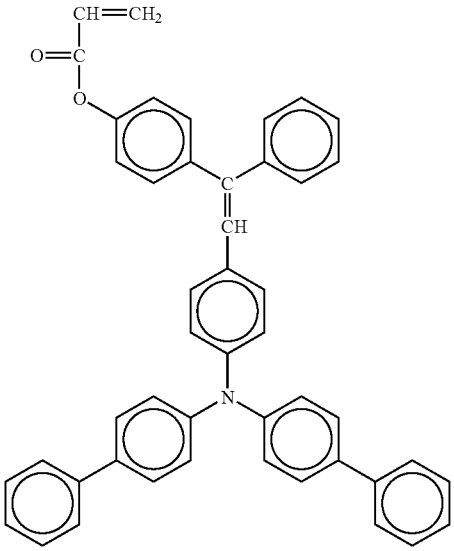
No. 114
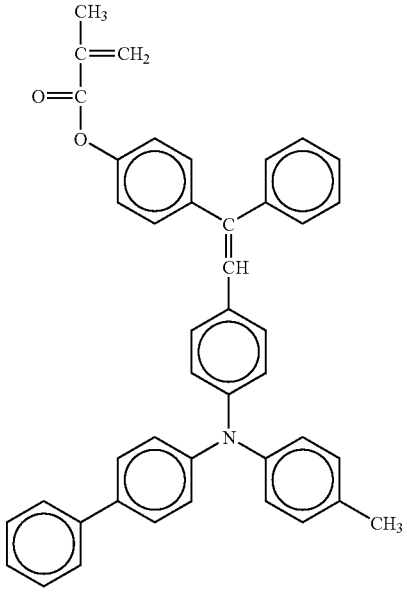
No. 115
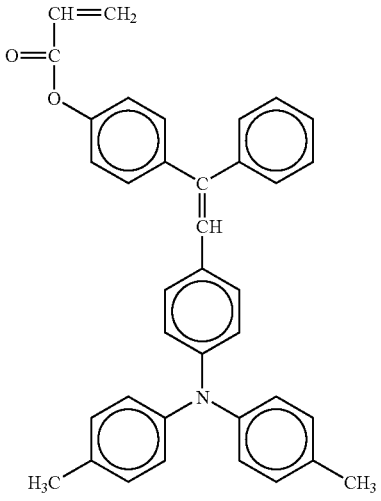
No. 116
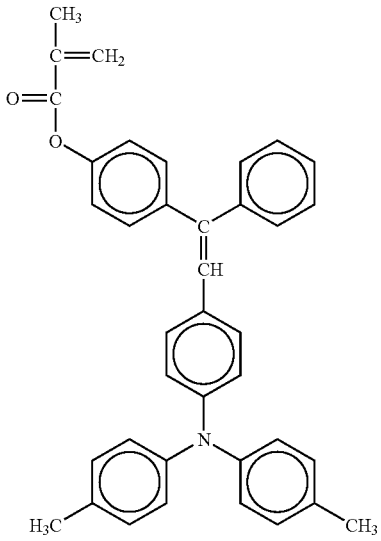

-continued
No. 117
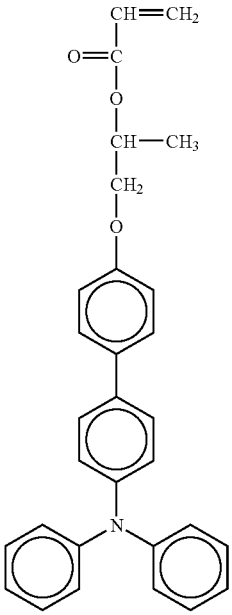
No. 118
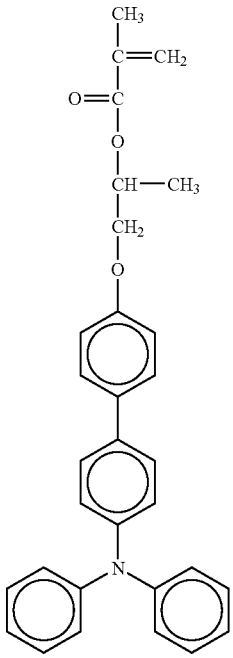
No. 119
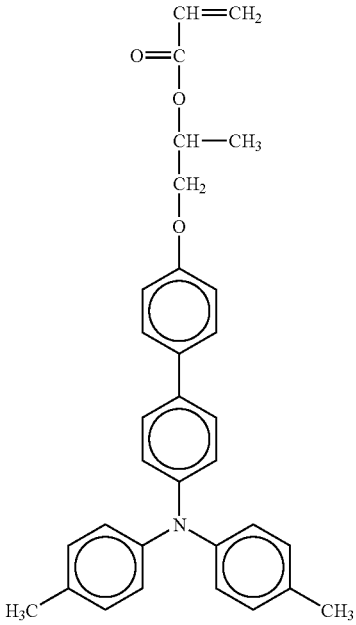
No. 120
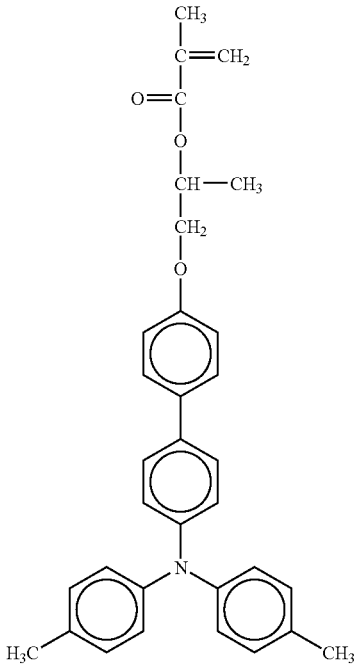

-continued
No. 121
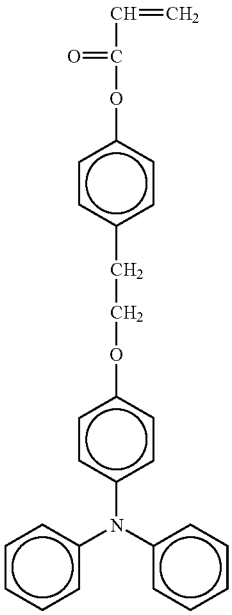
No. 122
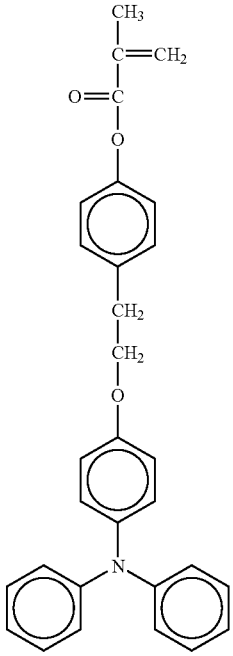
No. 123
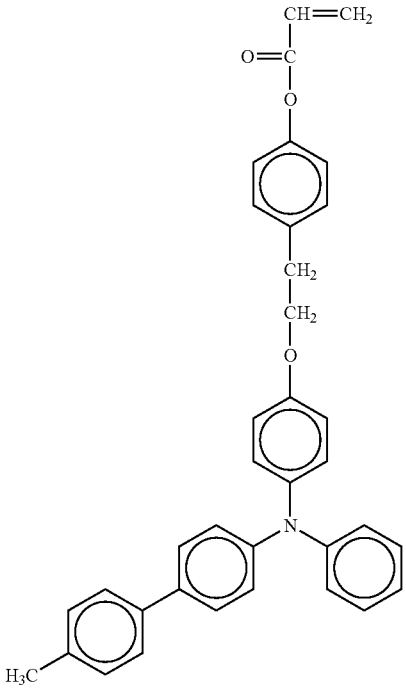
No. 124
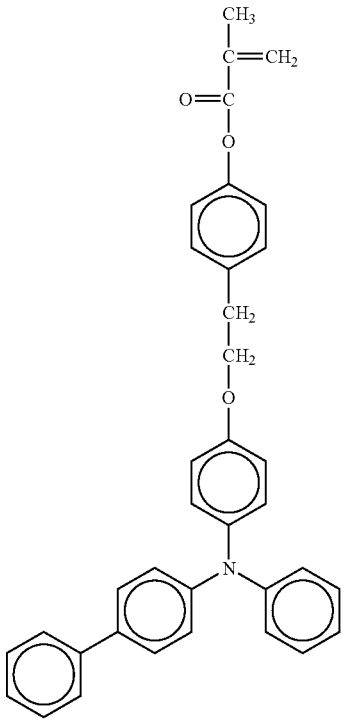

-continued
No. 125
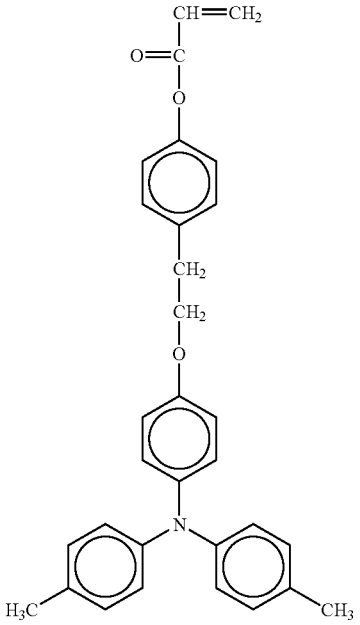
No. 126
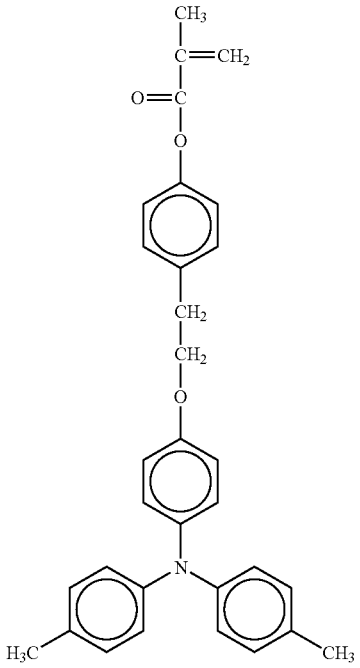
No. 127
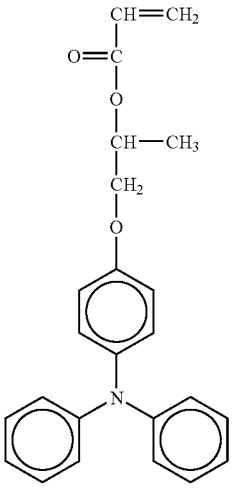
No. 128
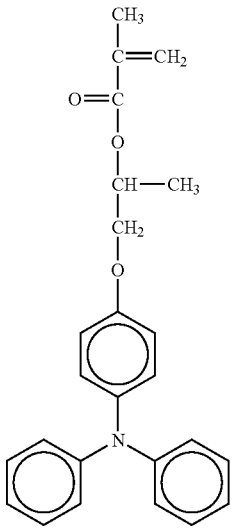

-continued
No. 129
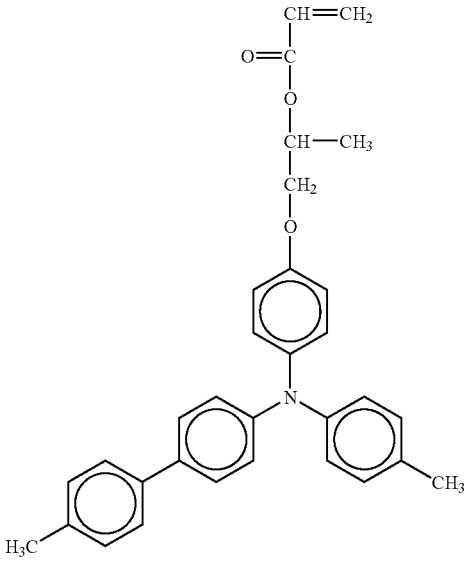
No. 130
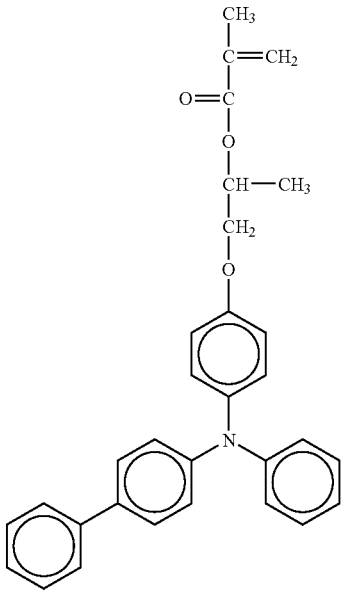
No. 131
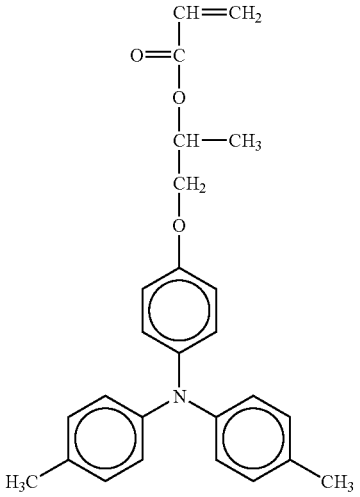
No. 132
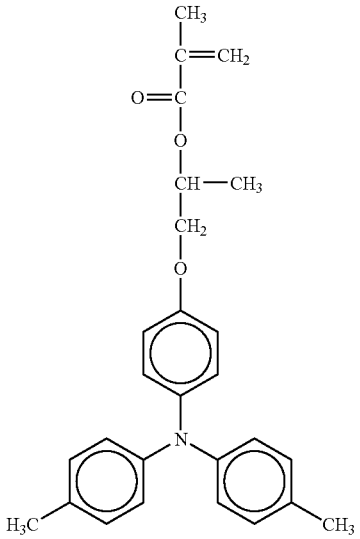
No. 133
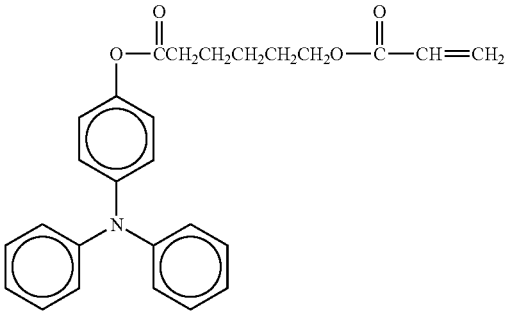
No. 134
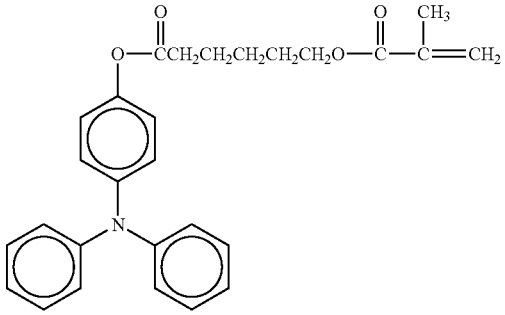

-continued
No. 135
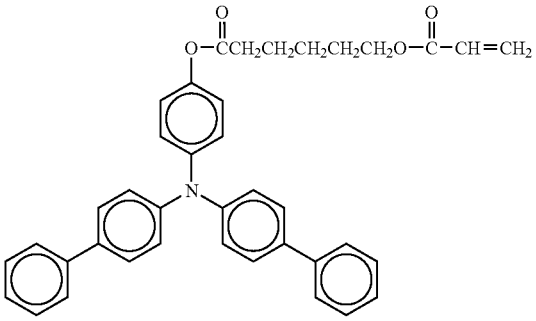
No. 136
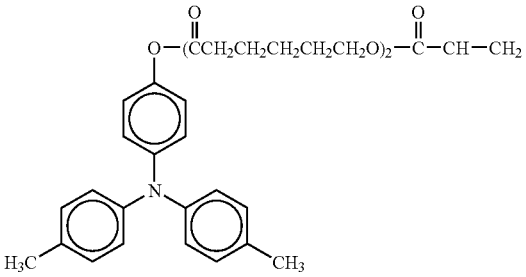
No. 137
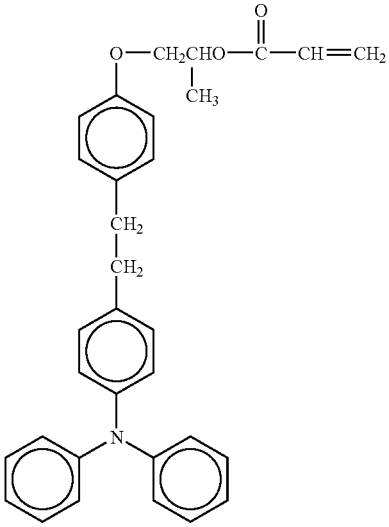
No. 138
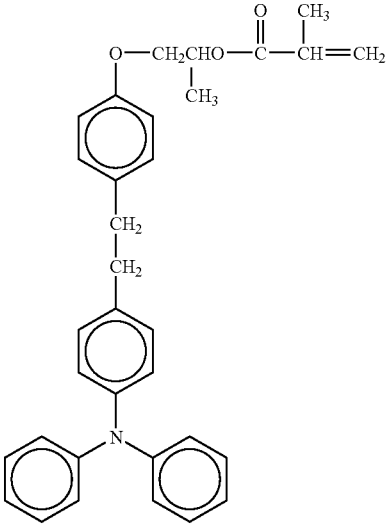
No. 139
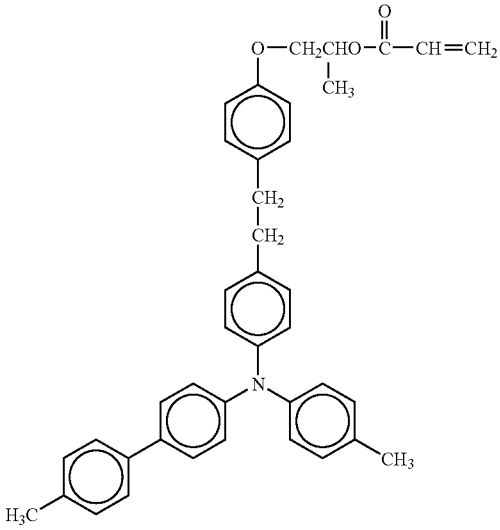
No. 140
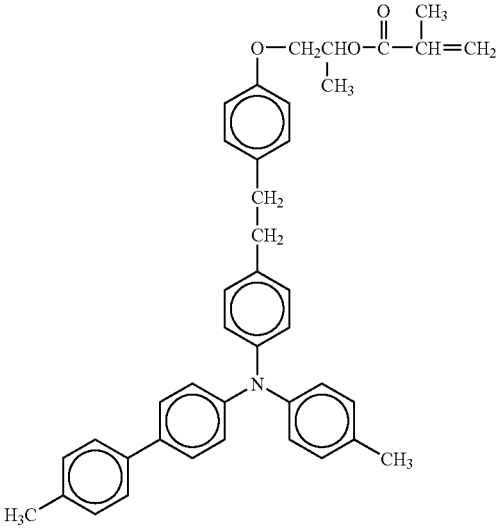

-continued
No. 141
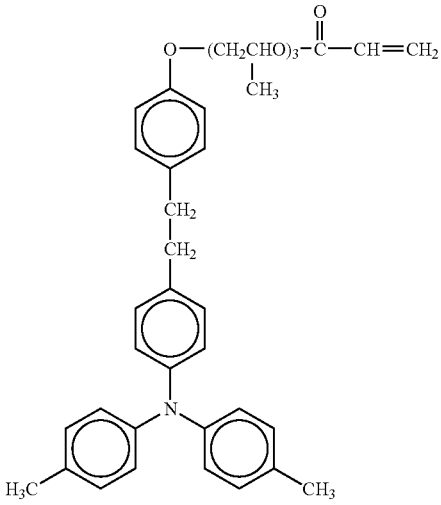
No. 142
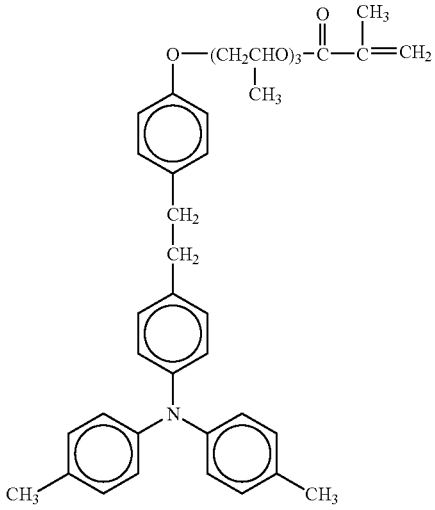
No. 143
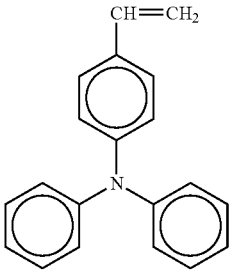
No. 144
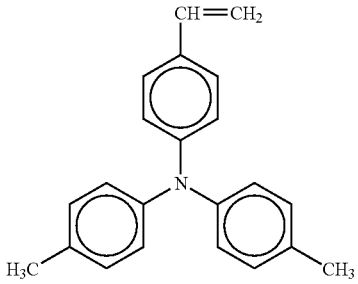
No. 145
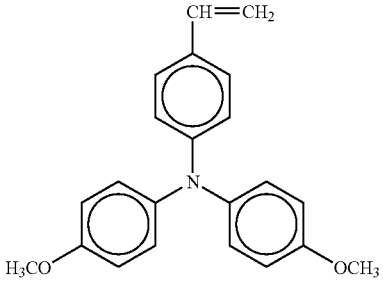
No. 146
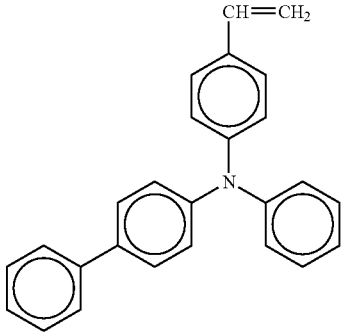
No. 147
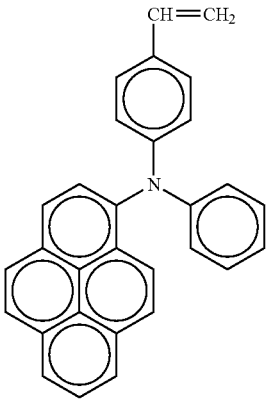
No. 148
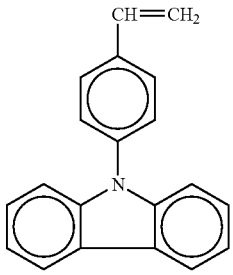

-continued
No. 149
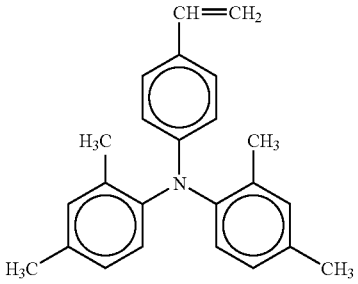
No. 150
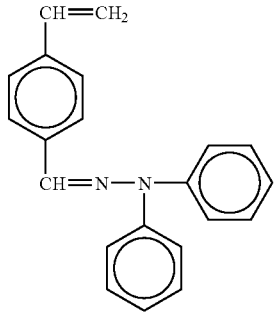
No. 151
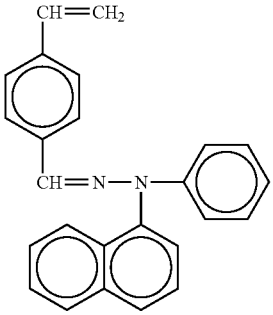
No. 152
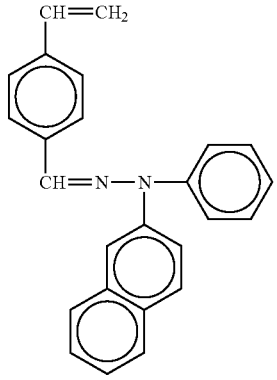
No. 153
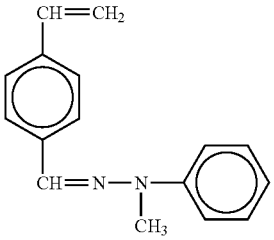
No. 154
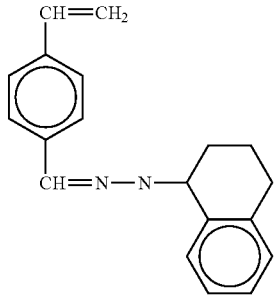
No. 155
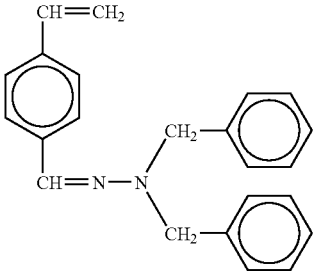
No. 156
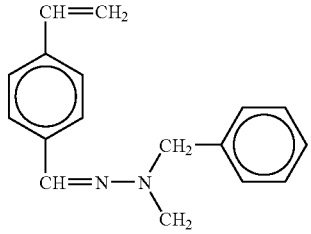
No. 157
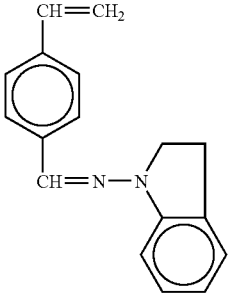
No. 158
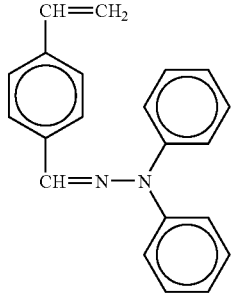

-continued

No. 159

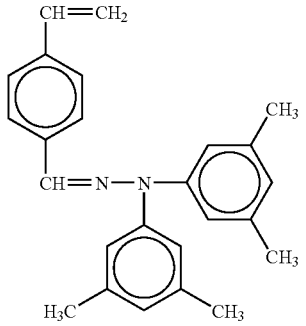

No. 160

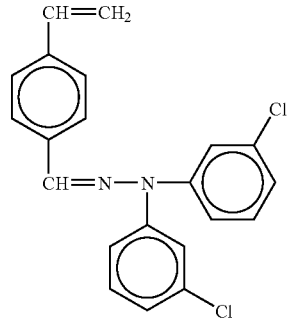

The monofunctional radical-polymerizable compound having a charge transportable structure according to the present invention is important for imparting the charge transporting function to the cross-linked charge transportable layer. The amount of the monofunctional radical-polymerizable compound having a charge transportable structure is preferably 20% by mass to 80% by mass, more preferably 30% by mass to 70% by mass, based on the mass of the the cross-linked charge transportable layer. When the amount is less than 20% by mass, the cross-linked charge transportable layer cannot satisfactorily maintain the charge transporting function, so that in the repeated using of the photoconductive body, the impairement of the electric properties of the photoconductive body, such as the lowering of the sensitivity and the elevation of the residual potential is caused sometime. On the other hand, when the amount is more than 80% by mass, the amount of the trifunctional monomer having no charge transportable structure is lowered, so that the lowering of the cross-linkage density is caused and the photoconductive body cannot exhibit high hardwearing properties sometimes. Since the electrical properties and hardwearing properties required for the photoconductive body vary depending on the process in which the photoconductive body is used and accordingly, the thickness of the charge transportable layer of the photoconductive body according to the present invention should be varied, it cannot be sweepingly mentioned that taking into consideration the balance between the above-noted two properties, the above-noted amount is most preferably 30% by mass to 70% by mass.

The cross-linked charge transportable layer is produced by curing at least the trifunctional or more functional radical-polymerizable monomer having no charge transportable structure and the monofunctional radical-polymerizable monomer having a charge transportable structure; however, besides these monomers, for imparting to the photoconductive body the functions, such as the controlling of the viscosity of the coating liquid for producing the cross-linked charge transportable layer, the relaxing of the stress of the cross-linked charge transportable layer and the lowering of the surface energy and friction coefficience of the cross-linked charge transportable layer, monofunctional and bifunctional radical-polymerizable monomers and a radical-polymerizable oligomer can be also used in combination with the above-noted two monomers for producing the cross-linked charge transportable layer. Examples of these radical-polymerizable monomers and oligomers include conventional radical-polymerizable monomers and oligomers.

Examples of the monofunctional radical-polymerizable monomer include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrulate, isoamylacrylate, isobutylacrylate, methoxytriethylene glycolacrylate, phenoxytetraethyleneglycolacrylate, cetylacrylate, isostearylacrylate, stearylacrylate and stylene monomer.

Examples of the bifunctional radical-polymerizable monomers include 1,3-butane dioldiacrylate, 1,4-butanedioldiacrylate, 1,4-butane dioldimethacrylate, 1,6-hexane dioldiacrylate, 1,6-hexane dioldimethacrylate, diethyleneglycoldiacrylate, neopentylglycoldiacrylate, EO modified bisphenol A diacrylate, EO modified bisphenol F diacrylate and neopentylglycoldiacrylate.

Examples of the above-noted functional monomer include a (meth)acrylate substituted by a fluorine atom, such as octafluoropentylacrylate, 2-perfluorooctylethylacrylate, 2-perfluorooctylethylmethacrylate and 2-perfluoroisononylethylacrylate and a vinyl monomer, acrylate or methacrylate having a polysiloxane group, such as acryloylpolydimethylsiloxaneethyl, methacryloylpolydimethylsiloxaneethyl, acryloylpolydimethylsiloxanepropyl, acryloylpolydimethylsiloxanbutyl and diacryloylpolydimethylsiloxanediethyl which have 20 to 70 recurring units of a siloxane linkage described in JP-B No. 05-60503 and JP-B No. 06-45770.

Examples of the radical-polymerizable oligomer include an epoxyacrylate oligomer, an urethaneacrylate oligomer and a polyesteracrylate oligomer.

The amount of the monofunctional or bifunctional radical-polymerizable monomer or the radical-polymerizable oligomer respectively is preferably 50 parts by mass or less, more preferably 30 parts by mass or less, relative to 100 parts by mass of the mass of the trifunctional or more functional radical-polymerizable monomer.

When the amount is more than 50 parts by mass, the three-dimensional cross-linkage density of the closs-linked charge transportable layer is substantially lowered, so that the hardwearing properties of the closs-linked charge transportable layer is lowered sometimes.

The cross-linked charge transportable layer is produced by curing at least the trifunctional or more functional radical-polymerizable monomer having no charge transportable structure and the monofunctional radical-polymerizable monomer having a charge transportable structure; however, optionally for progressing effectively the curing reaction, a polymerization initiator may be incorporated in the composition of the coating liquid for producing the cross-linked charge transportable layer. Examples of the polymerization initiator include a thermal polymerization initiator and a photopolymerization initiator. These polymerization initiators may be used individually or in combination.

Examples of the polymerization initiator include a peroxide initiator, such as 2,5-dimethylhexane-2,5-dihydro peroxide, dicumyl peroxide, benzoyl peroxide, t-butylcumyl peroxide, 2,5-dimethyl-2,5-di(peroxybenzoyl)hexine-3,di-t-butyl peroxide, t-butylhydro peroxide, cumenehydro peroxide, lauloyl peroxide and 2,2-bis(4,4-di-t-butylperoxycyclohexy)propane; and an azo initiator, such as azobisisobutylonitrile, azobiscyclohexanecarbonitrile, azobisisomethylbutylate, azobisisobutylamidine hydrochloric acid salt and 4,4'-azobis-a-cyanovaleric acid.

Examples of the photopolymerization initiator include an acetophenone or ketal photopolymalization initiator, such as diethoxyacetophenone, 2,2-dimethoxy-1,2-diphenylethane 1-one, 1-hydroxy-cyclohexinyl-phenyl-ketone, 4-(2-hydroxyethoxy)phenyl-(2-hydroxy-2-propyl)ketone, 2-benzyl-2-dimethylamino 1-(4-morpholinophenyl)butanone-1,2-hydroxy-2-methyl-1-phenylpropane-1-one, 2-methyl-2-morpholino(4-methylthiophenyl)propane-1-one and 1-phenyl-1,2-propanedione-2-(o-ethoxycarbonyl)oxime; a benoine ether photopolymalization initiator, such as benzoine, benzoine methyl ether, benzoine ethyl ether, benzoine isobutyl ether and benzoine isopropyl ether; a benzophenone photopolymalization initiator, such as benzophenone, 4-hydroxybenzophenone, o-benzoilmethylbenzoate, 2-benzoilnaphthalene, 4-benzoilbiphenyl, 4-benzoil phenyl ether, acrylated benzophenone and 1,4-benzoilbenzene; a thioxantone photopolymalization initiator, such as 2-isopropylthioxantone, 2-chlorothioxantone, 2,4-dimethylthioxantone, 2,4-diethylthioxantone and 2,4-dichlorothioxantone; and other photopolymalization initiators, such as ethylanthraquinone, 2,4,6-trimethylbenzoildiphenylphosphine oxide, 2,4,6-trimethylbenzoilphenylethoxyphosphine oxide, bis(2,4,6-trimethylbenzoil)phenylphosphine oxide, bis (2,4-dimethoxybenzoil)-2,4,4-trimethylpentylphosphine oxide, methylphenylglyoxy ester, 9,10-phenanthroline, an acridine compound, a triazine compound and an imidazol compound.

Further, a compound having a photopolymerization accelerating effect can be used individually or in combination with the above-noted photopolymerization initiator. Examples of the photopolymerization accelerating effect include triethanolamine, methyldiethanolamine, 4-dimethylaminoethylbenzoate, 4-dimethylaminoisoamylbenzoate, (2-dimethylamino)ethyl benzoate and 4,4'-dimethylaminobenzophenone.

The amount of the polymerization initiator is preferably 0.5 parts by mass to 40 parts by mass, more preferably 1 part by mass to 20 parts by mass, relative to 100 parts by mass of the total amount of the compounds having a radical-polymerizability.

The coating liquid used for disposing the cross-linked charge transportable layer may optionally comprise various additives, such as a plasticizer, a leveling agent and a low molecular weight-charge transportable substance having no radical reactivity for the stress relaxing or the adhesion improving.

Examples of the plasticizer include a plasticizer used for a general resin, such as dibutylphthalate and dioctylphthalate.

The amount of the plasticizer is preferably 20% by mass or less, more preferably 10% by mass or less, based on the total mass of the solid in the coating liquid for disposing the cross-linked charge transportable layer.

Examples of the leveling agent include a silicone oil, such as a dimethyl silicone oil and a methylphenyl silicone oil and a polymer and oligomer having a perfluoroalkyl group in the side chain.

The amount of the leveling agent is preferably 3% by mass or less, based on the total mass of the solid in the coating liquid for disposing the cross-linked charge transportable layer.

The cross-linked charge transportable layer according to the present invention is produced by coating the below-noted charge transportable layer with a coating liquid comprising at least the above-noted trifunctional or more functional radical-polymerizable monomer having no charge transportable structure and monofunctional radical-polymerizable compound having a charge transportable structure; and by curing the resultant coating. When the radical-polymerizable monomer is liquid, the coating liquid can be produced by dissolving the other components into the radical-polymerizable monomer liquid; however optionally, the coating liquid is diluted by a solvent before the using of the coating liquid.

Example of the solvent for the coating liquid include an alcohol solvent, such as methanol, ethanol, propanol and butanol; a ketone solvent, such as acetone, methyl ethyl ketone, methyl isobutyl ketone and cyclohexanone; an ether solvent, such as tetrahydrofuran, dioxane and a propyl ether; a halogenated solvent, such as dichloromethane, dichloroethane, trichloroethane and chlorobenzene; an aromatic solvent, such as benzene, toluene and xylene; and a cellosolve solvent, such as a methyl cellosolve, an ethyl cellosolve and a cellosolve acetate. These solvents may be used individually or in combination.

The degree of the dilution by the solvent varies depending on the solubility of the composition of the layer, the coating method and the objective thickness of the layer, and is random. The coating can be performed by a dip coating, a spray coating, a beads coating or a ring coating.

Accroding to the present invention, after the coating using the above-noted coating liquid for disposing the cross-linked charge transportable layer, the resultant coating is cured by applying an external energy to the coating, so that the cross-linked charge transportable layer is disposed. Examples of the external energy include a heat, a light and a radioactive ray. Examples of the method for applying the thermal energy include the heating from the surface of the coating or from the side of the support using a gas, such as air and nitrogen; a vapour; various heating media; an infrared ray and an electromagnetic wave.

The heating temperature is preferably 100° C. to 170° C. When the heating temperature is less than 100° C., the reaction rate of the curing is low and the curing reaction cannot be completed sometimes. On the other hand, when the heating temperature is more than 170° C., the curing reaction progresses ununiformly, so that in the closs-linked charge transportable layer, a large strain and a lot of unreacted residual groups and reaction-stopped terminals are caused sometimes. For the uniform progress of the curing reaction, it is effective that after the heating of the coating at a relative low temperature below 100° C., the heating temperature is elevated to 100° C., so that the curing reaction is completed.

Examples of the source of the light energy include an UV irradiating light source, such as a high-pressure mercury vapor lamp and metal halide lamp having an emission wavelength in the ultraviolet region; and also a light source for a visible light of which wavelength corresponds to a light absorption wavelength of the radical-polymerizable compound or photopolymerization initiator. When the amount of an irradiated light is preferably 50 mW/cm$^2$ to 1,000 mW/cm$^2$. When the amount is less than 50 mW/cm$^2$, the curing reaction takes much time sometimes. On the other hand, when the amount is more than 1,000 mW/cm$^2$, either the progression of the curing reaction becomes ununiform, so that in the surface of the closs-linked charge transportable layer, a localized wrinkle and a lot of unreacted residual groups and reaction-stopped terminals are caused sometimes; or due to a rapid cross-linking reaction, the internal stress of the closs-linked charge transportable layer becomes large, so that the cracking or film-peeling is caused.

Examples of the radioactive ray include an electron beam.

Among these energies, from the viewpoint of the easiness for controlling the reaction rate and the simplicity of the apparatus by which the energy is applied, the heat and light are usuful.

The closs-linked charge transportable layer has a thickness of preferably 1 μm to 10 μm, more preferably 2 μm to 8 μm.

When the thickness is more than 10 μm, the cracking or film-peeling is easily caused sometimes. The radical-polymerization is easily subjected to the inhibition by oxygen in such a manner that in the surface of the closs-linked charge transportable layer contacted with the atmosphere, due to the adverse effect of the radical trap by oxygen, the cross-linking reaction does not progress or progresses ununiformly. The adverse effect of the radical trap becomes remarkable, when the above-noted thickness is 1 μm or less, so that in the closs-linked charge transportable layer having a thickness of 1 μm or less, the lowering of the hardwearing properties and ununiform wear are easily caused and during the disposing of the closs-linked charge transportable layer by the coating, a component of the charge transportable layer disposed under the closs-linked charge transportable layer invades into the closs-linked charge transportable layer. When the coating thickness of the closs-linked charge transportable layer is small, the invading component is spread through the whole closs-linked charge transportable layer, so that the curing reaction is inhibited and the cross-linkage density is lowered.

For these reasons, when the closs-linked charge transportable layer according to the present invention has a thickness of 1 μm or more, the closs-linked charge transportable layer has advantageous hardwearing properties and advantageous scratch resistance; however, when during the repeated using of the photoconductive body, a portion which is peeled until the charge transportable layer disposed under the closs-linked charge transportable layer is locally caused, the wear of the portion is increased, so that due to the fluctuation of the electrification properties and sensitivity of the sensitize body, a density irregularity of the middle-tone image is easily caused. Therefore, for a longer life and high image quality of the photoconductive body, it is preferred that the closs-linked charge transportable layer has a thickness of 2 μm or more.

Further, as an unexpected effect, it was found that when the closs-linked charge transportable layer having a thickness of 1 μm to 8 μm is disposed, in the durability test with respect to the long-termed image forming, particularly in the durability test in a high temperature-high humidity atmosphere, a pinhole is hardly caused in the surface of the photoconductive body. The cause and mechanism of the above-noted effect are not yet clearified; however, it is considered that the effect is related to such an advantage that the closs-linked charge transportable layer has high strength, proper flexibility and a proper thickness. With respect to a conventional photoconductive body, it is assumed that the pinhole caused in the photoconductive body during the image forming is related to a scratch in micron-size caused in the surface of the photoconductive body by fine particles of silica and the like which are incorporated in the toner composition, the temperature and the humidity. The surface layer which is only hard is advantageous in that the peeling is not caused in such a surface layer; however, on the other hand, it is considered that when a scratch is caused in such a surface layer, the scratch grows and in the long-termed durability test, the pinhole is easily caused.

The above-noted coating liquid for disposing the cross-linked charge transportable layer may comprise besides the trifunctional or more functional radical-polymerizable compound having no charge transportable structure and the monofunctional radical-polymerizable compound having a charge transportable structure, as other components, an additive, such as a binder resin having no radical-polymerizable functional group, an anti-oxidant and a plasticizer.

When the coating liquid for disposing the cross-linked charge transportable layer comprises a large amount of the above-noted additives, in the cross-linked charge transportable layer, the cross-linkage density is lowered and a phase separartion between the cured form generated by the cross-linking reaction and the above-noted additive is caused, so that the cross-linked charge transportable layer becomes soluble in an organic solvent. More specifically, it is important that the amount of the additive is suppressed to 20% by mass or less, based on the mass of the solid in the coating liquid. So as not to lessen the cross-linkage density, it is desired that also the amount of the above-noted mono- or bi-functional radical-polymerizable monomer, reactive oligomer and reactive polymer respectively is suppressed to 20% by mass or less, based on the mass of the above-noted trifunctional radical-polymerizable monomer. Further, when the coating liquid for disposing the cross-linked charge transportable layer comprises a large amount of a bi- or more functional radical-polymerizable compound having a charge transportable structure, a bulky structure is fixed in the cross-linkage structure through plural bondings, so that the strain is easily caused in the cross-linked charge transportable layer and the cross-linked charge transportable layer is easily produced as an integrated body of fine cured forms and thus becomes sometimes soluble in an organic solvent. It varies depending on the compound structure that the amount of the bi- or more functional radical-polymerizable compound having a charge transportable structure is preferably 10% by mass or less, based on the mass of the monofunctional radical-polymerizable compound having a charge transportable structure. Further, in the layer composition in which the charge generating layer, the charge transportable layer and the cross-linked charge transportable layer are disposed in this order, it is preferred for obtaining high hardwearing properties and high scratch resistance that the cross-linked charge transportable layer which is the most outer surface layer is insoluble in an organic solvent.

In the embodiment of the present invention, for rendering the cross-linked charge transportable layer insoluble in an organic solvent, it is important to control (i) the composition and formulation of the cross-linked charge transportable layer, (ii) the diluting solvent and solid content of the coating liquid for disposing the cross-linked charge transportable layer, (iii) the selection of the coating method for disposing the cross-linked charge transportable layer, (iv) the curing condition for producing the cross-linked charge transportable layer and (v) rendering the charge transportable layer disposed under the cross-linked charge transportable layer slight-soluble; however, rendering the cross-linked charge transportable layer insoluble in an organic solvent is not always obtained by only one factor among the above-noted factors.

When as the solvent for diluting the coating liquid for disposing the cross-linked charge transportable layer, a solvent having a low evaporating rate is used, a residual solvent interferes the curing reaction sometimes and the invading amount of a component of the under layer is increased sometimes, so that the curing reaction becomes ununiform or the curing density is lowered. Accordingly, the cross-linked charge transportable layer becomes easily soluble in an organic solvent. More specifically, tetrahydrofuran, a solvent mixture of tetrahydrofuran and methanol, ethyl acetate, methyl ethyl ketone and ethyl cellosolve are useful; however, the selecting of the diluting solvent is performed in combination with the selecting of the coating method for disposing the cross-linked charge transportable layer. Further, when the solid content in the coating liquid for disposing the cross-linked charge transportable layer is too low, the cross-linked charge transportable layer becomes easily soluble in an organic solvent. On the contrary, the upper limit of the solid content is limited by a limitation for the coating thickness or the viscosity of the coating liquid. More specifically, the solid content is desirably 10% by mass to 50% by mass, based on the mass of the coating liquid for disposing the cross-linked charge transportable layer.

As the coating method for disposing the cross-linked charge transportable layer, preferred is a method in which a solvent content of the coating liquid is low and a contacting time of the composition for the cross-linked charge transportable layer with the solvent is short and more specifically, a spray coating and a ring coating in which the amount of the coating liquid is suppressed are most preferred. For suppressing the invading amount of a component of the under layer, it is effective that the charge transportable layer is disposed using a charge transportable polymer and an intermediate layer which is insoluble in the solvent of the coating liquid for disposing the cross-linked charge transportable layer is disposed.

When as a curing condition of the cross-linked charge transportable layer, the heating energy or the light irradiating energy is low, the curing reation is not completed, so that the solubility of the cross-linked charge transportable layer in an organic solvent is elevated. On the contrary, the curing reaction is performed using an extremely high energy, the curing reaction becomes ununiform, so that the number of an uncross-linked portion or a portion where the radical reaction is stopped is increased and the cross-linked charge transportable layer becomes easily an integrated body of fine cured forms. Accordingly, the cross-linked charge transportable layer becomes soluble in an organic solvent sometimes.

For rendering the cross-linked charge transportable layer insoluble in an organic solvent, the thermal curing is preferably performed at 100° C. to 170° C. for 10 minutes to 3 hours and the curing by the UV light irradiating is preferably performed under the condition where the amount of the irradiated light is 50 mW/cm$^2$ to 1,000 mW/cm$^2$, the curing time is 5 seconds to 5 minutes and desirably the temperature elevation during the curing is suppressed to 50° C. or less for suppressing an ununiform curing reaction.

Preferred examples of the method for rendering the cross-linked charge transportable layer insoluble in an organic solvent include a method in which the coating liquid for disposing the cross-linked charge transportable layer comprises an acrylate monomer having three acryloyloxy groups and a triarylamine compound having one acryloyloxy group, wherein the amount ratio of these two types of acrylate compound (an acrylate monomer: a triarylamine compound) is 7:3 to 3:7; a method in which the coating liquid for disposing the cross-linked charge transportable layer comprises besides the above-noted two types of acrylate compound, further a polymerization initiator in an amount of 3% by mass to 20% by mass, based on the total mass of the two types of acrylate compound, and a solvent; a method in which the charge transportable layer which is the under layer of the cross-linked charge transportable layer is produced using a triarylamine doner as a charge transportable substance and a polycarbonate resin as a binder resin, and the cross-linked charge transportable layer is disposed on the charge transportable layer by a spray coating using a coating liquid comprising a solvent, such as tetrahydrofuran, 2-butanone or ethyl acetate, wherein the amount of the solvent is tree times to ten times the total amount of the two types of acrylate compound in the coating liquid; and a method in which on the photoconductive body produced by disposing the undercoating layer, the charge generating layer and the above-noted charge transportable layer in this order on the support, such as an aluminum cylinder, the cross-linked charge transportable layer is disposed by a spray coating using the above-prepared coating liquid, followed by drying the resultant coating naturally or at a relative low temperature for a short period (i.e., at 25° C. to 80° C. for 1 minute to 10 minutes) and by curing the dried coating by the UV irradiating or the heating.

In the last method, the UV irradiating is performed using a metal halide lamp under the condition where the irradiating amount of the UV light is preferably 50 mW/cm$^2$ to 1,000 mW/cm$^2$. When the UV irradiating is performed in the irradiating amount of the UV light of 200 mW/cm$^2$, the UV light may be irradiated from plural lamps uniformly in the drum-circle direction of the photoconductive body for around 30 seconds. At this time, the temperature of the drum of the photoconductive body should be suppressed to 50° C. or less.

When the curing is performed by the heating, the heating temperature is preferably 100° C. to 170° C. and when the heating is performed using an oven equipped with a blower and the heating temperature is 150° C., the heating time is 20 minutes to three hours.

After the completion of the curing reaction, for lowering the amount of the residual solvent, the above-produced photoconductive body is subjected to a further heating at 100° C. to 150° C. for 10 minutes to 30 minutes, thereby obtaining the photoconductive body for the electrophotography according to the present invention.

With respect to the photoconductive body according to the present invention, between the charge transportable layer and the cross-linked charge transportable layer, for suppressing the invading of the component of the charge transportable layer into the cross-linked charge transportable layer or improving the adhesion properties between the two layers, an intermediate layer may be disposed. Therefore, as the intermediate layer, an intermediate layer which is insoluble or slight-soluble in the coating liquid for disposing the cross-linked charge transportable layer is suitable and generally comprises mainly a binder resin. Examples of the binder resin include a polyamide resin, a nylon resin which is soluble in an alcohl, a polyvinylbutylal resin which is soluble in water, a polyvinylbutylal resin and a polyvinyl alcohol resin. As the disposing method of the intermediate layer, the above-noted coating method is used.

The thickness of the intermediate layer is not restricted and may be properly selected depending on the application. The thickness is preferably 0.05 μm to 2 μm.

With respect to the photoconductive body according to the present invention, between the conductive support and the photoconductive layer, an under coating layer may be disposed. Generally, the under coating layer comprises maily a resin; however, taking-into consideration disposing the photoconductive layer on the under coating layer by the coating using a coating liquid containing a solvent, it is desirable that the above-noted resin has high solvent resistance agaist a general organic solvent. Examples of the above-noted resin include a water-soluble resin, such as a polyvinyl alcohol resin, a casein resin and a polyacrylic sodium resin; an alcohol-soluble resin, such as a copolymerized nylon resin and a methoxymethylated nylon; and a curable resin which will form a three-dimensional net work, such as a polyurethane resin, a melamine resin, a phenol resin, an alkyd-melamine resin and an epoxy resin. Further, for preventing the moiré and lowering the residual potential, the under coating layer may comprise fine particles pigment of a metal oxide, such as titanium oxide, silica, alumina, zirconium oxide, tin oxide and indium oxide.

The under coating layer can be preferably disposed by anodizing $Al_2O_3$ or by shaping to thin film under vacuum an organic compound, such as a poly-para-xylene resin; or an inorganic compound, such as $SiO_2$, $SnO_2$, $TiO_2$, ITO and $CeO_2$. By another conventional method, the under coating layer can be disposed.

The under coating layer can be disposed, like the above-noted photoconductive layer, according to a proper coating method using a proper solvent. Further, the under coating layer according to the present invention may comprise a silane coupling agent, a titanium coupling agent and a chromium coupling agent.

The thickness of the under coating layer is not restricted and may be properly selected depending on the application. The thickness is preferably 0 μm to 5 μm.

With respect to the photoconductive body according to the present invention, for improving environmental resistance, particularly for preventing the lowing of the sensitivity or the elevation of the residual potential, each of the cross-linked charge transportable layer, the charge transportable layer, the charge generating layer, the under coating layer and the intermediate layer may comprise an anti-oxidant.

Examples of the anti-oxidant include a phenolic compound, a p-phenylenediamine compound, a hydroquinone compound, an organic sulfur compound and an organic phosphorus compound. These anti-oxidants may be used individually or in combination.

Examples of the phenolic compound include 2,6-di-t-butyl-p-cresol, butylated hydroxyanisole, 2,6-di-t-butyl-4-ethylpenol, stearyl-β-(3,5-di-t-butyl-4-hydroxyphenyl) propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 1,1,3-tris-(2-methyl-4-hydroxy-5-t-butylphneyl)butane, 1,3,5-trimethyl-2,4,6-tris)3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester and a tocopherol.

Examples of the p-phenylenediamine compound include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine and N,N'-dimethyl-N,N'-di-t-butyl-p-phenylenediamine.

Examples of the hydroquinone compound include 2,5-di-t-octylhydoquinone, 2,6-didodecylhydroquinone, 2-dodecyl hydroquinone, 2-dodecyl-5-chlorohydroquinone, 2-t-octyl-5-methylhydroquinone and 2-(2-octadecenyl)-5-methylhydroquinone.

Examples of the organic sulfur compound include dilauryl-3,3'-thiodipropionate, distearyl-3,3'-thiodipropionate and ditetradecyl-3,3'-thiodipropionate.

Examples of the organic phosphorus compound include triphenylphosphine, tri(nonylphenyl)phosphine, tri(di-nonylphenyl) phosphine, tricresylphosphine and tri(2,4-dibutylphenoxy)phosphine.

These compounds are conventional as an anti-oxidant for a rubber, a plastic or the oils and fats and are easily commercially available.

The amount of the anti-oxidant is preferably 0.01% by mass to 10% by mass, based on the total mass of the layer which comprises the anti-oxidant.

<Examples of Synthesizing Method of Monofunctional Compound having Charge Transportable Structure>

Examples of the synthesizing method of a monofunctional compound having a charge transportable structure include a method disclosed in JP-B No. 3164426. An example thereof is shown as follows. The method of the example comprises the following two steps (1) and (2).

(1) Synthesizing of Hydroxy Group-Substituted Triarylamine Compound (Represented by Following Formula (9))

113.85 g of a methoxy group-substituted triarylamine (represented by the following formula (8)) were mixed with 138 g (0.92 mole) of sodium iodide and 240 ml of sulfolane and the resultant mixture was heated at 60° C. in a nitrogen gas stream. To the mixture, 99 g (0.91 mol) of trimethylchlorosilane was dropped for one hour and the mixture was stirred at about 60° C. for four hours and a half, thereby completing the reaction. The reaction product liquid was mixed with about 1.5 L of toluene and the resultant solution was cooled to room temperature, followed by washing the solution repeatedly with water and an aqueous solution of sodium carbonate. Thereafter, from the toluene solution, the solvent was distilled off and the resultant residue was purified by a column chromatography (adsorption medium: silica gel, developing solvent: mixture of toluene and ethyl acetate in a mixing ratio (toluene: ethyl acetate) of 20:1), thereby obtaining an oily substance. The obtained light-yellow oily substance was mixed with cyclohexane and a crystal was separated out, thereby obtaining 88.1 g (yield=80.4%) of a white crystal of a compound represented by the following formula (9). The compound has a melting point of 64.0° C. to 66.0° C.

TABLE 1

| | C | H | N |
|---|---|---|---|
| Measured Value | 85.06% | 6.41% | 3.73% |
| Calculated Value | 85.44% | 6.34% | 3.83% |

Formula (8)

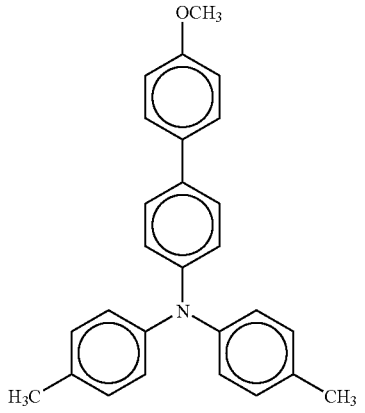

-continued

Formula (9)

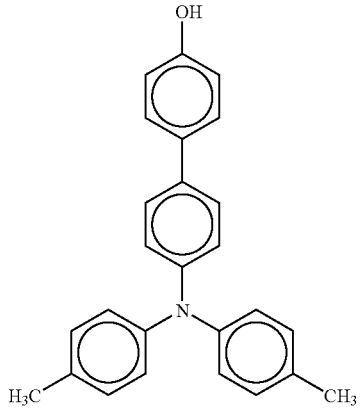

(2) Triarylamino Group-Substituted Acrylate Compound (Compound No. 54 Among 160 Above-Exemplified Radical Polymerizable Compounds)

82.9 g (0.227 mol) of a hydroxyl group-substituted triarylamine compound (represented by the formula (9)) obtained in the above section (1) was dissolved in 400 ml of tetrahydrofuran and to the resultant solution, an aqueous solution of sodium hydroxide (prepared by dissolving 12.4 g of sodium hydroxide in 100 ml of water) was dropped in a nitrogen gas stream. The resultant solution was cooled at 5° C. and to the solution, 25.2 g (0.272 mol) of acrylic acid chloride was dropped for 40 minutes, followed by stirring the solution at 5° C. for three hours, thereby completing the reaction. The reaction product solution was mixed with water and the resultant mixture was extracted with toluene. The extract was washed repeatedly with an aqueous solution of sodium bicarbonate and water. Thereafter, from the toluene solution, the solvent was distilled off and the resultant residue was purified by a column chromatography (adsorption medium: silica gel, developing solvent: toluene), thereby obtaining an oily substance. The obtained colorless oily substance was mixed with n-hexane and a crystal was separated out, thereby obtaining 80.73 g (yield=84.8%) of a white crystal of the compound No. 54. The compound has a melting point of 117.5° C. to 119.0° C.

TABLE 2

| | C | H | N |
|---|---|---|---|
| Measured Value | 83.13% | 6.01% | 3.16% |
| Calculated Value | 83.02% | 6.00% | 3.33% |

<Examples of Synthesizing Method of Bifunctional Compound Having Charge Transportable Structure>

Dihydroxymethyltriphenylamine which is a bifunctional compound having a charge transportable structure according to the present invention can be produced according to the following method.

First, into a flask equipped with a thermometer, a cooling coil, a stirring apparatus and a dropping funnel, 49 g of the compound (1) represented by the formula (1) in the following reaction formula and 184 g of phosphorus oxy chloride were charged and the content of the flask was heated and dissolved. To the resultant solution, 117 g of dimethylformamide was gradually dropped through a dropping funnel and the reaction mixture was stirred for about 15 hours maintaining the temperature of the reaction mixture at 85° C. to 90° C. Next, the reaction mixture was gradually poured into a superexcessive amount of warm water and the resultant mixture was stirred and cooled slowly, thereby separating a crystal out. The separated crystal was filtered, dried and purified by subjecting the crystal to the adsorption of impurities using a silica gel or the like and the recrystallization using acetonitrile, thereby obtaining the compound (2) represented by the formula (2) in the following reaction formula. The yield was 30 g.

30 g of the obtained compound (2) and 100 ml of ethanol were charged into a flask and the resultant mixture was stirred. 1.9 g of boron sodium hydride was charged into the mixture and the temperature of the mixture was maintained at 40° C. to 60° C., followed by stirring the mixture for about two hours, thereby obtaining a reaction mixture. Next, the obtained reaction mixture was gradually poured into about 300 ml of water and the resultant mixture was stirred, thereby separating a crystal out. The separated crystal was filtered and the filtered crystal was washed satisfactorily with water and dried, thereby obtaining the compound (3) represented by the formula (3) in the following reaction formula. The yield was 30 g.

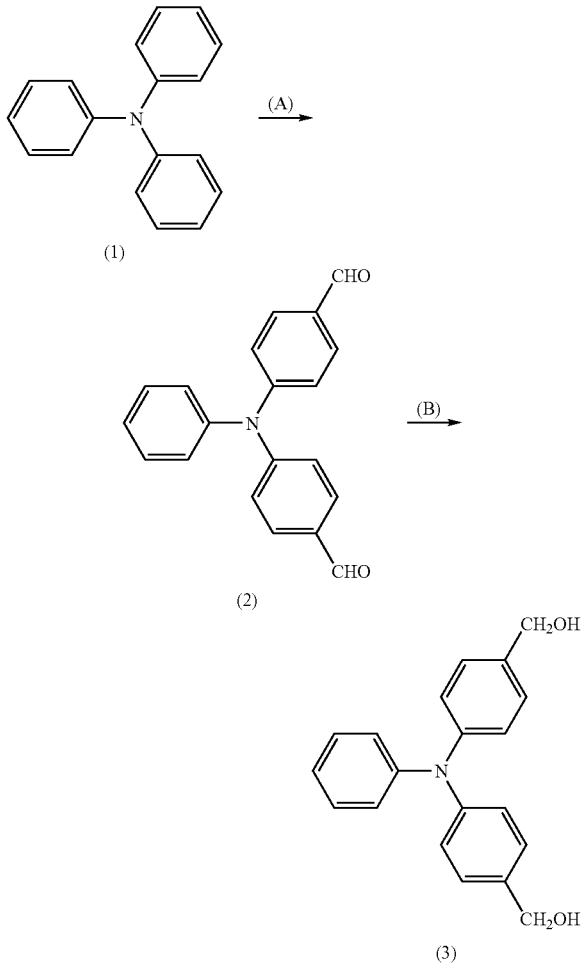

The electrostatic latent image carrier (photoconductive body for the electrophotography) according to the present invention can be applied not only to a general apparatus for the electrophotography, such as a copier, a laser printer, a LED printer and a printer equipped with a liquid crystal shutter, but also widely to an apparatus to which the electrophotography technique is applied, such as a display apparatus, a recording apparatus, a light printing apparatus, a plate-making apparatus and a facsimile apparatus.

The forming of the electrostatic latent image can be performed, for example according to a method (using the above-noted electrostatic latent image forming unit) comprising electrifying uniformly the surface of the electrostatic latent image carrier and exposing the surface of the photoconductive body according to the form of the image.

The above-noted electrostatic latent image forming unit comprises an electrifying unit for electrifying uniformly the surface of the electrostatic latent image carrier and a exposing unit configured to expose the surface of the photoconductive body according to the form of the image.

The above-noted electrifying can be performed, for example by applying the voltage to the surface of the electrostatic latent image carrier using the above-noted electrifying unit.

The electrifying unit is not restricted and may be selected depending on the application. Examples of the electrifying unit include a conventional contacting electrifying unit equipped with a conductive or semiconductive roll, brush, film or rubber blade and a non-contacting electrifying unit utilizing a corona discharge, such as a corotron and a scorotron.

The above-noted exposing can be performed, for example by exposing the surface of the photoconductive body according to the form of the image using the exposing unit.

The exposing unit is not restricted so long as the exposing unit can expose the surface of the photoconductive body which is electrified by the electrifying unit, according to the form of the image which is to be formed, and may be selected depending on the application. Examples of the exposing unit include various exposing unit, such as a copy optical exposing unit, a rod lens array exposing unit, a laser optical exposing unit and a liquid crystal shutter exposing unit.

As the exposing unit according to the present invention, also an exposing unit which exposes the surface of the electrostatic latent image carrier according to the form of the image from the reverse surface of the electrostatic latent image carrier, can be used.

Further, when the image forming apparatus is used also as a copier or a printer, the exposing according to the form of the image can be performed by irradiating a reflected light or a transmitted light from the original text or by a method comprising reading the original text using a sensor, signalizing the read original text and irradiating the light to the photoconductive body by scanning the laser beam, driving the LED array or driving the liquid crystal shutter array according to the above-obtained signal.

—Developing and Developing Unit—

The developing is forming a visible image by developing the electrostatic latent image using the toner or the above-noted developing agent.

The tonner is produced in the form of particles by producing an adhesive base material according to the reaction of a compound containing an active hydrogen group with a polymer which is reactive with the compound containing an active hydrogen group. The detail with respect to the toner is described below.

The forming of the visible image can be performed by developing the electrostatic latent image using the toner or the developing agent, and the above-noted developing unit.

The developing unit is not restricted so long as the developing unit can develop using the toner or the developing agent, and may be properly selected from conventional developing units depending on the application. Preferred examples of the developing unit include a developing unit which holds the toner or the developing agent and can attach the toner or the developing agent to the electrostatic latent image through contacting or without contacting.

The developing unit utilizes usually a dry developing method and may be a developing unit for a single color or a developing unit for a multicolor. Preferred examples of the developing unit include a developing unit comprising a stirrer for electrifying the toner or the developing agent by friction-stirring and a rotatable magnetic roller.

In the developing unit, for example the toner and the carrier are mixed and stirred, thereby generating a friction and electrifying the toner by the generated friction, and the electrified toner particles are retained on the surface of the rotating magnetic roller in the form of a row of standing ears of the rice plant, thereby forming a magnetic brush.

Since the magnetic roller is arranged in the near of the electrostatic latent image carrier, a portion of the toner particles constituting the above-noted magnetic brush formed on the surface of the magnetic roller is transferred onto the surface of the electrostatic latent image carrier by the electrical attracting force. Accordingly, the electrostatic latent image is developed by the toner, so that the visible image of the toner particles is formed on the surface of the electrostatic latent image carrier.

The developing agent held in the developing unit is a developing agent containing the toner; however the developing agent may be a developing agent containing one component or a developing agent containing two components.

—Transferring and Transferring Unit—

The transferring is transferring the visible image to a recording medium. In a preferred aspect of the transferring, the visible image is transferred to the intermediate transferring body as the primary transferring and the visible image in the intermediate transferring body is transferred to the recording medium as the secondary transfering. In a more preferred aspect of the transferring, the transferring using a toner of two or more colors, preferably using a full color toner comprises the primary transferring for forming a complex transferred image by transferring the visible image to the intermediate transferring body and the secondary transferring for transferring the complex transferred image to the recording medium.

The transferring can be performed, for example using the above-noted tranferring unit by electrifying the electrostatic latent image carrier using a electrifying unit for the tranferring. In a preferred aspect, the transferring unit comprises a primary transferring unit configured to form a complex transferred image by transferring the visible image to the intermediate transferring body and a secondary transferring unit configured to transfer the complex transferred image to the recording medium.

The intermediate transferring body is not restricted and may be properly selected from conventional transferring bodies depending on the application. Preferred examples of the intermediate transferring body include a transferring belt.

The transferring unit (the primary transferring unit and the secondary transferring unit) comprises preferably a transferring unit configured to peel the visible image formed on the electrostatic latent image carrier to the recording medium and electrifying the visible image. The image forming apparatus may comprise one or more transferring unit(s).

Examples of the transferring unit include a corona transferring unit utilizing the corona discharge, a transfer belt, a transfer roller, a pressing transfer roller and an adhesing transferring unit.

A representative recording medium is a plain paper; however the recording medium is not restricted so long as an unfixed image can be transferred to the recording medium and may be selected depending on the application. Examples of the recording medium include a PET base for OHP.

—Fixing and Fixing Unit—

The fixing is fixing the visible image transferred to the recording medium using a fixing unit. The fixing may be performed after each transferring of a toner in each color to the recording medium or at once after transferring of the laminated toner of colors.

The fixing unit is not restricted and may be properly selected depending on the application. Preferred examples of the fixing unit include a conventional heating and pressurizing unit. Examples of the heating and pressurizing unit include a combination of a heating roller and a pressuring roller, and a combination of a heating roller, a pressuring roller and an endless belt.

Usually, the heating using the heating and pressurizing unit is performed preferably at 80° C. to 200° C.

According to the present invention, depending on the application, the fixing may be performed, for example using a conventional light fixing unit, together with the above-noted fixing and fixing unit, or instead of the above-noted fixing and fixing unit.

—Cleaning and Cleaning Unit—

The cleaning is cleaning the surface of the electrostatic latent image carrier using a cleaning unit.

Examples of the cleaning unit include a cleaning blade, a magnetic blush cleaner, an electrostatic brush cleaner, a magnetic roller cleaner, a blade cleaner, a brush cleaner and a web cleaner.

Figure 2:
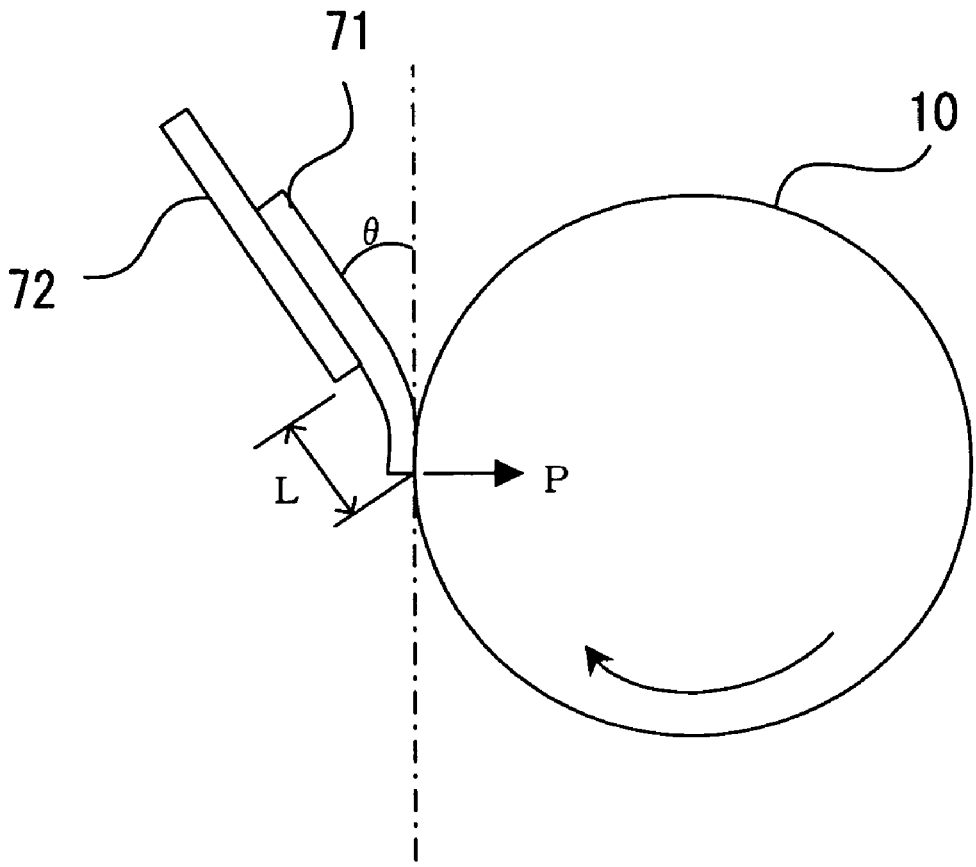
FIG. 2 is an explanatory view schematically showing an example of the cleaning unit used in the present invention.

Here, with respect to the cleaning unit, explanations are given. FIG. 2 is a sectional view schematically showing the cleaning system according to the present invention. In the present invention, a conventional cleaning condition and blade material can be used and the cleaning is preferably performed by pressing-contacting the cleaning unit with the photoconductive body against the rotation direction of the photoconductive body.

In FIG. 2, the pressing-contacting load P means a value of the direction vector in the normal to the pressing-contacting force at the time when the cleaning blade 71 is pressing-contacted with the photoconductive body 10. The pressing-contacting angle θ is an angle formed by the tangent line at the pressing-contacting point on the photoconductive body and the cleaning blade 71 which is not yet deformed by the contacting. The free length L of the cleaning blade 71 is the distance between the top point of the supporting member 72 and the top point of the cleaning blade 71 which is not yet deformed by the contacting.

The pressing-contacting load P is preferably 5 g/cm to 50 g/cm and the pressing-contacting angle θ is preferably 5° to 350. The free length L of the cleaning blade 71 is preferably 3 mm to 15 mm and the thickness of the cleaning blade 71 is preferably 0.5 mm to 10 mm.

Examples of the material for the rubber blade used in the above-noted blade cleaning include an urethane rubber, a silicone rubber, a fluorine rubber, a chloroprene rubber and a butadiene rubber. Among them, the urethane rubber is most preferred.

In the present invention, by controlling simultaneously both the hardness and impact resilience of the rubber blade, the contrarotation of the blade can be effectively suppressed. The JISA hardness of the rubber blade at 25±5° C. is preferably 65° to 80°. When the JISA hardness is less than 65°, the contrarotation of the blade is easily caused sometimes. On the other hand, when the JISA hardness is more than 80°, the cleaning performance of the blade is lowered sometimes. The impact resilience of the rubber blade is preferably 20% to 75%. When the impact resilience is more than 75%, the contrarotation of the blade is easily caused sometimes. On the other hand, when the impact resilience is less than 20%, the cleaning performance of the blade is lowered sometimes.

Here, the JISA hardness and the impact resilience can be measured according to the physical examination method for the vulcanized rubber of JIS K6301.

The destaticizing is destaticizing by applying a destaticizing-bias to the electrostatic latent image carrier and may be perferably performed using a destaticizing unit.

The destaticizing unit is not restricted so long as the destaticizing unit can apply a destaticizing bias to the electrostatic latent image carrier and may be properly selected from conventional destaticizing units. Preferred examples of the destaticizing unit include a destaticizing lamp.

The recycling is recycling the color toner for the electrophotography removed in the above-noted cleaning to the developing unit, and may be preferably performed using a recycling unit.

The recycling unit is not restricted and may be properly selected from conventional conveying units.

The controlling is controlling each of the above-noted steps and can be properly performed by a controlling unit.

The controlling unit is not restricted so long as the controlling unit can control the action of each of the above-noted units and may be properly selected depending on the application. Examples of the controlling unit include a device such as a sequencer and a computer.

Figure 3:
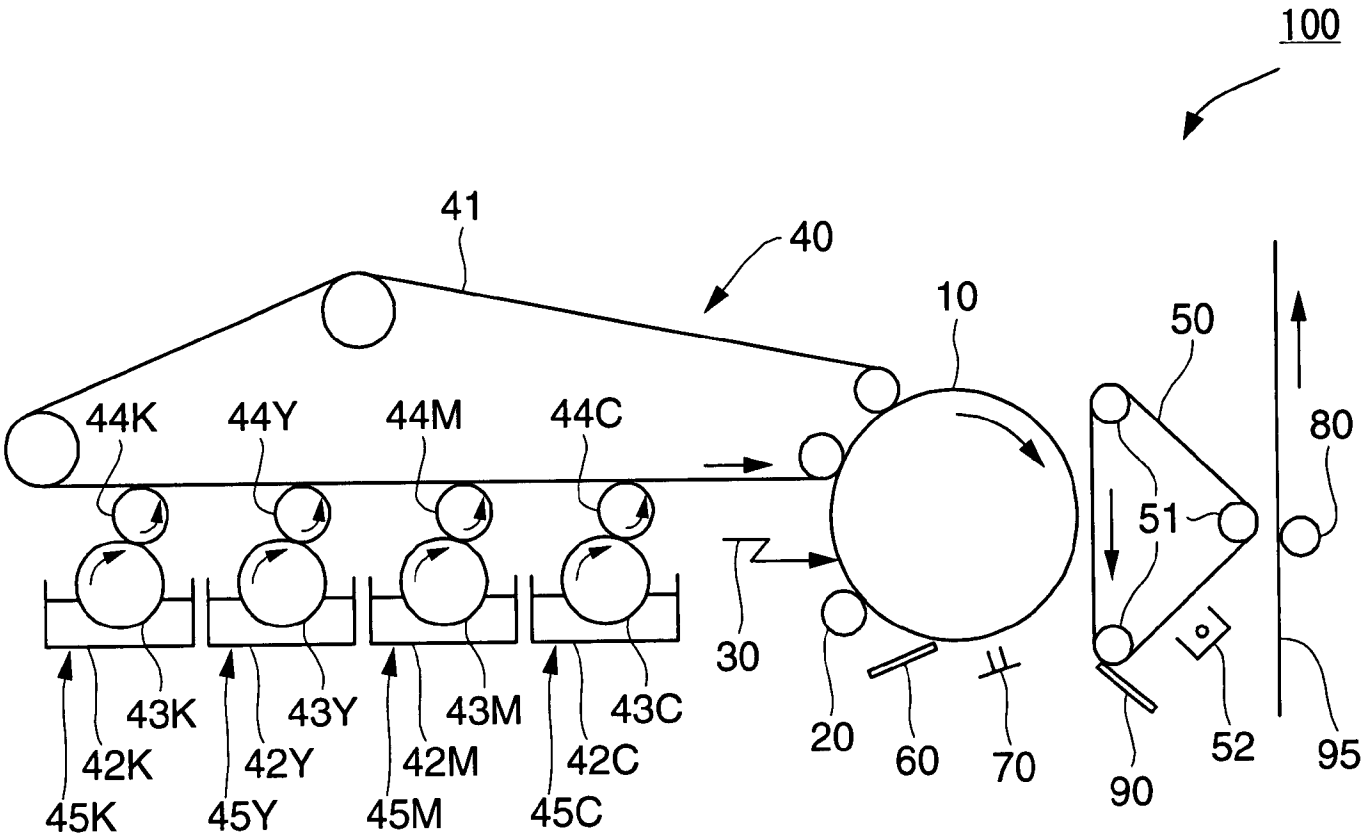
FIG. 3 is an explanatory view schematically showing an example of the performing of the image forming process according to the present invention using the image forming apparatus according to the present invention.

With respect to an embodiment for performing the imge forming method according to the present invention using the imge forming apparatus according to the present invention, referring to FIG. 3, explanations are given. The image forming apparatus 100 shown in FIG. 3 comprises the photoconductive drum 10 (hereinbelow referred to as "photoconductive body 10"), the electrifying roller 20 as the electrifying unit, the exposing apparatus 30 as the exposing unit, the developing apparatus 40 as the developing unit, the intermediate tranfering body 50, the cleaning apparatus 60 as the cleaning unit and the destaticizing lamp 70 as the destaticizing unit.

The intermediate tranfering body 50 is an endless belt and is designed to be movable in the direction shown by the arrow, by three rollers 51 which are arranged in the inside of the belt and stretch the belt. A part of the three rollers 51 has the function as a bias roller by which a part of the three rollers 51 can apply a specified transferring bias (primary transferring bias) to the intermediate transferring body 50. In the near of the intermediate transferring body 50, the cleaning apparatus 90 equipped with a cleaning blade is arranged and the transferring roller 80 as the transferring unit which can apply the transferring bias for transferring (secondary-transferring) a developed image (toner image) to the paper 95 for transferring as an end transferred medium, is arranged in such a manner that the intermediate transferring body 50 and the transferring roller 80 stand opposite to each other. Around the intermediate transferring body 50, the corona electrifying unit 52 configured to apply a charge to the toner image on the intermediate transferring body 50 is arranged between the contacting point of the photoconductive body 10 and the intermediate tranfering body 50 and the contacting point of the intermediate tranfering body 50 and the paper 50 for transferring in the rotating direction of the intermediate transferring body 50.

The developing apparatus 40 comprises the developing belt 41 as the developing agent carrier; and the black-developing unit 45 K, the yellow-developing unit 45 Y, magenta-developing unit 45 M and cyan-developing unit 45 C which are annexed together with the developing belt 41 around the developing belt 41. The black-developing unit 45 K is equipped with the developing agent holder 42 K, the developing agent feeding roller 43 K and the developing roller 44 K. The yellow-developing unit 45 Y is equipped with the developing agent holder 42 Y, the developing agent feeding roller 43 Y and the developing roller 44 Y. The magenta-developing unit 45 M is equipped with the developing agent holder 42 M, the developing agent feeding roller 43 M and the developing roller 44 M. The cyan-developing unit 45 C is equipped with the developing agent holder 42 C, the developing agent feeding roller 43 C and the developing roller 44 C. The developing belt 41 is an endless belt which is stretched among plural belt rollers and a portion thereof is contacted with the photoconductive body 10.

In the image forming apparatus 100 shown in FIG. 3, for example the electrifying roller 20 electrifies the photoconductive body 10 uniformly. The exposing apparatus 30 performs the exposing on the photoconductive body 10 according to the form of the image, thereby forming the electrostatic latent image. The electrostatic latent image formed on the photoconductive body 10 is developed by feeding the toner from the developing apparatus 40, thereby forming the visible image (toner image). The visible image is transferred (primary-tranferring) to the surface of the intermediate transferring body 50 by a voltage applied by the roller 51 and is further transferred (secondary-tranferring) to the surface of the paper 95 for transferring. Accordingly, on the paper 95 for transferring, the transferred image is formed. The residual toner on the photoconductive body 10 is removed by the cleaning apparatus 60 and the charge on the photoconductive body 10 is temporally removed by the destaticizing lamp 70.

Figure 4:
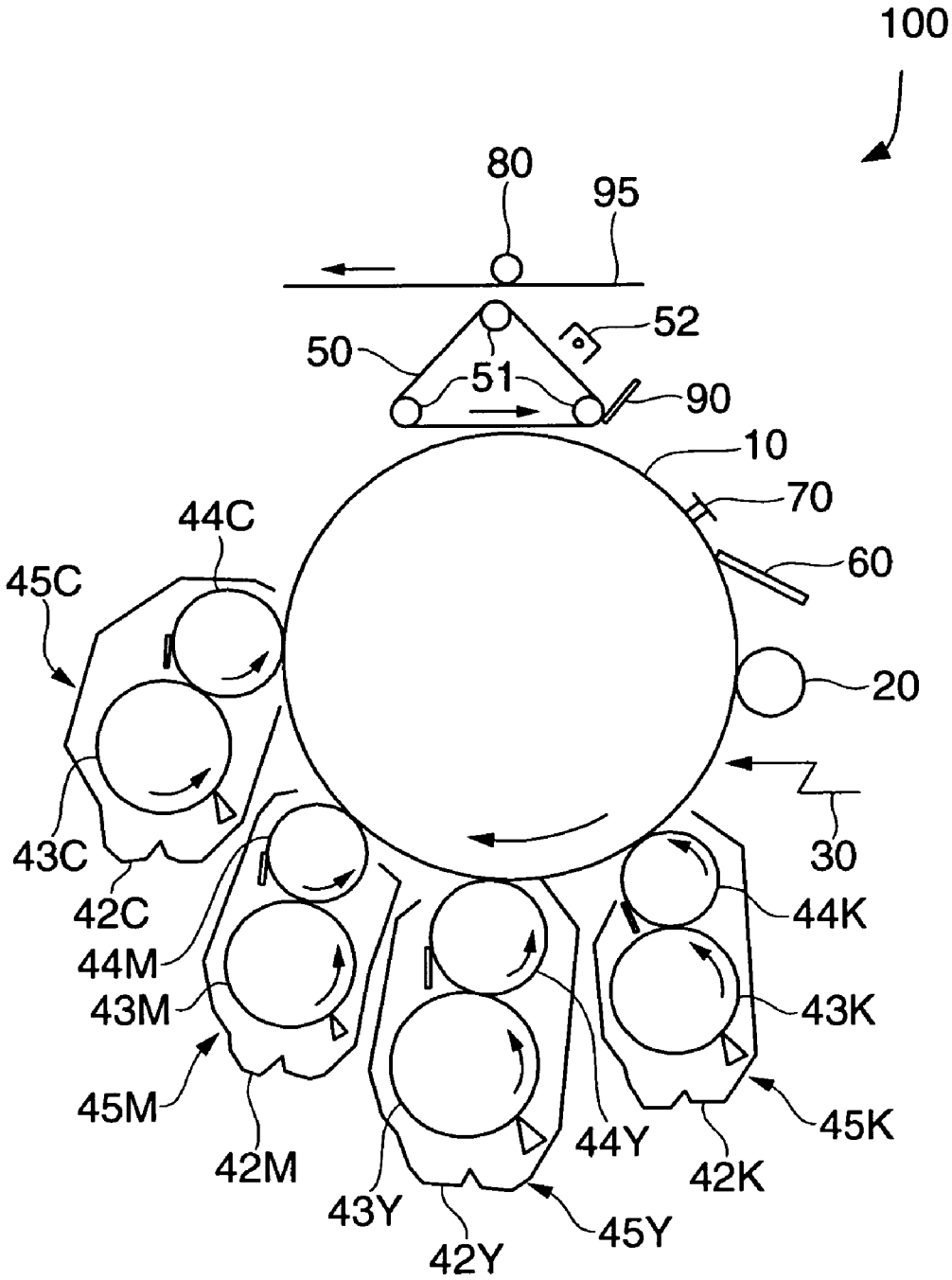
FIG. 4 is an explanatory view schematically showing another example of the performing of the image forming process according to the present invention using the image forming apparatus according to the present invention.

With respect to another embodiment for performing the imge forming method according to the present invention using the imge forming apparatus according to the present invention, referring to FIG. 4, explanations are given. The image forming apparatus 100 shown in FIG. 4 has substantially the same composition as that of the image forming apparatus 100 shown in FIG. 3, except that the image forming apparatus 100 shown in FIG. 4 comprises no developing belt 41 and around the photoconductive body 10, the black-developing unit 45 K, the yellow-developing unit 45 Y, the magenta-developing unit 45 M and the cyan-developing unit 45 C are arranged in such a manner that the photoconductive body 10 and the above-noted four developing units stand directly opposite to each other. The image forming apparatus 100 shown in FIG. 4 has substantially the same function and effect as those of the image forming apparatus 100 shown in FIG. 3. The same symbol in FIG. 4 as a symbol in FIG. 3 represents the same unit (or the like) in FIG. 4 as a unit in FIG. 3.

Figure 5:
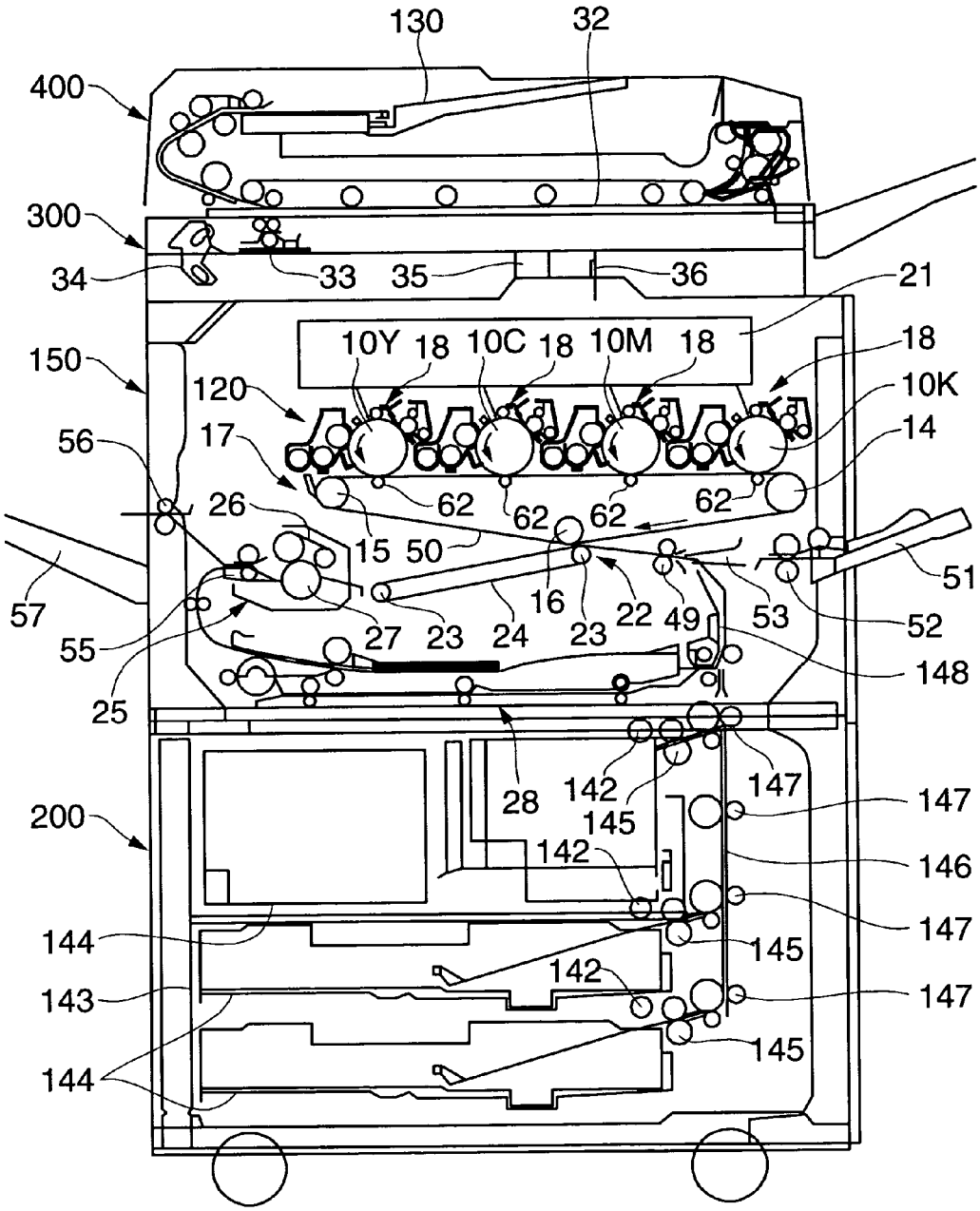
FIG. 5 is an explanatory view schematically showing an example of the performing of the image forming process according to the present invention using the image forming apparatus (a tandem color image forming apparatus) according to the present invention.

With respect to still another embodiment for performing the imge forming method according to the present invention using the imge forming apparatus according to the present invention, referring to FIG. 5, explanations are given. The tandem image forming apparatus shown in FIG. 5 is the tandem color image forming apparatus. The tandem image forming apparatus comprises the copying apparatus main body 150, the paper feeding table 200, the scanner 300 and the automatic document feeding apparatus (ADF) 400.

In the center of the copying apparatus main boby 150, the intermediate transferring body 50 in the form of an endless belt is installed. The intermediate transferring body 50 is stretched among the supporting rollers 14, 15 and 16 and is rotatable clock-wise in FIG. 5. In the near of the supporting roller 15, the cleaning apparatus 17 of the intermediate transferring body for removing the residual toner on the intermediate transferring body 50, is arranged. Along the intermediate transferring body 50 stretched between the supporting rollers 14 and 15, the tandem developing unit 120 comprising the four image forming units 18, such as the yellow-, cyan-, magenta- and black-image forming units which are fitted in this order along the conveying direction of the intermediate transferring body 50, is arranged in such a manner that the intermediate transferring body 50 and the four image forming units 18 stand opposite to each other. In the near of the tandem developing unit 120, the exposing apparatus 21 is arranged. In another side of the intermediate transferring body 50 than the side where the tandem developing unit 120 is arranged, the secondary transferring unit 22 is arranged. In the secondary transferring unit 22, the secondary transferring belt 24 which is an endless belt is stretched across a pair of secondary transferring rollers 23 and the paper for the transferring which is conveyed by the secondary transferring belt 24 and the intermediate transferring body 50 can be contacted with each other. In the near of the secondary transferring unit 22, the fixing apparatus 25 is arranged. The fixing apparatus 25 comprises the fixing belt 26 which is an endless belt and the pressing roller 27 which is arranged in such a manner that the pressing roller 27 is pressed by the fixing belt 26.

In the tandem image forming apparatus, in the near of the secondary transferring apparatus 22 and the fixing apparatus 25, the sheet reversing apparatus 28 for reversing the paper 95 for transferring in order to form the image on the both sides of the paper 95 for transferring, is arranged.

Next, with respect to the forming of the full color image (color copying) using the tandem image forming apparatus, explanations are given.

First, the document is set on the document stand 130 of the automatic document feeding apparatus (ADF) 400 or the automatic document feeding apparatus (ADF) 400 is opened and the document is set on the contact glass 32 of the scanner 300, then the automatic document feeding apparatus (ADF) 400 is closed.

When the start switch (not illustrated in FIG. 5) is pushed, the scanner 300 is driven, either after the document is conveyed onto the contact glass 32 in the case where the document is set on the document stand 130 or immediately in the case where the document is set on the contact glass 32, and the first running body 33 and the second running body 34 run. At this time, the first running body 33 irradiates the light from the light source in the first running body 33 and the second running body 34 reflects the reflected light from the surface of the document by a mirror in the second running body 34. The light reflected by the second running body 34 is irradiated through the image forming lens 35 and received by the reading sensor 36, so that the color document (color image) is read and the read color document is converted into the image informations of black, yellow, magenta and cyan.

Figure 6:
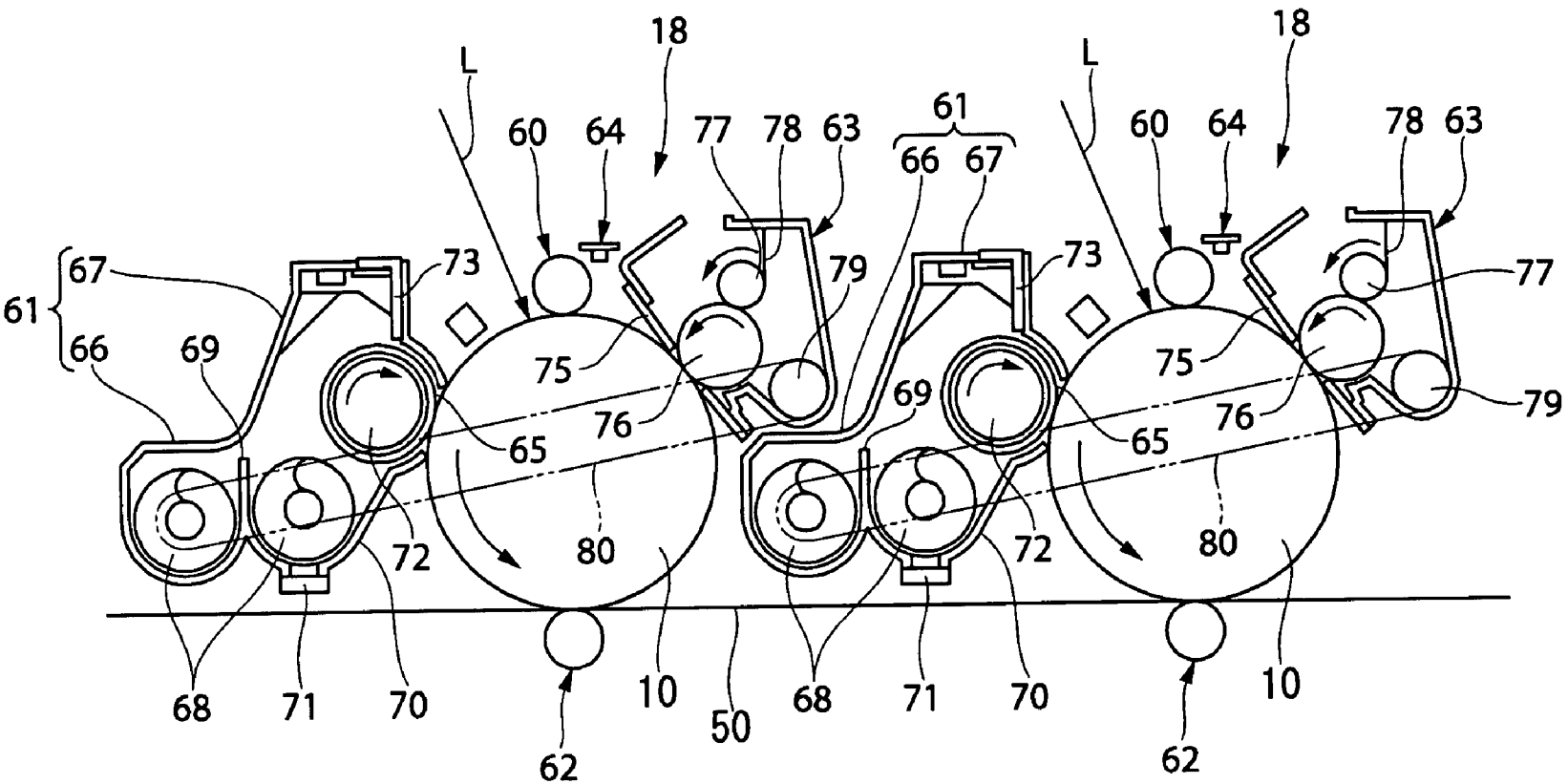
FIG. 6 is a fragmentary enlarged explanatory view schematically showing the image forming apparatus shown in FIG. 5.

Each of the black, yellow, magenta and cyan image informations is respectively transmitted to each image forming unit 18 (black image forming unit, yellow image forming unit, magenta image forming unit and cyan image forming unit) in the tandem image forming apparatus and by each image forming unit 18, each of black, yellow, magenta and cyan toner images is respectively formed. In other words, each image forming unit 18 (black image forming unit, yellow image forming unit, magenta image forming unit and cyan image forming unit) in the tandem image forming apparatus comprises, as shown in FIG. 6, each photoconductive body 10 (photoconductive body for black image 10 K, photoconductive body for yellow image 10 Y, photoconductive body for magenta image 10 M and photoconductive body for cyan image 10 C), each electrifying unit 60 which electrifies the photoconductive body 10 uniformly, each exposing unit which forms each electrostatic latent image corresponding to each color image on each photoconductive body by exposing (which is represented by "L" in FIG. 6) each photoconductive body according to each image corresponding to each color image based on each color image information, each developing unit 61 which forms each toner image of each color toner by developing each electrostatic latent image using each color toner (black toner, yellow toner, magenta toner and cyan toner), each transferring-electrifying unit 62 for transferring each toner image to the intermediate transferring body 50, each cleaning apparatus 63 for each photoconductive body and each destaticizing unit 64 and based on each color image information, each color image (black image, yellow image, magenta image and cyan image) can be formed. Each of the thus formed image, such as black image formed on the photoconductive body for black image 10 K, yellow image formed on the photoconductive body for yellow image 10 Y, magenta image formed on the photoconductive body for black image 10 M and cyan image formed on the photoconductive body for cyan image 10 C is sequently transferred (primary-tranferring) to the intermediate transferring body 50 which can be rotated by the supporting rollers 14, 15 and 16. Then, on the intermediate transferring body 50, the black image, yellow image, magenta image and cyan image are superimposed together, therby forming the synthesized color image (color transferred image). Reference characters 66 and 67 denote a lower main body case and an upper main body case, respectively, for the developing unit 61. Reference character 68 denotes a stirrer for stirring a developer, and reference character 69 denotes a division plate in the stirrer. The developer, spread over a roll-shaped developer bearing member 65, is formed into a thin film by means of a developer regulating plate 73 and is supplied to regions where an image is to be developed. The cleaning apparatus 63 is equipped with a primary cleaning blade 75 and a primary cleaning roller 76, The primary cleaning roller 76 is provided with a secondary cleaning roller 77, for cleaning the primary cleaning roller 76, and with a secondary cleaning blade 78, attached to the secondary cleaning roller 77. The cleaning apparatus 63 is further equipped with a conveying screw 79.

On the other hand, in the paper feeding table 200, the operations, such as rotating one of the paper feeding rollers 142 selectively; feeding the sheet (recording paper) from one of the paper feeding cassettes 144 in the paper bank 143; conveying the sheets to a primary paper feeding path 146, while separating the sheets one by one, by the separating roller 145; leading the sheets to secondary paper feeding path 148 in the copying apparatus main body 150 by means of a conveying roller 147; and stopping the sheet by directing the sheet to the resist roller 49; are performed. In the case of using the manual feeding tray 51, the operations comprise feeding the sheet (recording paper) on the manual feeding tray 51 by rotating the paper feeding roller; conveying the sheets to the manual paper feeding path 53, while separating the sheets one by one, by the separating roller 52; and stopping the sheet by directing the sheet to the resist roller 49. The resist roller 49 is generally used in such a state that the resist roller 49 is grounded; however, for removing the paper powder of the sheet, the resist roller 49 may be used in such a state that a bias is applied to the resist roller 49.

Thereafter, the further operations comprise rotating the resist roller 49 at the timing when the synthesized color image (color transferring image) is synthesized on the surface of the intermediate transferring body 50; feeding the sheet (recording paper) between the intermediate transferring body 50 and the secondary transferring apparatus 22; and transferring (secondary transferring) the above-noted synthesized color image (color transferring image) to the surface of the sheet (recording paper) by the secondary transferring apparatus 22, thereby transferring the color image to the surface of the sheet (recording paper) and forming the color image on the surface of the sheet (recording paper). The residual toner on the intermediate transferring body 50 after the image transferring is cleaned by the cleaning apparatus for the intermediate transferring body 17.

The still further operations comprise conveying the sheet (recording paper) on which the color image is transferred and formed, to the fixing apparatus 25 by the secondary transferring apparatus 22; and fixing the synthesized color image (color transferring image) on the sheet (recording paper) by applying the heat and pressure. Thereafter, in the case where on the reverse surface of the sheet (recording paper), no image will be recorded, the operations comprise changing the conveying route of the sheet (recording paper) towards the discharging roller 56 by the route changing claw 55; discharging the sheet (recording paper) by the discharging roller 56; and stacking the sheets in the discharging tray 57, and in the case where also on the reverse surface of the sheet (recording paper), the image will be recorded, the operations comprise changing the conveying route of the sheet (recording paper) towards the sheet revesing apparatus 28 by the route changing claw 55; reversing the sheet by the sheet reversing apparatus 28 and leading the sheet to the transferring units for recording the image on the reverse surface of the sheet; discharging the sheet (recording paper) by the discharging roller 56; and stacking the sheets in the discharging tray 57.

According to the image forming apparatus and the image forming process according to the present invention, the photoconductive layer comprises the reaction product produced by the reaction between the trifunctional or more functional radical polymerizable compound having no charge transportable structure and the monofunctional radical polymerizable compound having a charge transportable structure and by using the combination of the photoconductive body for the electrophotography comprising the photoconductive layer having a small wear degree and the toner produced in the form of particles by producing the adhesive base material by reacting the compound having an active hydrogen group and the polymer which is reactive with the compound having an active hydrogen group in an aqueous medium, an image having high quality in which the causing of the image blur and the image failure in the form of a stripe or a dot (black dot) can be prevented even in a high temperature-high humidity atmosphere and the high minuteness of the image can be maintained fro a long period, can be formed.

(Process Cartridge)

The process cartridge according to the present invention comprises an electrostatic latent image carrier carrying the electrostatic latent image, the developing unit configured to form a visible image by developing an electrostatic latent image formed on the electrostatic latent image carrier using the toner and optionally other units selected properly.

The electrostatic latent image carrier comprises a support and a photoconductive layer which comprises a charge generating layer, a charge transportable layer and a cross-linked charge transportable layer which are disposed on the support in this order and the cross-linked charge transportable layer comprises a compound produced by the reaction between a trifunctional or more functional radical-polymerizable compound having no charge transportable structure and a monofunctional radical-polymerizable compound having a charge transportable structure.

As the electrostatic latent image carrier for the process cartridge, the same electrostatic latent image carrier as that used in the above section of "Image Forming Process".

As the toner for the process cartridge, a toner produced in the form of particles by producing an adhesive base material through reacting a compound having an active hydrogen group with a polymer which can be reacted with the compound having an active hydrogen group in an aqueous medium is used and the detail thereof is mentioned below.

The developing unit for the process cartridge comprises a developing agent holder holding the toner or the developing agent and a developing agent carrier carrying and conveying the toner or the developing agent which is held in the developing agent holder, and may further comprise a layer thickness controlling member for controlling the thickness of the toner layer.

The process cartridge according to the present invention can be attached in various apparatus for the electrophotography in an attachable and detachable manner and is preferably in the apparatus for the electrophotography according to the present invention in an attachable and detachable manner.

Here, the process cartridge comprises, for example, as shown in FIG. 1, the photoconductive body 101, the electrifying unit 102, the exposing unit 103, the developing unit 104, the medium for the transferring (e.g., paper) 105, the cleaning unit 107, the transferring unit 108 and optionally other members.

The photoconductive body 101 comprises the support and the photoconductive layer comprising the charge generating layer, the charge transportable layer and the cross-linked charge transportable layer which are disposed on the support in this order. As the electrifying unit 102, as mentioned above, a conventional electrifying unit is used and for forming an image having high minuteness, a corona discharge is applied to the photoconductive body so that the photoconductive body has a strength of the electric field of 30 V/μm or more (60 V/μm or less, preferably 50 V/μm or less).

As the exposing unit 103, a light source which can write with high resolution is used.

As the electrifying unit 102, a random electrifying unit (preferably a scortron electrifying unit) is used.

The image forming apparatus for the electrophotography according to the present invention may be composed in such a manner that the components, such as the above-noted photoconductive body, the developing unit and the cleaning unit are incorporated into the process cartridge and the process cartridge is attached to the image forming apparatus main body in an attachable and detachable manner; or in such a manner that at least one of the electrifying unit, the image exposing unit, the developing unit, the transferring or separating unit and the cleaning unit, and the photoconductive body are together incorporated into the process cartridge and the process cartridge is attached to the image forming apparatus main body in an attachable and detachable manner which can be obtained by a guiding unit, such as a rail of the image forming apparatus main body.

(Toner)

The toner is produced in the form of particles by producing the adhesive base material by reacting the compound having an active hydrogen group and the polymer which is reactive with the compound having an active hydrogen group in an aqueous medium, and comprises a colorant, such as a pigment and optionally other components, such as a mold release agent, resin fine particles, a non-reactive polyester resin and a charge controlling agent.

—Adhesive Base Material—

The adhesive base material exhibits adhesion properties for a recording medium, such as paper and comprises a polymer produced by reacting the compound having an active hydrogen group and the polymer which is reactive with the compound having an active hydrogen group in an aqueous medium and optionally another binder selected properly from conventional binder resins.

The weight average molecular weight of the adhesive base material is not restricted and may be properly selected depending on the application. The weight average molecular weight is preferably 1,000 or more, more preferably 2,000 to 10,000,000, most preferably 3,000 to 1,000,000.

When the weight average molecular weight is less than 1,000, the hot offset resistance of the photoconductive body is impaired sometimes.

The glass transition temperature (Tg) of the adhesive base material is not restricted and may be properly selected depending on the application. The glass transition temperature is preferably 30° C. to 70° C., more preferably 40° C. to 65° C.

When the glass transition temperature is less than 30° C., heat resisting storage properties of the toner are impaired sometimes. On the other hand, when the glass transition temperature is more than 70° C., the low temperature fixing properties of the toner is unsatisfactory sometimes.

The adhesive base material is not restricted and may be properly selected depending on the application. Most preferred examples of the adhesive base material include a polyester resin.

The polyester resin is not restricted and may be properly selected depending on the application. Most preferred examples of the polyester resin include an urea modified polyester resin.

The urea modified polyester resin can be produced by reacting an amine (B) as the above-noted compound having an active hydrogen group and a polyester prepolymer having an isocyanate group (A) as the above-noted compound having an active hydrogen group, in an aqueous medium.

The urea modified polyester resin may comprise, besides an urea bonding an urethane bonding. The content molar ratio of the urea bonding and the urethane bonding (urea bonding/urethane bonding) is preferably 100/0 to 10/90, more preferably 80/20 to 20/80, most preferably 60/40 to 30/to 70.

When the content molar ratio of the urea bonding is less than 10, the hot offset resistance of the photoconductive body is impaired sometimes.

Preferred examples of the urea modified polyester resin include (1) a mixture of a polyester prepolmer which is produced by reacting a condensation-polymerization product of a 2 mole ethylene oxide adduct of a bisphenol A and isophthalic acid with isophorone diisocyanate, and which is ureanated by isophorone; and a condensation-polymerization product of a 2 mole ethylene oxide adduct of a bisphenol A and isophthalic acid, (2) a mixture of a polyester prepolmer which is produced by reacting a condensation-polymerization product of a 2 mole ethylene oxide adduct of a bisphenol A and isophthalic acid with isophorone diisocyanate, and which is ureanated by isophorone; and a condensation-polymerization product of a 2 mole ethylene oxide adduct of a bisphenol A and terephthalic acid, (3) a mixture of a polyester prepolmer which is produced by reacting a condensation-polymerization product of a 2 mole ethylene oxide adduct of a bisphenol A, a 2 mole propylene oxide adduct of a bisphenol A and terephthalic acid with isophorone diisocyanate, and which is ureanated by isophorone; and a condensation-polymerization product of a 2 mole ethylene oxide adduct of a bisphenol A, a 2 mole propylene oxide adduct of a bisphenol A and terephthalic acid, (4) a mixture of a polyester prepolmer which is produced by reacting a condensation-polymerization product of a 2 mole ethylene oxide adduct of a bisphenol A, a 2 mole propylene oxide adduct of a bisphenol A and terephthalic acid with isophorone diisocyanate, and which is ureanated by isophorone; and a condensation-polymerization product of a 2 mole propylene oxide adduct of a bisphenol A and terephthalic acid, (5) a mixture of a polyester prepolmer which is produced by reacting a condensation-polymerization product of a 2 mole ethylene oxide adduct of a bisphenol A and terephthalic acid with isophorone diisocyanate, and which is ureanated by hexamethylenediamine; and a condensation-polymerization product of a 2 mole ethylene oxide adduct of a bisphenol A and terephthalic acid, (6) a mixture of a polyester prepolmer which is produced by reacting a condensation-polymerization product of a 2 mole ethylene oxide adduct of a bisphenol A and terephthalic acid with isophorone diisocyanate, and which is ureanated by hexamethylenediamine; and a condensation-polymerization product of a 2 mole ethylene oxide adduct of a bisphenol A, a 2 mole propylene oxide adduct of a bisphenol A and terephthalic acid, (7) a mixture of a polyester prepolmer which is produced by reacting a condensation-polymerization product of a 2 mole ethylene oxide adduct of a bisphenol A and terephthalic acid with isophorone diisocyanate, and which is ureanated by ethylenediamine; and a condensation-polymerization product of a 2 mole ethylene oxide adduct of a bisphenol A and terephthalic acid, (8) a mixture of a polyester prepolmer which is produced by reacting a condensation-polymerization product of a 2 mole ethylene oxide adduct of a bisphenol A and isophthalic acid with diphenylmethane diisocyanate, and which is ureanated by hexamethylenediamine; and a condensation-polymerization product of a 2 mole ethylene oxide adduct of a bisphenol A and isophthalic acid, (9) a mixture of a polyester prepolmer which is produced by reacting a condensation-polymerization product of a 2 mole ethylene oxide adduct of a bisphenol A, a 2 mole propylene oxide adduct of a bisphenol A and terephthalic acid/dodecenylsuccinic acid anhydride with diphenylmethane diisocyanate, and which is ureanated by hexamethylenediamine; and a condensation-polymerization product of a 2 mole ethylene oxide adduct of a bisphenol A, a 2 mole propylene oxide adduct of a bisphenol A and terephthalic acid and (10) a mixture of a polyester prepolmer which is produced by reacting a condensation-polymerization product of a 2 mole ethylene oxide adduct of a bisphenol A and isophthalic acid with toluene diisocyanate, and which is ureanated by hexamethylenediamine; and a condensation-polymerization product of a 2 mole ethylene oxide adduct of a bisphenol A and isophthalic acid.

—Compound Having Active Hydrogen Group—

In the extension reaction or cross-linking reaction of a polymer which is reactive with a compound having an active hydrogen and a compound having an active hydrogen in an aqueous medium, the compound having an active hydrogen reacts as an extension agent or a crosslinker.

The compound having an active hydrogen is not restricted and may be properly selected depending on the application. As the compound having an active hydrogen, for example, when a polymer which is reactive with a compound having an active hydrogen is the above-noted polyester prepolymer having an isocyanate group (A), from the viewpoint of having a function of enhancing the molecular weight of the polyester prepolymer having an isocyanate group (A) through the extension or cross-linking reaction with the polyester prepolymer having an isocyanate group (A), the above-noted amine (B) is preferred.

The active hydrogen group is not restricted and may be properly selected depending on the application. Examples of the active hydrogen group include a hydroxyl group (an alcoholic hydroxyl group or a phenolic hydroxyl group), an amino group, a carboxyl group and a mercapto group. These active hydrogen groups may be used individually or in combination. Among them, the alcoholic hydroxyl group is most preferred.

The amine (B) is not restricted and may be properly selected depending on the application. Examples of the amine (B) include a diamine (B1), a trifunctional or more valent polyamine (B2), an aminoalcohol (B3), an aminomercaptan (B4), an amino acid (B5) and any one of amines produced by blocking an amino group in the above amines of (B1) to (B5).

These amines may be used individually or in combination. Among them, a diamine (B1) and a mixture of a diamine (B) and a small amount of a trifunctional or more valent polyamine (B2) is most preferred.

Examples of the diamine (B1) include an aromatic diamine, a cycloaliphtic diamine and an aliphatic diamine. Specific examples of the aromatic diamine include phenylenediamine, diethyltoluenediamine and 4,4'-diaminodiphenylmethane. Specific examples of the cycloaliphatic diamine include 4,4'-diamino-3,3'dimethyldicyclohexylmethane, diaminecyclohexane and isophoronediamine. Specific examples of the aliphatic diamine include ethyle nediamine, tetramethylene diamine and hexamethylenediamine.

Specific examples of the trifunctional or more valent polyamine (B2) include diethylenetriamine and triethylenetetramine.

Specific examples of the aminoalcohol (B3) include ethanol amine and hydroxyethylaniline.

Specific examples of the aminomercaptane include aminoethylmercaptane and aminopropylmercaptane.

Specific examples of the amino acid (B5) include amino propioic acid and amino caproic acid.

Specific examples of the any one of amines (B6) produced by blocking an amino group in the above amines of (B1) to (B5) include a ketimine compound produced by a reaction of any one of the above-noted amines (B1) to (B5) and a ketone (e.g., acetone, methyl ethyl ketone and methyl isobutyl ketone), and an oxazolizone compound.

Fopr terminating the extension or cross-linking rection of the compound having an active hydrogen group with the polymer which is reactive with the compound having an active hydrogen group, a reaction terminating agent can be used. It is preferred that by using the reaction terminating agent, the molecular weight of the adhesive base material can be controlled within a desired range. Examples of the reaction terminating agent include a monoamine (e.g., diethylamine, dibutylamine, butylamine and laurylamine) and a compound produced by blocking an amino group in the monoamine (ketimine compound).

As the mixing ratio of the amine (B) and the polyester prepolymer having an isocyanate group (A), the mixing equivalent ratio ([NCO]/[NHx]) between the isocyanate group [NCO] in the polyester prepolymer having an isocyanate group (A) and the amino group [NHx] in the amine (B) is preferably 1/3 to 3/1, more preferably 1/2 to 2/1, most preferably 1/1.5 to 1.5/1.

When the mixing equivalent ratio ([NCO]/[NHx]) is less than 1/3, the low temperature fixing properties of the photoconductive body is lowered sometimes. On the other hand, when the mixing equivalent ratio ([NCO]/[NHx]) is more than 3/1, the hot offset resistance of the photoconductive body is impaired sometimes.

—Polymer which is Reactive with Compound Having Active Hydrogen—Group

The polymer which is reactive with a compound having an active hydrogen group (hereinafter, sometimes referred to as "prepolymer") is not restricted so long as the polymer has at least a portion which is reactive with a compound having an active hydrogen group and may be properly selected from conventional resins depending on the application. Examples of the compound having an active hydrogen group include a polyol resin, a polyacryl resin, a polyester resin, an epoxy resin and any one of derived resins from the above-noted resins.

These resins may be used individually or in combination. Among them, from the viewpoint of high melt fluidity and transparency, a polyester resin is most preferred.

The portion in the above-noted prepolymer, which is reactive with the compound having an active hydrogen group is not restricted and may be properly selected from conventional substituents depending on the application. Examples of the reactive portion in the prepolymer include an isocyanate group, an epoxy group, a carbonic acid group and an acid chloride group.

These reactive portions may be contained in the prepolymer individually or in combination. Among them, the isocyanate group is most preferred.

From the viewpoint of such an advantage that the molecular weight of the polymer component is easily controlled and the oilles low temperature fixing properties of the dry toner produced using the prepolymer, particularly advantageous molt release properties and fixing properties of the dry toner even when the image forming apparatus is not equipped with no molt release oil applying unit for a heating medium for the fixing can be secured, the above-noted prepolymer is most preferably a polyester resin having an urea bonding formable group (RMPE).

Examples of the urea bonding formable group include an isocyanate group. When the urea bonding formable group in the above-noted polyester resin having an urea bonding formable group (RMPE) is an isocyanate group, as the polyester resin (RMPE), the polyester prepolymer having an isocyanate group (A) is most preferred.

The polyester prepolymer having an isocyanate group (A) is not restricted and may be properly selected depending on the application. Examples of the polyester prepolymer having an isocyanate group (A) include a condensation-polymerization product of a polyol (PO) and a polycarboxylic acid (PC) which is a reaction product produced by reacting the polyester resin having an active hydrogen group with a polyisocyanate (PIC).

The polyol (PO) is not restricted and may be properly selected depending on the application. Examples of the polyol include a diol (DIO), a trifunctional or more valent polyol (TO) and a mixture of the diol and the trifunctional or more valent polyol. These polyol may be used individually or in combination. Among them, the diol (DIO) and a mixture of the diol (DIO) and a small amount of the trifunctional or more valent polyol (TO) are preferred.

Examples of the diol (DIO) include an alkylene glycol, an alkylene ether glycol, a cycloaliphatic diol, an alkyleneoxide adduct of a cycloaliphatic diol, a bisphenol and an alkyleneoxide adduct of a bisphenol.

Examples of the alkylene glycol include a $C_2$ to $C_{12}$ glycol, such as ethylene glycol, 1,2-propylene glycol, 1,3-propylene glycol, 1,4-butanediol and 1,6-hexanediol. Examples of the alkylene ether glycol include diethylene glycol, triethylene glycol, dipropylene glycol, polyethylene glycol, polypropylene glycol and polytetramethylene ether glycol. Examples of the cycloaliphatic diol include 1,4-cyclohexsanedimethanol and a hydrogen substituted bisphenol A. Examples of the alkyleneoxide adduct of the cycloaliphatic diol include a cycloaliphatic diol to which an alkyleneoxide, such as ethylene oxide, propylene oxide and butylenes oxide is added. Examples of the bisphenol include bisphenol A, bisphenol F and bisphenol S. Examples of the alkyleneoxide adduct of the bisphenol include a bisphenol to which an alkyleneoxide, such as ethylene oxide, propylene oxide and butylenes oxide is added.

Among them, a $C_2$ to $C_{12}$ alkylene glycol and an alkylene oxide adduct of a bisphenol are preferred and an alkylene oxide adduct of a bisphenol and a mixture of an alkylene oxide adduct of a bisphenol and a $C_2$ to $C_{12}$ alkylene glycol is most preferred.

As the trifunctional or more valent polyol (TO), tri- to octa- or more valent polyol is preferred. Examples of a $C_2$ to $C_{12}$ alkylene glycol include the trifunctional or more valent polyvalent aliphatic alcohol, a trifunctional or more valent polyphenol and an alkylene oxide adduct of a trifunctional or more valent polyphenol.

Examples of the trifunctional or more valent polyvalent aliphatic alcohol include glycerine, trimethylolethane, trimethylolpropane, pentaerythritol and sorbitol.

Examples of the trifunctional or more valent polyphenol include a trisphenol PA, a phenolic novolak and a cresolic novalak. Examples of an alkylene oxide adduct of the trifunctional or more valent polyphenol include a trifunctional or more valent polyphenol to which an alkylene oxide, such as ethylene oxide, propylene oxide and butylenes oxide is added.

The mixing mass ratio (DIO:TO) of the diol (DIO) and the trifunctional or more valent polyol (TO) in a mixture thereof is preferably 100:0.01 to 100:10, more preferably 100:0.01 to 100:1.

The polycarboxylic acid (PC) is not restricted and may be properly selected depending on the application. Examples of the polycarboxylic acid include a dicarboxylic acid (DIC), a trifunctional or more valent polycarboxylic acid (TC) and a mixture of a dicarboxylic acid (DIC) and a trifunctional or more valent polycarboxylic acid.

These polycarboxylic acids may be used individually or in combination. Among them, a dicarboxylic acid (DIC) and a mixture of a dicarboxylic acid (DIC) and a small amount of a trifunctional or more valent polycarboxylic acid (TC) are preferred.

Examples of the dicarboxylic acid include an alkylenedicarboxylic acid, an alkenylenedicarboxylic acid and an aromatic dicarboxylic acid.

Examples of the alkylenedicarboxylic acid include succinic acid, adipic acid and sebacic acid. Preferred examples of the alkenylenedicarboxylic acid include a $C_4$ to $C_{20}$ alkenylenedicarboxylic acid, such as maleic acid and fumaric acid. Preferred examples of the aromatic dicarboxylic acid include a $C_8$ to $C_{20}$ aromatic dicarboxylic acid, such as phthalic acid, isophthalic acid, terephthalic acid and naphthalenedicarboxylic acid.

Among them, a $C_4$ to $C_{20}$ alkenylenedicarboxylic acid and a $C_8$ to $C_{20}$ aromatic dicarboxylic acid are preferred.

Preferred examples of the trifunctional or more valent polycarboxylic acid (TO) include a tri- to octa- or more valent polycarboxylic acid, such as an aromatic polycarboxylic acid.

Examples of the aromatic polycarboxylic acid include $C_9$ to $C_{20}$ aromatic polycarboxylic acid, such as trimellitic acid and pyromellitic acid.

Examples of the polycarboxylic acid (PC) include an acid anhytride and lower alkyl ester of one selected from the group consisting of the dicarboxylic acid (DIC), the trifunctional or more valent polycarboxylic acid (TC) and a mixture of the dicarboxylic acid (DIC) and the trifunctional or more valent polycarboxylic acid (TC). Examples of the above-noted lower alkyl ester include a methyl ester, a ethyl ester and an isopropyl ester.

The mixing mass ratio (DIC:TC) of the dicarboxylic acid (DIC) and the trifunctional or more valent polycarboxylic acid (TC) in the mixture thereof is not restricted and may be properly selected depending on the application. The mixing mass ratio is preferably 100:0.01 to 100:10, more preferably 100:0.01 to 100:1.

The mixing ratio of the polyol (PO) and the polycarboxylic acid (PC) in the condensation-polymerization of the polyol and polycarboxylic acid is not restricted and may be properly selected depending on the application. For example, an equivalent ratio ([OH]/[COOH]) of a hydroxyl group [OH] of the polyol (PO) and a carboxyl group [COOH] of the polycarboxylic acid (PC) is preferably 2/1 to 1/1, more preferably 1.5/1 to 1/1, most preferably 1.3/1 to 1.02/1.

The amount of the polyol (PO) in the polyester prepolymer having an isocyanate group (A) is not restricted and may be properly selected depending on the application. The amount is preferably 0.5% by mass to 40% by mass, more preferably 1% by mass to 30% by mass, most preferably 2% by mass to 20% by mass, based on the mass of the polyester prepolymer having an isocyanate group (A).

When the amount is less than 0.5% by mass, the hot offset resistance of the photoconductive body is impaired and the compatibility between the heat resisting storage properties and lower temperature fixing properties of the toner becomes difficult sometimes. On the other hand, when the amount is more than 40% by mass, the lower temperature fixing properties of the toner is impaired sometimes.

The polyisocyanate (PIC) is not restricted and may be properly selected depending on the application. Examples of the polyisocyanate include an aliphatic polyisocyanate, a cycloaliphatic polyisocyanate, an aromatic diisocyanate, an isocyanurate, a phenol derivative of the above-noted polyisocyanates and a blocked product of the above-noted polyisocyanates produced by blocking the polyisocyanate with an oxime or a caprolactam.

Examples of the aliphatic polyisocyanate include tetramethylene diisocyanate, hexamethylene diisocyanate, 2,6-diisocyanate methylcaproate, octamethylene diisocyanate, decamethylene diisocyanate, dodecamethylene diisocyanate, tetradecamethylene diisocyanate, trimethylhexane diisocyanate and tetramethylhexane diisocyanate. Examples of the cycloaliphatic polyisocyanate include isophoron diisocyanate and cyclohexylmethane diisocyanate. Examples of the aromatic diisocyanate include tolylene diisocyanate, diphenylmethane diisocyanate, 1,5-naphthylene diisocyanate, diphenylene-4,4'-diisocyanate, 4,4'-diisocyanate-3,3'-dimethyldiphenyl, 3-methyldiphenylmethane-4,4'-diisocyanate, diphenyl ether-4,4'-diisocyanate and α,α,α',α'-tetramethylxylene diisocyanate. Examples of the isocyanurate include tris-isocyanatoalkyl-ioscyanurate and triisocyanatocycloalkyl-isocyanurate.

These polyisocyantes may be used individually or in combination.

As the mixing ratio of the polyisocyanate (PIC) and the polyester resin having an active hydrogen group (e.g., a polyester resin having a hydroxyl group) in the reaction thereof with each other, usually, the mixing equivalent ratio ([NCO]/[OH]) of the isocyanate group [NCO] in the polyisocyanate (PIC) and the hydroxyl group [OH] in the polyester resin having a hydroxyl group is preferably 5/1 to 1/1, more preferably 4/1 to 1.2/1, most preferably 3/1 to 1.5/1.

When the mixing ratio of the isocyanate group is more than 5, the lower temperature fixing properties of the toner is impaired. On the other hand, when the mixing ratio of the isocyanate group is less than 1, the offset resistance of the toner is impaired sometimes.

The amount of the polyisocyanate (PIC) in the polyester prepolymer having an isocyanate group (A) is not restricted and may be properly selected depending on the application. The amount is preferably 0.5% by mass to 40% by mass, more preferably 1% by mass to 30% by mass, still more preferably 2% by mass to 20% by mass.

When the amount is less than 0.5% by mass, the hot offset resitance of the toner is impaired and the compatibility between the heat resisting storage properties and lower temperature of the toner becomes difficult sometimes. On the other hand, when the amount is more than 40% by mass, the lower temperature fixing properties of the toner is impaired sometimes.

The average number of the isocyanate group contained in one molecule of the polyester prepolymer having an isocyanate group (A) is preferably 1 or more, more preferably 1.2 to 5, still more preferably 1.5 to 4.

When the average number of the isocyanate group is less than 1, the molecular weight of the polyester resin (RMPE) which is modified with an urea bonding formable group is lowered and the hot offset resistance of the toner is impaired sometimes.

—Aqueous Medium—

The above-noted aqueous medium is not restricted and may be properly selected from conventional aqueous media depending on the application. Examples of the aqueous medium include water, a solvent which is miscible with water and a mixture of water and a solvent which is miscible with water.

The solvent which is miscible with water is not restricted so long as the solvent is miscible with water. Examples of the solvent which is miscible with water include an alcohol, dimethylformamide, tetrahydrofuran a cellosolve and a lower ketone.

Examples of the alcohol include methanol, isopropanol and ethyleneglycol. Examples of the cellosolve include methyl cellosolve. Examples of the lower ketone include acetone and methyl ethyl ketone.

These aqueous media may be used individually or in combination.

—Other Components—

The othe components are not restricted and may be properly selected depending on the application. Examples of other components include a cleaning properties improving agent, a fluidity imparting agent, a mold release agent, a colorant, an unreactive polyester resin, a charge controlling agent and a magnetic material. These components can be incorporated in the toner composition as an additive.

The cleaning properties improving agent is incorporated in the toner composition for removing the residual toner on the photoconductive body or the primary transferring medium after the transferring. Examples of the cleaning properties improving agent include a metal salt of an aliphatic acid, such as zinc stearate and calcium stearate; and polymer fine particles produced by a soap free emulsion polymerization, such as polymethylmetacrylate fine particles and polystyrene fine particles. The polymer fine particles have preferably a relative small particle size distribution and a volume average particle diameter of 0.01 μm to 1 μm.

Preferred examples of the fluidity imparting agent include the same fine particles as the above-noted fine particles. The fine particles are incorporated in the toner composition as an additive and for reinforcing the incorporating effect of the fine particles, it is preferred that the fluidity improving agent is incorporated in the toner composition as an additive.

The colorant is not restricted and may be propely selected from conventional dyes and pigments depending on the application. Examples of the colorant include a carbon black, a nigrosine dye, black iron oxide, naphthol yellow S, Hanza yellow (10G, 5G, G), cadmium yellow, yellow iron oxide, loess, chrome yellow, titanium yellow, polyazo yellow, oil yellow, hansa yellow (GR, A, RN, R), pigment yellow L, benzidine yellow (G, GR), permanent yellow (NCG), Vulcan fast yellow (5G, R), tartrazine lake, quinoline yellow lake, anthracene yellow BGL, isoindolinone yellow, red iron oxide, minium, lead vermilion, cadmium red, cadmium mercury red, antimony vermilion, Permanent-Red 4R, Para Red, Fire Red, p-chloro-o-nitroaniline red, risol fast scarlet, brilliant fast scarlet, Brilliant Carmine BS, permanent red (F2R, F4R, FRL, FRLL, F4RH), fast scarlet VD, Vulcan Fast Rubine B, brilliant scarlet G, Lithol Rubine GX, permanent-Red F5R, brilliant carmine 6B, Pigment Scarlet 3B, Bordeaux 5B, Toluidine Maroon, Permanent Bordeaux F2K, Helio Bordeaux BL, bold 10B, BON Maroon Light, BON Maroon Medium, eosine lake, rhodamine lake B, rhodamine lake Y, alizarin lake, Thioindigo Red B, Thioindigo Maroon, oil red, quinacridone red, pyrazolone red, polyazo red, chrome vermilion, benzidine orange, Perynone Orange, oil orange, cobalt blue, cerulean blue, alkali blue lake, peacock blue lake, Victoria blue lake, non-metallic phthalocyanine blue, phthalocyanine-blue, fast sky blue, Indanthrene Blue (RS, BC), indigo, ultramarine blue, Berlin blue, anthraquinone blue, fast violet B, methyl violet lake, cobalt purple, manganese purple, dioxane violet, anthraquinone violet, chromium green, zinc green, chromium oxide, viridian, emerald green, pigment green B, naphthol green B, green gold, acid green lake, malachite-green lake, phthalocyanine green, anthraquinone green, titanium oxide, zinc white, lithopone.

These colorants may be used individually or in combination.

The amount of the colorant in the toner is not restricted and may be properly selected depending on the application. The amount is preferably 1% by mass to 20% by mass, more preferably 3% by mass to 15% by mass, based on the mass of the toner. When the amount is less than 1% by mass, the coloring force becomes unsatisfactory some times. On the other hand, when the amount is more than 15% by mass, the fixing proiperties of the toner is lowered sometimes.

The colorant may be used in combination with a resin as a master batch. The resin is not restricted and may be properly selected from conventional resins depending on the application. Examples of the resin include styrene and a polymer of a substituted styrene, a styrene copolymer, a polymethylmethacrylate, a a polybutylmethacrylate, a polyvinyl chloride, a polyvinyl acetate, a polyethylene, a polypropylene, a polyester, an epoxy resin, an epoxypolyol resin, a a polyurethane, a polyamide, a polyvinylbutylal, a polyacrylate resin, a rosin, a modified rosin, a terpene resin, an aliphatic hydrocarbon resin, a cycloaliphatic hydrocarbon resin, an aromatic petroleum resin, a chlorinated paraffine and a paraffine wax. These resins may be used individually or in combination.

Examples of the styrene or the polymer of a substituted styrene include a polyester resin, a polystyrene, a polyp-chlorostyrene and a polyvinyltoluene. Examples of the styrene copolymer include a styrene-p-chlorostyrene copolymer, a styrene-propylene copolymer, a styrene-vinyltoluene copolymer, a styrene-vinylnaphthalene copolymetr, a styrene-butyl acrylate copolymer, a styrene-octyl acrylate copolymer, a styrene-methyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, a a styrene-acrylonitrile-indene copolymer, a styrene maleic acid copolymer and a styrene-maleic acid ester copolymer.

The master batch can be produced by mixing or kneeding a resin for the master batch and the colorant with applying a high shearing force. At this time, for enhancing the interaction between the colorant and the resin, it is preferred that an organic solvent is added to the mixture. By a so-called flushing method, a wet cake of the colorant can be used as it is, so that from the viewpoint of such an advantage that thedrying is unnecessary, the flushing method is preferred. The flushing method comprises mixing or kneeding an aqueous paste of the colorant which contains water and the resin together with an organic solvent, transferring the colorant to the resin and removing water and the organic solvent from the mixture. For the above-noted mixing or kneeding, for example a dispersing apparatus, such as a triple roll mill which can apply a high shearing force is preferably used.

The mold release agent is not restricted and may be properly selected from conventional mold release agent depending on the application. Preferred examples of the mold release agent include a wax.

Examples of the wax include a wax having a carbonyl group, a polyolephine wax and a hydrocarbon having a long chain. These waxes may be used individually or in combination. Among them, the wax having a carbonyl group is preferred.

Eaxmples of the wax having a carbonyl group include a polyalkane acid ester, a polyalkanol ester, a polyalkane acid amide, a polyalkylamide and a dialkyl ketone. Examples of the polyalkane acid ester include carnauba wax, montan wax, trimethylolpropane tribehenate, pentaerythritol tetrabehenate, pentaerythritol diacetate dibehenate, glycerine tribehenate, 1,18-octadecanediol distearate. Examples of the polyalkanol ester include tristearyl trimellitate and distearyl maleate. Examples of the polyalkane acid amide include dibehenylamide. Examples of the polyalkylamide include trimellitic acid tristearylamide. Examples of the dialkyl ketone include distearyl ketone. Among these wax having a carbonyl group, a polyalkane acid ester is most preferred.

Examples of the polyolefin wax include a polyethylene wax and a polypropylene wax.

Examples of the hydrocarbon having a long chain include a paraffine wax and a Sasol wax.

The melting point of the mold release agent is not restricted and may be properly selected depending on the application.

The melting point is preferably 40° C. to 160° C., more preferably 50° C. to 120° C., most preferably 60° C. to 100° C.

When the melting point is less than 40° C., the wax affects adversely the heat resisting storage properties of the toner sometimes. On the other hand, when the melting point is more than 160° C., during the fixing at a low temperature, the toner causes easily the cold offset sometimes.

The amount of the mold release agent in the toner is not restricted and may be properly selected depending on the application. The amount is preferably 0% by mass to 40% by mass, more preferably 3% by mass to 30% by mass.

When the amount is more than 40% by mass, the fluidity of the toner and the durability of the developing agent are lowered sometimes.

The above-noted resin fine particles incorporated in the toner composition as a main component (OMS) is generally used for controlling the toner form (e.g., circularity degree and particle size distribution). The resin fine particles are attached or bonded to the surface of the form of the toner particles during the production of the toner binder resin and the forming of the form of the toner particles.

The resin fine particles are preferably produced using a resin which can form an aqueous dispersion in an aqueous medium and may be produced using a resin selected properly from conventional resins depending on the application. The resin may be also a thermoplastic resin or a thermosetting resin.

Specific examples of the resin include a vinyl resin, a polyurethane resin, an epoxy resin, a polyester resin, a a polyamide resin, a polyamide rtesin, a silicone resin, a phenolic resin, a melamine resin, an urea resin, an aniline resin, an iomer resin and a polycarbonate resin.

These resins may be used individually or in combinatioin. Among them, from the viewpoint of such an advantage that an aqueous dispersion of resin particles in the form of an ultrafine sphere can be easily produced, a vinyl resin, a polyurethane resin, an epoxy resin, a polyester resin and a mixture of the above-noted resins are preferred. The above-noted vinyl resin is a polymer produced by polymerizing or copolymerizing a vinyl monomer and examples thereof include a styrene-(meth)acrylate resin, a styrene-butadiene copolymer, an (meth)acrylic acid-acrylate copolymer, a styrene-acrylonitrile copolymer, a styrene-maleic acid anhydride copolymer and a styrene-(meth)acrylic acid copolymer.

The glass transition temperature (Tg) of the resin fine particles is not restricted and may be properly selected depending on the application. The glass transition temperature is preferably 40° C. to 100° C., more preferably 60° C. to 80° C.

When the glass transition temperature (Tg) is less than 40° C., the shelf stability of the toner is impaired and a blocking is caused sometimes during the storage of the toner or in the developing apparatus. On the other hand, when the glass transition temperature (Tg) is more than 100° C., resin fine particles inhibit the adhesion properties of the toner to a paper for fixing, so that the lower limit temperature for the fixing is elevated sometimes.

The weight average molecular weight (Mw) of resin fine particles is not restricted and may be properly selected depending on the application. The weight average molecular weight is preferably 9,000 to 500,000, more preferably 20,000 to 200,000.

When the weight average molecular weight is less than 9,000, the shelf stability of the toner is impaired and a blocking is caused sometimes during the storage of the toner or in the developing apparatus. On the other hand, when the weight average molecular weight is more than 200,000, resin fine particles inhibit the adhesion properties of the toner to a paper for fixing, so that the lower limit temperature for the fixing is elevated sometimes.

The average particle diameter of the resin fine particles is not restricted and may be properly selected depending on the application. The average particle diameter is preferably 5 nm to 500 nm, more preferably 30 nm to 300 nm.

When the average particle diameter is less than 5 nm, particle diameter controlling properties are lowered. On the other hand, when the average particle diameter is more than 500 nm, the particle diameter distribution becomes broad.

The amount of the resin fine particles in the toner is not restricted and may be properly selected depending on the application. The amount is preferably 0.5% by mass to 5.0% by mass, more preferably 1.0% by mass to 3.0% by mass, based on the mass of the toner.

The amount of the resin fine particles in the toner can be measured according to various methods. By analyzing a substance or a functional group derived only from resin fine particles using a thermal decomposition gas chromatography mass analyzer, the above-noted amount can be calculated from the peak area for the resin fine particles obtained by the above-noted analysis.

For improving the low temperature fixing properties and glossiness of the toner, the unreactive polyester resin is incorporated in the toner composition.

The unreactive polyester resin is not restricted and may be properly selected from conventional unreactive polyester resins depending on the application. Examples of the unreactive polyester resin include the same polyester resin as the above-noted polyester resin having an urea bonding formable group, i.e., a condensation-polmerization product of a polyol (PO) and a polycarboxylic acid (PC). The unreactive polyester resin may be not only an unmodified polyester, but also a modified polyester which is modified with another chemical bonding than an urea bonding, such as an urethane bonding. It is preferred from the viewpoint of the low temperature fixing properties and hot offset resistance of the toner that a portion of the unreactive polyester resin is compatible with the polyester resin having an urea bonding formable group (RMPE), in other words these two polyester resins have similar structures to each other which are compatible with each other.

The weight average molecular weight of the unreactive polyester resin is not restricted and may be properly selected depending on the application. The weight average molecular weight measured by GPC (gel permiation chromatography) of the unreactive polyester resin is preferably 1,000 to 30,000, more preferably 1,500 to 15,000.

When the weight average molecular weight is less than 1,000, the offset properties of the toner is impaired sometimes. On the other hand, when the weight average molecular weight is more than 30,000, the low temperature fixing properties of the toner is impaired sometimes.

The acid value of the unreactive polyester resin is preferably 1 to 50, more preferably 5 to 30. Generally, when the toner has an acid value, the toner is easily negatively charged.

When the unreactive polyester resin is incorporated in the toner composition, the mixing mass ratio (RMPE/PE) of the polyester resin having an urea bonding formable group (RMPE) and the unreactive polyester resin (PE) is preferably 5/95 to 80/20, more preferably 5/95 to 30/70, still more preferably 5/95 to 25/75.

When the mixing mass ratio of the unreactive polyester resin (PE) is more than 95, the hot offset resistance of the toner is impaired sometimes. On the other hand, when the mixing mass ratio of the unreactive polyester resin (PE) is less than 20, the low temperature fixing properties of the toner is impaired sometimes.

The charge controlling agent is not restricted and may be properly selected from conventional charge controlling agents depending on the application; however, when as the charge controlling agent, a colored material is used, a color tone of the toner is changed sometimes, therefore, a colorless material or material having a color which is near to white is preferably used. Examples of the charge controlling agent include a nigrosine dye, a tiphenylmethane dye, a metal complex dye containing chromium, a molybdic acid-chlate pigment, a rhodamine dye, an alkoxy amine, a quaternary ammonium salt (including a fluorine modified quaternary ammonium salt), an alkylamide, phosphorus or a compound thereof, tungsten or a compound thereof, an activating agent containing fluorine, a metal salt of salicylic acid and a metal salt of a salicylic acid derivative. These charge controlling agents may be used individually or in combination.

The charge controlling agent may be a commercially available agent. Examples of the commercially available charge controlling agent include a nigrosine dye Bontron 03, a quaternary ammonium salt Bontron P-51, an azo dye containing a metal Bontron S-34, an oxynaphthoic acid metal complex E-82, a salicylic acid metal complex E-84 and a phenolic condensate E-89 (which are manufactured and sold by Orient Chemical Industries); quaternary ammonium salt molybdenum complexes TP-302, TP-415 (which are manufactured and sold by Hodogaya Chemical Industries); a quaternary ammonium salt Copy Charge PSY VP2038, a triphenylmethane derivative Copy Blue PR and quaternary ammonium salts Copy Charge NEG VP2036 and Copy Charge NX VP434 (which are manufactured and sold by Hoechst AG); a quaternary ammonium salt LRA-901 and a boron complex LR-147 (which are manufactured and sold by Japan Carlit Co., Ltd.); a copper phthalocyanin; a perylene dye; a qunacridon dye; an azo pigment; and a polymer having a functional group, such as a sulfon group, a carboxyl group and a quaternary ammonium group.

The charge controling agent may be dissolved or dispersed in the toner composition as the charge controling agent which is melt-kneeded with a master batch, may be dissolved or dispersed in the organic solvent together with other components of the toner composition, or may be fixed on the surface of the toner after the toner particles have been produced.

The amount of the charge controlling agent varies depending on the type of the toner binder resin, the presence of an additive or the dispersing method and cannot be sweepingly specified; however, the amount is preferably 0.1 part by mass to 10 parts by mass, more preferably 0.2 part by mass to 5 parts by mass, relative to 100 parts by mass of the mass of the toner binder resin. When the amount is less than 0.1 part by mass, the charge properties of the toner is unsatisfactory sometimes. On the other hand, when the amount is more than 10 parts by mass, the charge properties of the toner is too large, so that the fluidity of the developing agent or the image density is lowered sometimes.

The magnetic material is not restricted and may be properly selected from conventional magnetic materials depending on the application. Examples of the magnetic material include an iron powder, a magnetite and a ferrite. Among them, from the viewpoint of the color tone, a white magnetic material is preferred.

The form and size of the toner according to the present invention is not restricted and may be properly selected depending on the application. However, the toner has preferably the following average circularity, volume average particle diameter, ratio between the volume average particle diameter and the number average particle diameter (volume average particle diameter/number average particle diameter) and thermal properties.

The average circularity is a value calculated by dividing a perimeter of a corresponding circle having the same projected area as that of the toner form by a perimeter of an actual toner particle and is preferably 0.940 to 0.960, more preferably 0.945 to 0.955. The toner comprises preferably 10% or less of particles having an average circularity of less than 0.940.

When the average circularity is less than 0.940, satisfactory transferring properties and a high quality image having no dust cannot be obtaine sometimes. On the other hand, when the average circularity is more than 0.960, with respect to the image forming apparatus equipped with a cleaning blade, a cleaning failure on the photoconductive body or tranfering belt is caused, so that a dirt on the image is caused, for example in the case of the forming of an image having a high image-area ratio, such as a photography image, the base dirt of the image due to an accumulated residual toner on the photoconductive body after the transferring is caused sometimes, when an image is not transferred due to a paper feeding failure; or an electrifying roller for contacting-electrifying the photoconductive body is contaminated and the electrifying roller cannot perform the original electrifying capability.

The average circularity can be measured, for example according to a method of the optical detection zone in which a suspension of the toner particles is caused to pass through the detection zone for photographying and the particle image of the toner is detected and analyzed optically by the CCD camera, wherein as an analyzer, for example the flow particles image analyzing apparatus FPIA-2100 (manufactured and sold by Sysmex Corporation) is used.

The volume average particle diameter of the toner is preferably 4 μ/m to 8 μm.

When the volume average particle diameter is less than 4 μm, either in the case of using a two-components developing agent, the toner is fusion-bonded on the surface of the photoconductive body during a long-period stirring in the developing apparatus and the electrifying capability of the photoconductive body is lowered, or in the case of using an one-component developing agent, the filming of the toner on the developing roller or the fusion-bonding of the toner on a member, such as the blade for laminating the toner is easily caused. On the other hand, when the volume average particle diameter is more than 8 μm, an image having a high resolution and a high quality can be difficultly obtained.

With respect to the toner, the ratio (volume average particle diameter/number average particle diameter) of the volume average particle diameter and number average particle diameter is preferably 1.25 or less, more preferably 1.10 to 1.25. When the ratio is more than 1.25, an image having a high resolution and a high quality can be difficultly obtained and when the toner inflow/outflow is performed (the balance between the consumed toner and the supplimented toner is taken), the particle diamer of the toner fluctuates largely. On the other hand, when the ratio is less than 1.10, while such a ratio is preferred from the viewpoint of the stabilization of the toner behavior and the uniformization of the charge of the toner, either the toner cannot be satisfactorily electrified sametimes or the cleaning properties of the toner is impaired sometimes.

The volume average particle diameter and the ratio [volume average particle diameter/number average particle diameter] can be measuered using, for example a particle size measuring apparatus (manufactured and sold by Colter Electronics.; trade name: Colter Counter TAII).

The above-noted thermal properties are referred to as "flow tester properties" and evaluated for example as the softening temperature (Ts), the flow beginning temperature (Tfb) and the softening point according to the ½ method ($T_{1/2}$).

These thermal properties can be measured according to a properly selected meathod and can be obtained from the flow curve measured using the flow tester CFT 500 (manufactured and sold by Shimadzu Corporation).

The softening temperature (Ts) is not restricted and may be properly selected depending on the application. The softening temperature (Ts) is preferably 50° C. or more, more preferably 60° C. to 100° C. When the softening temperature (Ts) is less than 50° C., the heat resisting storage properties of the toner is impaired sometimes.

The flow beginning temperature (Tfb) is not restricted and may be properly selected depending on the application. The flow beginning temperature (Tfb) is preferably 60° C. or more, more preferably 70° C. to 150° C. When the flow beginning temperature (Tfb) is less than 60° C., the offset properties of the toner is impaired sometimes.

The softening point according to the ½ method ($T_{1/2}$) is not restricted and may be properly selected depending on the application. The softening point according to the ½ method ($T_{1/2}$) is preferably 70° C. or more, more preferably 90° C. to 170° C. When the softening point according to the ½ method ($T_{1/2}$) is less than 70° C., the offset properties of the toner is impaired sometimes.

The color of the toner is not restricted and may be properly selected depending on the application. Examples of the toner include a black toner, cyan toner, magenta toner and yellow toner and each of these toners can be obtained by selecting properly the type of the above-noted colorant.

According to the image forming process in which the above-noted toner is applied to the photoconductive body according to the present invention, even in a high temperature-high humidity atmosphere, the water absorption of the toner is small and the cause of an image blur and image failure in the form of a stripe or a dot (black dot) can be prevented, so that an image having high durability and a high quality can be obtained. The toner according to the present invention can be used preferably in various application fields, more preferably in the image forming according to the electrophotogarphy method, most preferably in the following container holding the toner, developing agent, process cartridge, image forming apparatus and image forming process according to the present invention.

The toner according to the present invention can be produced according to a conventional method, preferably according to the below-described manufacturing method of the toner according to the present invention.

(Manufacturing Method of Toner)

The manufacturing method of the toner toner according to the present invention comprises producing an adhesive base material and optionally othersteps selected properly.

Production of Adhesive Base Material

The production of an adhesive base material is producing the toner by producing an adhesive base material by dispersing and reacting the compound having an active hydrogen group and the polymer which is reactive with the compound having an active hydrogen group in an aqueous medium.

The production of an adhesive base material comprises preparing an aqueous medium phase, preparing an organic solvent phase, emulsifying or dispersing and other steps (synthesizing the compound having an active hydrogen group and the polymer which is reactive with the compound having an active hydrogen group).

The preparing of the aqueous medium phase can be performed, for example by dispersing the resin fine particles in an aqueous medium. The amount of the resin fine particles in the aqueous medium is not restricted and may be properly selected depending on the application. The amount of the resin fine particles is preferably 0.5% by mass to 10% by mass, based on the mass of the aqueous medium.

The preparing of the organic solvent phase can be performed by dissolving or dispersing in an organic solvent, materials for the toner, such as the compound having an active hydrogen group, the polymer which is reactive with the compound having an active hydrogen group, the pigment, the mold release agent, the charge controlling agent and the unreactive polyester resin.

Among the above-noted materials for the toner, other components than the polymer which is reactive with the compound having an active hydrogen group (prepolymer) may be mixed with the aqueous medium together with the resin fine particles during the dispersing of the resin fine particles in the preparing of the aqueous medium phase or may be mixed with the aqueous medium together with the organic solvent phase during the mixing of the organic solvent phase with the aqueous medium phase.

The organic solvent is not restricted so long as in the organic solvent, the above-noted materials for the toner can be dissolved or dispersed and may be properly selected depending on the application. As the organic solvent, from the viewpoint of easiness for removing the solvent, an organic solvent having a boiling point of less than 150° C. is preferred. Example sof the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Among them, ethyl acetate, toluene, xylene, benzene, methylene chloride, 1,2-dichloroethane, chloroform and carbon tetrachloride are most preferred. These organic solvent may be used individually or in combination.

The amount of the organic solvent is not restricted and may be properly selected depending on the application. The amount is preferably 40 parts by mass to 300 parts by mass, more preferably 60 parts by mass to 140 parts by mass, still more preferably 80 parts by mass to 120 parts by mass, relative to 100 parts by mass of the mass of the material for the toner.

The emulsifying or the dispersing can be performed by emulsifying or dispersing the above-prepared organic solven phase in the above-prepared aqueous medium phase. During the emulsifying or dispersing, by subjecting the compound having an active hydrogen group and the polymer which is reactive with the compound having an active hydrogen group to an extension or cross-linking rection, the above-noted adhesive base material can be produced.

Examples of the manufacturing method of the adhesive base material (e.g., the urea modified polyester resin) include the following methods:

(1) a method comprising emulsifying or dispersing the organic solvent phase containing the polymer which is reactve with the compound having an active hydrogen group (e.g., the polyester prepolymer having an isocyanate group (A)) and the compound having an active hydrogen group (e.g., the amine (B)) in the aqueous medium phase, thereby forming a dispersion; and producing the adhesive base material by subjecting the polymer which is reactve with the compound having an active hydrogen group and the compound having an active hydrogen group to the extension or cross-linking reaction in the aqueous medium phase, (2) a method comprising emulsifying or dispersing the organic solvent phase in the aqueous medium phase containing the compound having an active hydrogen group, thereby forming a dispersion; and producing the adhesive base material by subjecting the polymer which is reactve with the compound having an active hydrogen group and the compound having an active hydrogen group to the extension or cross-linking reaction in the aqueous medium phase and (3) a method comprising mixing the organic solvent phase with the aqueous medium; mixing the resultant mixture with the compound having an active hydrogen group, thereby forming a dispersion; and producing the adhesive base material by subjecting the polymer which is reactve with the compound having an active hydrogen group and the compound having an active hydrogen group to the extension or cross-linking reaction in the aqueous medium phase.

In the method (3), since a modified polyester resin is produced in preference in the surface of the toner which is being produced, a density gradient can be formed in a toner particle.

The condition of the extension or cross-linking reaction to which the polymer which is reactve with the compound having an active hydrogen group and the compound having an active hydrogen group are subjected by the emulsifying or dispersing for producing the adhesive base material is not restricted and may be properly selected depending on the combination of a compound having an active hydrogen group and a compound having an active hydrogen group. The reaction time is preferably 10 minutes to 40 hours, more preferably 2 hours to 24 hours. The reaction temperature is preferably 0° C. to 150° C., more preferably 40° C. to 98° C.

Examples of the method for forming stably the dispersion comprising the polymer which is reactve with the compound having an active hydrogen group (e.g., a polyester prepolymer having an isocyanate group (A)) in the aqueous medium phase include a method comprising mixing the aqueous medium phase with materials for the toner, such as the polymer which is reactve with the compound having an active hydrogen group (e.g., a polyester prepolymer having an isocyanate group (A)) and which is dissolved or dispersed in the organic solvent, the pigment, the mold release agent, the charge controlling agent and the unreactive polyester resin; and dispersing the above-noted materials for the toner in the aqueous medium by applying a shearing force.

The method of the dispersing is not restricted and may be properly selected from conventional metods using a conventional dispersing apparatus. Examples of the conventional dispersing apparatus include a low speed shearing-dispersing apparatus, a high speed shearing-dispersing apparatus, a friction dispersing apparatus, a high pressure jet dispersing apparatus and a ultrasonic dispersing apparatus. Among them, from the viewpoint of a capability of controlling the particle diameter of the dispersion at 2 μm to 20 μm, a high speed shearing-dispersing apparatus is preferred.

When the high speed shearing-dispersing apparatus is used, the conditions of the dispersing, such as a rotation number of the dispersing apparatus, a dispersing time and a dispersing temperature are not restricted and may be properly selected depending on the application. The rotation number of the dispersing apparatus is preferably 1,000 rpm to 30,000 rpm, more preferably 5,000 rpm to 20,000 rpm. The dispersing time is, with respect to a batch system dispersing apparatus, preferably 0.1 minute to 5 minutes. The dispersing temperature is, under presuure, preferably 0° C. to 150° C., more preferably 40° C. to 98° C. The higher the dispersing temperature, the easier the dispersing generally.

The amount of the aqueous medium during the emulsifying or dispersing is preferably 50 parts by mass to 2,000 parts by mass, more preferably 100 parts by mass to 1,000 parts by mass, relative to 100 parts by mass of the mass of the material for the toner.

When the amount is less than 50 parts by mass, the dispersing state of the material for the toner is impaired, so that a toner particle having a specified particle diameter cannot be obtained sometimes. On the other hand, when the amount is more than 2,000 parts by mass, the production cost is elevated sometimes.

It is preferred that for the emulsifying or dispersing, if desired, from the viewpoint of sharpening the form of the particle size distribution and dispersing stably, a dispersant is used.

The dispersant is not restricted and may be properly selected depending on the application. Examples of the dispersant include a surfactant, a dispersant containing a water-slight soluble compound and a polymer protective colloid. These dispersants may be used individually or in combination. Among them, the surfactant is preferred.

Examples of the surfactant include an anionic surfactant, a cationic surfactant, a nonionic surfactant and an ampholytic surfactant.

Examples of the anionic surfactant include an alkylbenzenesulfonate, a α-olefinsulfonate and a phosphoric acid ester. Preferred examples thereof include a surfactant having a fluoroalkyl group. Eaxmples of the surfactant having a fluoroalkyl group include a $C_2$ to $C_{10}$ fluoroalkylcarboxylic acid and a metal salt thereof, a perfluorooctanesulfonylglutamic acid disodium, 3-[ω-fluoroalkyl($C_6$ to $C_{11}$)oxy]-1-alkyl($C_3$ to $C_4$)sulfonic acid sodium, 3-[(ω-fluoroalkanoyl($C_6$ to $C_8$)-N-ethylamino]-1-propane sulfonic acid sodium, a fluoroalkyl ($C_{11}$ to $C_{20}$)carboxylic acid and a metal salt thereof, a perfluoroalkylcarboxylic acid($C_7$ to $C_{13}$) and a metal salt thereof, a perfluoroalkyl($C_4$ to $C_{12}$) sulfonic acid and a metal salt thereof, a perfluorooctanesulfonic amide, a perfluoroalkyl($C_6$ to $C_{10}$)sulfonic amide propyltrimethylammonium salt, a perfluoroalkyl($C_6$ to $C_{10}$)-N-ethylsulfonylglycin salt and a monoperfluoroalkyl($C_6$ to $C_{16}$) etylphosphoric acid ester. Examples of a commercially available surfactant having a fluroalkyl group include Surflon S-111, -112, -113 (manufactured and sold by Asahi Glass Co., Ltd.); Fluorad FC-93, FC-95, FC-98 and FC-129 (manufactured and sold by Sumitomo 3M, Limited); Unidyne DS-101 and 102 (manufactured and sold by Daikin Industries, Ltd.); Megaface F-110, -120, -113, -191, -812 and -833 (manufactured and sold by Dainippon Ink and Chemicals Incorporation); Eftop EF-102, -103, -104, -105, -112, -123A, -123B, -306A, -501, -201 and -204 (manufactured and sold by JEMCO Inc.); and FTERGENT F-100 and -150 (manufactured and sold by NEOS Co., Ltd.).

Examples of the cationic surfactant include an amine salt surfactant and a quaternary ammonium salt cationic surfactant. Examples of the amine salt surfactant include an alkylamine salt, an aminoalcohol aliphatic acid derivative, a polyamine aliphatic acid derivative and an imidazoline. Examples of the quaternary ammonium salt cationic surfactant include an alkyltrimethylammonium salt, a dialkyldimethylammonium salt, an alkyldimethylbenzylammonium salt, a pyridinium salt, an alkylisoquinolinium salt and a benzetonium chloride. Among the cationic surfactants, an aliphatic primary, secondary and tertiary amine having a fluoroalkyl group; an aliphatic quaternary ammonium salt, such as a sulfonamidepropyltrimethylammonium salt; a benzalconium salt; a benzetonium chloride; a pyridinium salt; and an imidazolinium salt are preferred. Examples of the commercially available cationic surfactant include Surflon S-121

(manufactured and sold by Asahi Glass Co., Ltd.); Fluorad FC-135 (manufactured and sold by Sumitomo 3M, Limited); Unidyne DS-202 (manufactured and sold by Daikin Industries, Ltd.); Megaface F-150 and -824 (manufactured and sold by Dainippon Ink and Chemicals Incorporation); Eftop EF-132 (manufactured and sold by JEMCO Inc.); and FTERGENT F-300 (manufactured and sold by NEOS Co., Ltd.).

Examples of the nonionic surfactant include an aliphatic acid amide derivative and a polyalcohol derivative.

Examples of the ampholytic surfactant include alanine, dodecyldi(aminoethyl)glycine, di(octylaminoethyl)glycine and N-alkyl-N,N-dimethylammoniumbetaine.

Examples of the dispersant containing a water-slight soluble inorganic compound include tricalcium phosphate, calcium carbonate, a colloidal silica and a hydroxyl apatite.

Examples of the polymer protective colloid include a (meth)acryl monomer containing an acid or a hydroxyl group, a vinyl alcohol or an ether thereof, an ester of a vinyl alcohol and a compound having a carboxyl group, an amide compound or a methylol compound thereof, a chloride, a homopolymer or copolymer of a compound having a nitrogen atom or a nitrogen-containing heterocyclic group, a polyoxyethylene and a cellulose.

Examples of the above-noted acid include acrylic acid, methavrylic acid, α-cyanoacrylic acid, α-cyanomethacrylic acid, itaconic acid, crotonic acid, fumaric acid, maleic acid and maleic acid anhydride. Examples of the (meth)acryl monomer having a hydroxyl group include β-hydroxyethyl acrylate, β-hydroxyethyl acrylate, β-hydroxypropyl methacrylate, γ-hydroxypropyl acrylate, γ-hydroxypropyl methacrylate, 3-chloro-2-hydroxypropyl acrylate, 3-chloro -2-hydroxypropyl methacrylate, diethylene glycol monoacrylate ester, diethylene glycol monomethacrylate ester, glycerine monoacrylate ester, glycerine monomethacrylate ester, N-methylolacrylamide and N-methylolmethacrylamide. Examples of the vinyl alcohol or the ether thereof include vinyl methyl ether, vinyl ethyl ether and vinyl propyl ether. Examples of the ester of a vinyl alcohol and a compound having a carboxyl group include vinyl acetate, vinyl propionate and vinyl butylate. Eaxmples of the amide compound or the methylol compound thereof include acrylic amide, methacrylic amide, diacetoneacrylicamide acid and the methylol compound thereof. Examples of the chloride include acrylic acid chloride and methacrylic acid chloride. Examples of the homopolymer or copolymer of a compound having a nitrogen atom or a nitrogen-containing heterocyclic group include vinylpyridine, vinylpyrolidone, vinylimidazole and ethyleneimine. Examples of the polyoxyethylene include a polyoxyethylene, a polyoxypropylene, a polyoxyethylenealkylamine, a polyoxypropylenealkylamine, a polyoxyethylene alkylamide, a polyoxypropylenealkylamide, a polyoxyethylenenonylphenylether, a polyoxyethylenelaurylphenylether, a polyoxyethylenestearylphenylester and a polyoxyethylenenonylphenylester. Examples of the cellulose include a methyl cellulose, a hydroxylethyl cellulose and hydroxypropyl cellulose.

For the emulsifying or dispersing, optionally a dispersion stabilizing agent may be used.

Examples of the dispersion stabilizing agent include a calcium phosphate which is soluble in both ana cid and an alkali.

When a calcium phosphate as the dispersion stabilizing agent is used, a calcium phosphate can be removed from the fine particles of the resin according to a method comprising dissolving a calcium phosphate with an acid, such as a hydrochloric acid and washing the fine particles by water; or a method in which a calcium phosphate is decomposed by an enzyme.

For the emulsifying or dispersing, a catalyst for the extension or cross-linking rection can be used. Examples of the catalyst include dibutyl tin laurate and dioctyl tin laurate.

By mixing the thus obtained toner particles with particles of the mold release agent or the charge controlling agent or further by applying a mechanical impact force to the toner particles, the elimination of particles of the mold release agent from the surface of the toner particles can be prevented.

Examples of the method for applying a mechanical impact force to the toner particles include a method in which a mechanical impact force produced by a propeller rotating in a high speed is applied to the mixture of the toner particles and particles of the mold release agent or charge controlling agent and a method in which the mixture is introduced into a high-speed stream of air and particles are crashed into each other or compounded particles are crashed into a proper crashing plate. Examples of the apparatus used for applying a mechanical impact force to the toner particles include Ongmill (manufactured and sold by Hosokawa Micron Co., Ltd.), an apparatus produced by converting the I-mill (manufactured and sold by Nippon Pneumatic Mfg. Co., Ltd.) with lowering the griding air pressure, a hybridization system (manufactured and sold by Nara Machinery Co., Ltd.), a Cryptron system (Kawasaki Heavy Industries, Ltd.) and an automatic mortar.

Hereinbelow, a preferred specific example of the manufacturing method of the toner according to the present invention is shown.

—Production of Adhesive Base Material—

—Preparing of Aqueous Medium Phase—

Into a reactor equipped with a stirring rod and a thermometer, water, a sodium salt of a sulfuric acid ester of a methacrylic acid ethyleneoxide adduct, stylene, methacrylic acid and ammonium persulfate are fed and the content of the reactor is stirred at 400 rpm for 15 minutes, therby obtaining a white emulsion. The emulsion is heated and the temperature of the inside of the reactor is elevated to 75° C., followed by reacting the content of the reactor for 5 hours, thereby obtaining a reaction mixture. Further, the obtained reaction mixture is mixed with a 1% by mass aqueous solution of ammonium persulfate and the resultant mixture is reacted at 75° C. for 5 hours, therby preparing an aqueous dispersion (hereinbelow, referred to as "fine particles dispersion") of a vinyl resin (styrene-metacrylic acid-sodium salt of sulfuric acid ester of a methacrylic acid ethylene oxide adduct copolymer). Thereafter, water, the above-prepared fine particles dispersion, a 48.5% by mass aqueous solution of sodium dodecyldiphenylethersulfonate and ethyl acetate are mixed and stirred, thereby preparing an opaque liquid (hereinbelow, referred to as "aqueous phase").

—Synthesis of Prepolymer (Polymer which is Reactive with Active Hydrogen Group)—

Into a reactor equipped with a cooling coil, a stirrer and a nitrogen introducing pipe, a 2 mole ethyleneoxide adduct of bisphenol A, a 3 mole propyleneoxide adduct of bisphenol A, terephthalic acid, adipic acid and dibutyl tin oxide are fed and the content of the reactor is reacted at 230° C. under atmospheric pressure for 8 hours, therby obtaining a reaction mixture. Further, the obtained reaction mixture is reacted under a reduced pressure of 10 mmHg to 15 mmHg for 5 hours and into the reactor, trimellitic acid anhydride is fed, followed by reacting the content of the reactor at 180° C. under atmospheric pressure for 2 hours, thereby synthesizing a low molecular weight polyester.

Thereafter, into a reactor equipped with a cooling coil, a stirrer and a nitrogen introducing pipe, the above-synthesized low molecular weight polyester, isophoron diisocyanate and ethyl acetate are fed and the content of the reactor is reacted at 100° C. for 5 hours, therby synthesizing a prepolymer (polymer which is reactive with an active hydrogen group).

Synthesis of Ketimine (Compound Having Active Hydrogen Group)

Into a reactor equipped with a stirring rod and a thermometer, isophoron and methyl ethyl ketone are fed and the content of the reactor is reacted at 50° C. for 5 hours, thereby synthesizing a ketimine compound (compound having active hydrogen group).

—Preparing of Organic Solvent Phase—

Into a reactor equipped with a stirring rod and a thermometer, a low molecular weight polyester, a synthesized ester wax (pentaerithritolbehenate) and ethyl aceytate are fed and while stirring the content of the reactor, the temperature of the content is elevated to 80° C., maintained at 80° C. for 5 hours and lowered to 30° C. during one hour. Next, into the reactor, ethyl acetate is fed and the content of the reactor is stirred for one hour, therby obtaining a solution of the material for the toner.

The obtained solution of the raw material for the toner is transferred to another reactor and using a beads mill (manufactured and sold by Imex Co., Ltd.; trade name: Ultra visco mill), the dispersing of the wax is performed under the conditions of the liquid feeding rate of 1 kg/hr, the circumferential speed of the disc of 6 m/sec, the filled beads of 80% by volume zirconia beads having a diameter of 0.5 mm and the liquid feeding of 3 times-pass. Next, with the resultant dispersion, 65% by mass ethyl acetate solution of the low molecular weight polyester is mixed and the resultant mixture is subjected to the dispersing using the above-noted beads mill under the condition of the liquid feeding of 1 time-pass, thereby preparing the organic solvent phase.

—Emulsifying or Dispersing—

The above-prepared organic solvent phase, the above-noted prepolymer (low molecular weight polyester) and the above-noted ketimine compound are fed into a reactor and using TK homomixer (manufactured and sold by Tokushu Kika Kogyo Co., Ltd.), the content of the reactor is mixed under the condition of the rotation number of 5,000 rpm for 1 minute. Into the reactor, the above-prepared aqueous phase is fed and using TK homomixer, the content of the reactor is mixed under the condition of 13,000 rpm for 20 minute, so that the content is subjected to the emulsifying or dispersing, thereby preparing an emulsion slurry. Next, into a reactor equipped with a stirring rod and a thermometer, the above-prepared emulsion slurry is fed and the emulsion is subjected to the distilling-off of the solvent at 30° C. for 8 hours, followed by leaving the emulsion slurry at rest at 50° C. for 6 hours.

After the above-left emulsion slurry is filtered under reduced pressure, the resultant filter cake is mixed with an ion-exchanged water and the resultant mixture is mixed using the TK homomixer under the condition of the rotation number of 12, 000 rpm for 10 minutes, followed by filtering the mixture and obtaining a filter cake. The obtained filter cake is mixed with 10% by mass aqueous solution of sodium hydroxide and the mixture is subjected to an alkali-washing comprising applying an ultrasonic vibration to the resultant mixture and mixing the mixture using the TK homomixer under the condition of the rotation number of 12, 000 rpm for 30 minutes, followed by filtering the mixture under reduced pressure. The above-noted alkali-washing is repeated one more time (two times of the alkali-washing). The resultant filter cake is mixed with 10% by mass aqueous solution of hydrochloric acid and the resultant mixture is mixed using the TK homomixer under the condition of the rotation number of 12, 000 rpm for 10 minutes, followed by filtering the mixture. The resultant filter cake is mixed with an ion-exchanged water and the resultant mixture is mixed using the TK homomixer under the condition of the rotation number of 12, 000 rpm for 10 minutes, followed by filtering the mixture two times, thereby obtaining a filter cake. The obtained filter cake is dried using an air-circulation dryer at 45° C. for 48 hours and the cake is sifted using a mesh having an aperture of 75 μm, thereby obtaining the toner particles.

The obtained toner particles are mixed with a hydrophobic silica and hydrophobic titanium oxide using a henschel mixer, thereby producing the toner. According to the above-noted manufacturing method of the toner, the toner can be effectively produced.

(Developing Agent)

The above-noted developing agent comprises the above-noted toner and other components, such as a carrier. The developing agent may be a developing agent of one component or a developing agent of two components; however when the developing agent is used for a high speed printer corresponding to a recent improvement of the information processing speed, from the viewpoint of improving the life of the developing agent, the developing agent of two components is preferred.

With respect to the developing agent of one component using the toner, when the toner inflow/out flow is performed, the fluctuation of the toner particle diameter is small and the filming of the toner to a developing roller and the fusion-bonding of the toner to a member, such as a blade for laminating the toner are not caused, so that during a long-term service of the developing apparatus (friction-stirring of the developing agent), the advantageous stable developing properties and image of the developing agent can be obtained. Further, with respect to the developing agent of two components, even when the toner inflow/out flow is performed for a long term, the fluctuation of the toner particle diameter in the developing agent is small, so that by a long-term friction-stirring of the developing agent in the developing apparatus, the advantageous stable developing properties can be obtained.

The above-noted carrier is not restricted and may be properly selected depending on the application. As the carrier, a carrier comprising a core and a resin layer coating the core is preferred.

The matrial for the core is not restricted and may be properly selected from conventional materials for the core depending on the application. Preferred examples of the material include a manganese-strontium (Mn—Sr) material and manganese-magnesium (Mn—Mg) material having an electromagmetic unit of 50 emu/g to 90 emu/g; and from the viewpoint of ensuring the image density, a high-magnetized material, such as an iron powder (100 emu/g or more) and a magnetite (75 emu/g to 120 emu/g) is preferred. Further, from the viewpoint of an advantage for enhancing the image quality by weakening the collision of the carrier with the photoconductive body on which the toner is retained in the form of a row of standing ears of the rice plant, a low-magnetized material, such as a copper-zinc material magnetite (30 emu/g to 80 emu/g) is preferred. These materials may be used individually or in combination.

The partice diameter of the core is preferably 20 μm to 200 μm, more preferably 40 μm to 100 μm, in trems of the average particle diameter (volume average particle diameter ($D_{50}$)).

When the average particle diameter (volume average particle diameter ($D_{50}$)) is less than 20 μm, in the distribution of the carrier particle diameter, an amount of fine particles becomes large and the magnetization per one particle is lowered, so that the scattering of the toner is caused sometimes. On the other hand, when the average particle diameter is more than 200 μm, the specific surface area of the particles is lowered and the scattering of the toner is caused sometimes, so that particularly with respect to the full-color printing having a large solid image part, the reproducibility of the solid image part is impaired sometimes.

The material for the resin layer is not restricted and may be properly selected from conventional resins depending on the application. Examples of the material include an amino resin; a polyvinyl resin; a polystyrene resin; a halogenated olefin resin; a polyester resin; a polycarbonate resin; a polyethylene resin; a polyvinyl fluoride resin; a polytrifluoroethylene resin; a polyhexafluoropropylene resin; a vinylidene fluoride-acrylic monomer copolymer; a vinylidene fluoride-vinyl fluoride copolymer; a fluoro terpolymer, such as a tetrafluoroethylene-vinylidene fluoride-a vinyl fluoride; and a silicone resin. These resins may be used individually or in combination.

Examples of the above-noted amino resin include an urea-formaldehyd resin, a melamine resin, a benzoguanamine resin, an urea resin, a polyamide resin and an epoxy resin. Examples of the above-noted polyvinyl resin include an acrylic resin, a polymethylmethacrylate resin, a polyacrylonitrile resin, a polyvinylacetate resin; a polyvinylalcohol resin, and a polyvinylbutylal resin. Examples of the above-noted polystyrene resin include a polystyrene resin and a styrene-acrylic monomer copolymer. Examples of the above-noted halogenated olefin resin include a polyvinyl chloride resin. Examples of the above-noted polyester resin include a polyethyleneterephthalate resin and a polybutyleneterephthalate resin.

The above-noted resin layer may optionally comprise conductive particles, such as particles of a metal, a carbon black, titanium oxide, tin oxide or zinc oxide. The average particle diameter of the conductive particles is preferably 1 μm or less. When the average particle diameter is more than 1 μm, the controlling of the electrical resistance of the developing agent becomes difficult sometimes.

The resin layer can be produced, for example according to a method comprising preparing a coating solution by dissolving the above-noted silicone resin in a solvent, coating uniformly the surface of the core with the above-prepared coating liquid according to a conventional coating method, drying the resultant coating and stoving the coating. Examples of the above-noted coating method include a dipp coating, a spray coating and a brushing coating.

The above-noted solvent is not restricted and may be properly selected depending on the application. Examples of the solvent include toluene, xylene, methyl ethyl ketone, methyl isobutyl ketone and cellosolve butyl acetate.

The method for the above-noted stoving is not restricted. Examples of the method include an external heating method and an internal heating method, such as a method using an oven, such as a fixed electric oven, a mobile electric oven, a rotary electric oven and a burner oven; and a method using a microwave.

The amount of the resin layer in the carrier is preferably 0.01% by mass to 5.0% by mass, based on the mass of the carrier.

When the amount is less than 0.01% by mass, on the surface of the core, the uniform resin layer cannot be formed sometimes. On the other hand, when the amount is more than 5.0% by mass, the thickness of the resin layer becomes too large and a granulation of carriers is caused, so that uniform carrier particles cannot be obtained sometimes.

In the case where the developing agent is a two components developing agent, the amount of the carrier in the two components developing agent is not restricted and may be properly selected depending on the application. The amount is preferably 90% by mass to 99% by mass, more preferably 93% by mass to 97% by mass.

Since the above-noted developing agent comprises the above-noted toner, when using the developing agent, the image is formed, while maintaining the condition in which the blade cleaning properties of the developing agent, an image having high minuteness and a high quality can be obtained.

The developing agent according to the present invention can be preferably used in the image forming according to various conventional electrophotography, such as a magneticized one component developing method, a none-magneticized one component developing method and a two components developing method.

(Container holding Toner)

The container holding the toner holds the above-noted toner or developing agent in a container.

The container is not restricted and may be properly selected from conventional containers depending on the application. Preferred examples of the container include a container comprising a container main body holding the toner and a cap.

The size, form, structure and material of the container main body holding the toner are not restricted and may be properly selected depending on the application. The form is preferably a cylindrical form, most preferably a form in which on the inner circle surface, a concave and convex in the form of a spiral is formed and not only by rotating the container main body, the toner as the content of the container main body can move to the outlet, but also a part of the spiral portion or the whole spiral portion has a so-called bellows function.

The material for the container main body holding the toner is not restricted and is preferably a material having high dimensional accuracy. Preferred examples of the material include a resin, such as a polyester resin, a polyethylene resin, a polypropylene resin, a polystyrene resin, a polyvinyl chloride resin, a polyacrylic resin, a polycarbonate resin, a ABS resin and a polyacetal resin.

The container holding the toner is so excellent in handring properties that the storage and conveyance thereof is easy and the container holding the toner can be preferably used for supplementing the toner by attaching to the process cartridge or image forming apparatus in an attachable or detachable manner.

Hereinbelow, explanations are given with respect to Examples of the present invention, which should not be construed as limiting the scope of the present invention. In the following Production Examples, "parts" means "parts by mass". For the measurement of the particle diameter distribution, a particle diameter measuring apparatus (manufactured and sold by Beckman Coulter, Inc.; trade name: Multilyzer II) was used.

PRODUCTION EXAMPLE 1

Preparing of Toner

Preparing of Aqueous Medium Phase (Aqueous Phase)

Into a reactor equipped with a stirring rod and a thermometer, the following raw materials were fed and the content of the reactor was stirred at 400 rpm for 15 minutes, therby obtaining a white emulsion.

| (Raw Materials) | |
|---|---|
| Water | 683 parts |
| Sodium salt of a sulfuric acid ester of a metacrylic acid ethyleneoxide adduct (manufactured and sold by Sanyo Chemical Industries, Ltd.; trade name: Eleminol RS-30) | 11 parts |
| Styrene | 138 parts |
| Metacrylic acid | 138 parts |
| Ammonium persulfate | 1 part |

The obtained emulsion was heated and the temperature of the inside of the reactor was elevated to 75° C., thereby reacting the content of the reactor was reacted for 5 hours. Next, the resultant reaction mixture was mixed with 30 parts by mass of 1% aqueous solution of ammonium persulfate and the reaction mixture was reacted at 75° C. for 5 hours, therby preparing an aqueous dispersion (hereinbelow, referred to as "fine particles dispersion 1") of a vinyl resin (styrene-methacrylic acid-sodium salt of a sulfuric acid ester of a methacrylic acid ethyleneoxide adduct copolymer).

The volume average particle diameter of the above-obtained "fine particles dispersion 1" was measured using a laser-diffraction particle size distribution measuring apparatus (manufactured and sold by Horiba, Ltd.; trade name: LA-920) and found to be 0.14 μm. Further, a portion of the obtained "fine particles dispersion 1" was dried and the resin composition thereof was isolated. The glass transition temperature (Tg) of the resin composition was measured and found to be 152° C.

Thereafter, 990 parts by mass of water, 80 parts by mass of the fine particles dispersion 1, 40 parts by mass of a 48.5% by mass aqueous solution of sodium dodecyldiphenyletherdisulfonate (manufactured and sold by Sanyo Chemical Industries, Ltd.; trade name Eleminol MON-7) and 90 parts by mass of ethyl acetate were mixed, thereby preparing an opaque liquid (hereinbelow, referred to as "aqueous phase 1").

—Synthesis of Low Molecular Weight Polyester 1 —

Into a reactor equipped with a cooling coil, a stirrer and a nitrogen introducing pipe, 220 parts of a 2 mole ethyleneoxide adduct of bisphenol A, 561 parts of a 3 mole propyleneoxide adduct of bisphenol A, 218 parts of terephthalic acid, 48 parts of adipic acid and 2 parts of dibutyl tin oxide were fed and the content of the reactor was reacted at 230° C. under atmospheric pressure for 8 hours, therby obtaining a reaction mixture. Next, the obtained reaction mixture was reacted under a reduced pressure of 10 mmHg to 15 mmHg for 5 hours and into the reactor, 45 parts of trimellitic acid anhydride was fed, followed by reacting the content of the reactor at 180° C. under atmospheric pressure for 2 hours, thereby synthesizing the "low molecular weight polyester 1".

The number average molecular weight (Mn), weight average molecular weight (Mw), glass transition temperature (Tg) and acid value of the above-obtained "low molecular weight polyester 1" were measured and found to be respectively 2,500, 6,700, 43° C. and 25.

—Synthesis of Prepolymer 1 (Polymer which is Reactive with Compound Having Active Hydrogen Group)—

Into a reactor equipped with a cooling coil, a stirrer and a nitrogen introducing pipe, 682 parts of a 2 mole ethyleneoxide adduct of bisphenol A, 81 parts of a 2 mole propyleneoxide adduct of bisphenol A, 283 parts of terephthalic acid, 22 parts of trimellitic acid anhydride and 2 parts of dibutyl tin oxide were fed and the content of the reactor was reacted at 230° C. under atmospheric pressure for 8 hours, therby obtaining a reaction mixture. Next, the obtained reaction mixture was reacted under a reduced pressure of 10 mmHg to 15 mmHg for 5 hours and into the reactor, trimellitic acid anhydride is fed, thereby synthesizing the "intermediate polyester 1".

The number average molecular weight (Mn), weight average molecular weight (Mw), glass transition temperature (Tg), acid value and hydroxyl number of the above-obtained "intermediate polyester 1" were measured and found to be respectively 2,100, 9,500, 55° C., 0.5 and 51.

Further, into a reactor equipped with a cooling coil, a stirrer and a nitrogen introducing pipe, 411 parts of the above-syntheiszed "intermediate polyester 1", 89 parts of isophorone and 500 parts of ethyl acetate were fed and the content of the recator was reacted at 100° C. for 5 hours, thereby synthesized the prepolymer 1.

The content of free isocyanate in the above-synthesized prepolymer 1 was measured and found to be 1.53% by mass, based on the mass of the prepolymer 1.

Synthesis of Ketimine Compound 1 (Compound Having Active Hydrogen Group)

Into a reactor equipped with a stirring rod and a thermometer, 170 parts of isophorone and 75 parts of methyl ethyl ketone were fed and the content of the reactor was reacted at 50° C. fro 5 hours, thereby synthesizing the ketimine compound 1.

The amine value of the above-synthesized ketimine compound 1 was measured and found to be 418.

Synthesis of Master Batch (MB)

40 Parts of a carbon black (manufactured and sold by Cabot Corporation; trade name: Regal 400 R), 60 parts of a binder resin (polyester resin)(manufactured and sold by Sanyo Chemical Industries, Ltd.; trade name: RS-801, having an acid value of 10, a weight average molecular weight (Mw) of 20,000 and Tg of 64° C.) and 30 parts of water were mixed using a henschel mixer, thereby obtaining a mixture in which water was impregnated in a pigment arrregate. The mixture was kneaded using a double roll mill in which the surface temperature of the roll was preset at 13° C. for 45 minutes and the kneaded mixture was ground using a pulverizer (manufactured and sold by Hosokawa Micron Corporatrion) to a particle having a diameter of 1 mm, thereby preparing a master batch 1.

—Preparing of Organic Solvent Phase (Organic Phase)—

Into a reactor equipped with a stirring rod and a thermometer, 378 parts of the "low molecular weight polyester 1", 110 parts of carnauba wax, 22 parts of a metal salicylate complex CCA (manufactured and sold by Orient Chemical Industries; trade name: E-84) and 947 parts of ethyl acetate were fed and while stirring the content of the reactor, the temperature of the content of the reactor was elevated to 80° C., followed by maintaining the temperature at 80° C. for 5 hours and lowering the temperature to 30° C. during one hour. Next, into the reactor, 500 parts of the "master batch 1" and 500 parts of ethyl acetate were fed and the content of the reactor was mixed for one hour, thereby obtaining the "raw material solution 1".

1324 Parts of the obtained "solution of the raw material for the toner 1" is transferred to another reactor and using a beads mill (manufactured and sold by Imex Co., Ltd.; trade name: Ultra visco mill), the dispersing of the carbon black in the "solution of the raw material for the toner 1" and the carnauba wax was performed under the conditions of the liquid feeding rate of 1 kg/hr, the circumferential speed of the disc of 6 m/sec, the filled beads of 80% by volume zirconia beads having a diameter of 0.5 mm and the liquid feeding of 3 times-pass. Next, with the resultant dispersion, 1324 parts of 65% by mass ethyl acetate solution of the "low molecular weight polyester 1" is mixed and the resultant mixture was subjected to the dispersing using the above-noted beads mill under the condition of the liquid feeding of 1 time-pass, thereby preparing the "organic solvent phase 1".

The solid content of the obtained "organic solvent phase 1" was measured and found to be 50% by mass.

Emulsifying or Dispersing

648 Parts of the "organic solvent phase 1", 154 parts of the "prepolymer 1" and 6.6 parts of the "ketimine compound 1" were fed into a reactor and using TK homomixer (manufactured and sold by Tokushu Kika Kogyo Co., Ltd.), the content of the reactor is mixed under the condition of the rotation number of 5,000 rpm for 1 minute. Into the reactor, 1,200 parts of the "aqueous phase 1" was fed and using TK homomixer, the content of the reactor was mixed under the condition of 13,000 rpm for 20 minute, so that the content was subjected to the emulsifying or dispersing, thereby preparing the "emulsion slurry 1".

Next, into a reactor equipped with a stirring rod and a thermometer, the "emulsion slurry 1" was fed and the emulsion was subjected to the distilling-off of the solvent at 30° C. for 8 hours. Thereafter, the "emulsion slurry 1" was reacted at 45° C. for 4 hours.

The volume average particle diameter and number average particle diameter of the "emulsion slurry 1" were measured and found to be respectively 5.95 μm and 5.45 μm.

Washing and Drying

After 100 parts of the above-obtained "emulsion slurry 1" was filtered under reduced pressure, the resultant filter cake was mixed with 100 parts of an ion-exchanged water and the resultant mixture was mixed using the TK homomixer under the condition of the rotation number of 12, 000 rpm for 10 minutes, followed by filtering the mixture and obtaining a filter cake. The obtained filter cake was mixed with 100 parts of 10% by mass aqueous solution of sodium hydroxide and the mixture was subjected to an alkali-washing comprising applying an ultrasonic vibration to the resultant mixture and mixing the mixture using the TK homomixer under the condition of the rotation number of 12, 000 rpm for 30 minutes, followed by filtering the mixture under reduced pressure. The above-noted alkali-washing (hereinbelow, referred to as "ultrasonic alkali washing") is repeated one more time (two times of the alkali-washing). The resultant filter cake was mixed with 100 parts of 10% by mass aqueous solution of hydrochloric acid and the resultant mixture was mixed using the TK homomixer under the condition of the rotation number of 12, 000 rpm for 10 minutes, followed by filtering the mixture. The resultant filter cake was mixed with 300 parts of an ion-exchanged water and the resultant mixture was mixed using the TK homomixer under the condition of the rotation number of 12, 000 rpm for 10 minutes, followed by filtering the mixture two times, thereby obtaining the "filter cake 1". The obtained "filter cake 1" was dried using an air-circulation dryer at 45° C. for 48 hours and the cake was sifted using a mesh having an aperture of 75 μm, thereby obtaining the "toner particles 1".

The volume average particle diameter Dv, number average particle diameter Dn and the ratio Dv/Dn of the obtained "toner 1" of Production Example 1 were measured and found to be respectively 6.03 μm, 5.52 μm and 1.09. Futher, the average circularity of the toner of Production Example 1 was measured according to the following method and found to be 0.955.

<Average Circularity>

The average circularity of the toner of Production Example 1 was measured using the flow particles image analyzing apparatus FPIA-2100 (manufactured and sold by Sysmex Corporation). More specifically, into a receptacle, 100 ml to 150 ml of water containing impurity solid removed therefrom beforehand and 0.1 ml to 0.5 ml of a surfactant (alkylbenzenesulfonate) as a dispersant were fed and in the resultant dispersant solution, 0.1 g to 0.5 g of each of the toners was dispersed. The obtained dispersion was subjected to a dispersing treatment using an ultrasonic dispersing apparatus for 1 minute to 3 minutes, so that the resultant dispersion had a concentration of 3,000 pices/μl to 10,000 pieces/μl and thereafter the form and particle size distribution of the dispersion were measured. From the result of the measurement, the average circularity of the toner was calculated.

PRODUCTION EXAMPLE 2

Production of Toner

The "toner 2" of Production Example 2 was produced in substantially the same manner as in Production Example 1, except that in the "Washing and Drying", the ultrasonic alkali washing was performed one time.

The volume average particle diameter Dv, number average particle diameter Dn and the ratio Dv/Dn of the obtained "toner 2" of Production Example 2 were measured and found to be respectively 6.07 μm, 5.50 μm and 1.10. Futher, the average circularity of the toner of Production Example 2 was measured according to the same method as that in Production Example 1 and found to be 0.950.

PRODUCTION EXAMPLE 3

Production of Toner

The toner was prepared in substantially the same manner as in Production Example 1, except that in the preparing of the organic solvent phase (organic phase), 22 parts of a metal salicylate complex CCA (manufactured and sold by Orient Chemical Industries; trade name: E-84) was not used.

Next, 100 parts by mass of the above-prepared toner was mixed with a metal salicylate complex CCA (manufactured and sold by Orient Chemical Industries; trade name: E-84) and the resultant mixture was subjected to a CCA incorporating treatment using a Q mixer (manufactured and sold by Mitsui Mining Co., Ltd), thereby producing the "toner 3" of Production Example 3.

The volume average particle diameter Dv, number average particle diameter Dn and the ratio Dv/Dn of the obtained "toner 3" of Production Example 3 were measured and found to be respectively 5.80 μm, 5.17 μm and 1.12. Futher, the average circularity of the toner of Production Example 3 was measured according to the same method as that in Production Example 1 and found to be 0.960.

PRODUCTION EXAMPLE 4

Producing of Toner

Synthesis of Low Molecular Weight Polyester 2

Into a reactor equipped with a cooling coil, a stirrer and a nitrogen introducing pipe, 262 parts of a 2 mole ethyleneoxide adduct of bisphenol A, 202 parts of a 2 mole propyleneoxide adduct of bisphenol A, 236 parts of a 3 mole propyleneoxide adduct of bisphenol A, 266 parts of terephthalic acid, 48 parts of adipic acid and 2 parts of dibutyl tin oxide were fed and the content of the reactor was reacted at 230° C. under atmospheric pressure for 8 hours, therby obtaining a reaction mixture. Next, the obtained reaction mixture was reacted under a reduced pressure of 10 mmHg to 15 mmHg for 5 hours and into the reactor, 45 parts of trimellitic acid anhydride was fed, followed by reacting the content of the reactor at 180° C. under atmospheric pressure for 2 hours, thereby synthesizing the "low molecular weight polyester 2".

The number average molecular weight (Mn), weight average molecular weight (Mw), glass transition temperature (Tg) and acid value of the above-obtained "low molecular weight polyester 2" were measured and found to be respectively 2,390, 6,010, 62° C. and 20.7.

Preparing of Organic Solvent Phase 2

Into a reactor equipped with a stirring rod and a thermometer, 378 parts of the above-prepared "low molecular weight polyester 2", 110 parts of carnauba wax, 22 parts of a metal salicylate complex CCA (manufactured and sold by Orient Chemical Industries; trade name: E-84) and 947 parts of ethyl acetate were fed and while stirring the content of the reactor, the temperature of the content of the reactor was elevated to 80° C., followed by maintaining the temperature at 80° C. for 5 hours and lowering the temperature to 30° C. during one hour. Next, into the reactor, 500 parts of the "master batch 1" and 500 parts of ethyl acetate were fed and the content of the reactor was mixed for one hour, thereby obtaining the "raw material solution 2".

1324 Parts of the obtained "solution of the raw material for the toner 2" is transferred to another reactor and using a beads mill (manufactured and sold by Imex Co., Ltd.; trade name: Ultra visco mill), the dispersing of the carbon black in the "solution of the raw material for the toner 2" and the carnauba wax was performed under the conditions of the liquid feeding rate of 1 kg/hr, the circumferential speed of the disc of 6 m/sec, the filled beads of 80% by volume zirconia beads having a diameter of 0.5 mm and the liquid feeding of 3 times-pass. Next, with the resultant dispersion, 1324 parts of 65% by mass ethyl acetate solution of the "low molecular weight polyester 2" is mixed and the resultant mixture was subjected to the dispersing using the above-noted beads mill under the condition of the liquid feeding of 1 time-pass, thereby preparing the "organic solvent phase 2".

The solid content of the obtained "organic solvent phase 2" was measured and found to be 52% by mass.

The "toner 4" of Production Example 4 was produced in substantially the same manner as in Production Example 1, except that "Synthesis of Low Molecular Weight Polyester 1" and "Preparing of Organic Solvent Phase 1" were changed to respectively "Synthesis of Low Molecular Weight Polyester 2" and "Preparing of Organic Solvent Phase 2"; in the "Emulsifying or Dispersing", the "organic solvent phase 1" was changed to the "organic solvent phase 2"; and in the "Washing and Drying", the alkali washing without the ultrasonic was performed two times.

The volume average particle diameter Dv, number average particle diameter Dn and the ratio Dv/Dn of the obtained "toner 4" of Production Example 4 were measured and found to be respectively 6.30 μm, 5.68 μm and 1.11. Futher, the average circularity of the toner of Production Example 4 was measured according to the same method as that in Production Example 1 and found to be 0.940.

PRODUCTION EXAMPLE 5

The "toner 5" of Production Example 5 was produced in substantially the same manner as in Production Example 4, except that in the "Washing and Drying", the alkali washing without the ultrasonic was performed one time.

The volume average particle diameter Dv, number average particle diameter Dn and the ratio Dv/Dn of the obtained "toner 5" of Production Example 5 were measured and found to be respectively 6.42 μm, 5.44 μm and 1.18. Futher, the average circularity of the toner of Production Example 5 was measured according to the same method as that in Production Example 1 and found to be 0.945.

PRODUCTION EXAMPLE 6

Producing of Toner

Synthesis of Low Molecular Weight Polyester 3

Into a reactor equipped with a cooling coil, a stirrer and a nitrogen introducing pipe, 719 parts of a 2 mole propyleneoxide adduct of bisphenol A, 274 parts of terephthalic acid, 48 parts of adipic acid and 2 parts of dibutyl tin oxide were fed and the content of the reactor was reacted at 230° C. under atmospheric pressure for 8 hours, therby obtaining a reaction mixture. Next, the obtained reaction mixture was reacted under a reduced pressure of 10 mmHg to 15 mmHg for 5 hours and into the reactor, 7 parts of trimellitic acid anhydride was fed, followed by reacting the content of the reactor at 180° C. under atmospheric pressure for 2 hours, thereby synthesizing the "low molecular weight polyester 3".

The number average molecular weight (Mn), weight average molecular weight (Mw), glass transition temperature (Tg) and acid value of the above-obtained "low molecular weight polyester 3" were measured and found to be respectively 2,290, 5,750, 65° C. and 4.9.

Preparing of Organic Solvent Phase 3

Into a reactor equipped with a stirring rod and a thermometer, 378 parts of the above-prepared "low molecular weight polyester 3", 110 parts of carnauba wax, 22 parts of a metal salicylate complex CCA (manufactured and sold by Orient Chemical Industries; trade name: E-84) and 947 parts of ethyl acetate were fed and while stirring the content of the reactor, the temperature of the content of the reactor was elevated to 80° C., followed by maintaining the temperature at 80° C. for 5 hours and lowering the temperature to 30° C. during one hour. Next, into the reactor, 500 parts of the "master batch 1" and 500 parts of ethyl acetate were fed and the content of the reactor was mixed for one hour, thereby obtaining the "raw material solution 3".

1324 Parts of the obtained "solution of the raw material for the toner 3" is transferred to another reactor and using a beads mill (manufactured and sold by Imex Co., Ltd.; trade name: Ultra visco mill), the dispersing of the carbon black in the "solution of the raw material for the toner 2" and the carnauba wax was performed under the conditions of the liquid feeding rate of 1 kg/hr, the circumferential speed of the disc of 6 m/sec, the filled beads of 80% by volume zirconia beads having a diameter of 0.5 mm and the liquid feeding of 3 times-pass. Next, with the resultant dispersion, 1324 parts of 65% by mass ethyl acetate solution of the "low molecular weight polyester 3" is mixed and the resultant mixture was subjected to the dispersing using the above-noted beads mill under the condition of the liquid feeding of 1 time-pass, thereby preparing the "organic solvent phase 3".

The solid content of the obtained "organic solvent phase 3" was measured and found to be 49% by mass.

The "toner 6" of Production Example 6 was produced in substantially the same manner as in Production Example 1, except that "Synthesis of Low Molecular Weight Polyester 1" and "Preparing of Organic Solvent Phase 1" were changed to respectively "Synthesis of Low Molecular Weight Polyester 3" and "Preparing of Organic Solvent Phase 3"; in the "Emulsifying or Dispersing", the "organic solvent phase 1" was changed to the "organic solvent phase 3"; and in the "Washing and Drying", the alkali washing without the ultrasonic was performed four times.

The volume average particle diameter Dv, number average particle diameter Dn and the ratio Dv/Dn of the obtained "toner 4" of Production Example 4 were measured and found to be respectively 7.05 μm, 5.64 μm and 1.25. Futher, the average circularity of the toner of Production Example 6 was measured according to the same method as that in Production Example 1 and found to be 0.950.

PRODUCTION EXAMPLE 7

The "toner 7" of Production Example 7 was produced in substantially the same manner as in Production Example 6, except that in the "Washing and Drying", the alkali washing without the ultrasonic was performed two times.

The volume average particle diameter Dv, number average particle diameter Dn and the ratio Dv/Dn of the obtained "toner 7" of Production Example 7 were measured and found to be respectively 7.05 μm, 5.64 μm and 1.25. Futher, the average circularity of the toner of Production Example 7 was measured according to the same method as that in Production Example 1 and found to be 0.955.

PRODUCTION EXAMPLE 8

Producing of Toner

Synthesis of Low Molecular Weight Polyester 4

Into a reactor equipped with a cooling coil, a stirrer and a nitrogen introducing pipe, 121 parts of a 2 mole ethyleneoxide adduct of bisphenol A, 64 parts of a 2 mole propyleneoxide adduct of bisphenol A, 527 parts of a 3 mole propyleneoxide adduct of bisphenol A, 246 parts of terephthalic acid, 48 parts of adipic acid and 2 parts of dibutyl tin oxide were fed and the content of the reactor was reacted at 230° C. under atmospheric pressure for 8 hours, therby obtaining a reaction mixture. Next, the obtained reaction mixture was reacted under a reduced pressure of 10 mmHg to 15 mmHg for 5 hours and into the reactor, 42 parts of trimellitic acid anhydride was fed, followed by reacting the content of the reactor at 180° C. under atmospheric pressure for 2 hours, thereby synthesizing the "low molecular weight polyester 4".

The number average molecular weight (Mn), weight average molecular weight (Mw), glass transition temperature (Tg) and acid value of the above-obtained "low molecular weight polyester 4" were measured and found to be respectively 2,500, 6,190, 48° C. and 25.2.

Preparing of Organic Solvent Phase 4

Into a reactor equipped with a stirring rod and a thermometer, 378 parts of the above-prepared "low molecular weight polyester 4", 110 parts of carnauba wax, 22 parts of a metal salicylate complex CCA (manufactured and sold by Orient Chemical Industries; trade name: E-84) and 947 parts of ethyl acetate were fed and while stirring the content of the reactor, the temperature of the content of the reactor was elevated to 80° C., followed by maintaining the temperature at 80° C. for 5 hours and lowering the temperature to 30° C. during one hour. Next, into the reactor, 500 parts of the "master batch 1" and 500 parts of ethyl acetate were fed and the content of the reactor was mixed for one hour, thereby obtaining the "raw material solution 4".

1324 Parts of the obtained "solution of the raw material for the toner 4" is transferred to another reactor and using a beads mill (manufactured and sold by Imex Co., Ltd.; trade name: Ultra visco mill), the dispersing of the carbon black in the "solution of the raw material for the toner 4" and the carnauba wax was performed under the conditions of the liquid feeding rate of 1 kg/hr, the circumferential speed of the disc of 6 m/sec, the filled beads of 80% by volume zirconia beads having a diameter of 0.5 mm and the liquid feeding of 3 times-pass. Next, with the resultant dispersion, 1324 parts of 65% by mass ethyl acetate solution of the "low molecular weight polyester 4" is mixed and the resultant mixture was subjected to the dispersing using the above-noted beads mill under the condition of the liquid feeding of 1 time-pass, thereby preparing the "organic solvent phase 4".

The solid content of the obtained "organic solvent phase 1" was measured and found to be 49% by mass.

The "toner 8" of Production Example 8 was produced in substantially the same manner as in Production Example 1, except that "Synthesis of Low Molecular Weight Polyester 1" and "Preparing of Organic Solvent Phase 1" were changed to respectively "Synthesis of Low Molecular Weight Polyester 4" and "Preparing of Organic Solvent Phase 4".

The volume average particle diameter Dv, number average particle diameter Dn and the ratio Dv/Dn of the obtained "toner 8" of Production Example 8 were measured and found to be respectively 4.80 μm, 4.00 μm and 1.20. Futher, the average circularity of the toner of Production Example 4 was measured according to the same method as that in Production Example 1 and found to be 0.960.

PRODUCTION EXAMPLE 9

The "toner 9" of Production Example 9 was produced in substantially the same manner as in Production Example 8, except that in the "Washing and Drying", the ultrasonic alkali washing was performed one time.

The volume average particle diameter Dv, number average particle diameter Dn and the ratio Dv/Dn of the obtained "toner 9" of Production Example 9 were measured and found to be respectively 5.11 μm, 4.22 μm and 1.21. Futher, the average circularity of the toner of Production Example 1 was measured according to the same method as that in Production Example 1 and found to be 0.960.

PRODUCTION EXAMPLE 10

Production of Ground Toner 100 parts of a styrene-aclylate resin, 8 parts of a carbon black and 4 parts of a low molecular weight polypropylene resin having a weight average molecular weight of 3,600 were melt-kneaded according to a conventional method, thereby obtaining a toner and the obtained toner was ground and classified, thereby producing the "toner 10" of Production Example 10 which has a volume average particle diameter Dv of 7.2 μm, a number average particle diameter Dn of 4.22 μm and the ratio Dv/Dn of 1.71. Futher, the average circularity of the toner of Production Example 10 was measured according to the same method as that in Production Example 1 and found to be 0.930.

Preparing of Developing Agent

Each of the "toner 1" to "toner 10" of Production Example 1 to Production Example 10 was mixed respectively with a hydrophobic silica having a primary number average particle diameter of 12 nm and continueously with a ferrite carrier having a volume average particle diameter of 45 μm which is coated with a styrene-acrylate resin, thereby preparing "developing agent 1" to "developing agent 10".

PRODUCTION EXAMPLE 11

Production of Electrostatic Latent Imge Carrier

An aluminum pipe having a diameter of 30 mm and a length of 350 mm which has been subjected to a cutting process for preventing the moiré was coated with a 5% by mass methanol solution of a polyamide resin (manufactured and sold by Toray Industries, Inc.; trade name: CM 8,000) accoding to a dip coating, thereby disposing the undercoating layer. Next, 10 parts of oxytitanium phthalocyanine which has a strong peak at the Bragg angle of 9.0°, 14.2°, 23.9° and 27.1° in the CuKa X-ray diffracotmetry, 10 parts of a polyvinylbutylal (manufactured and sold by Sekisui Chemical Co., Ltd.; trade name: S-Lec BM 2) and 60 parts of cyclohexanone were dispersed using a sand mill comprising glass beads having a diameter of 1 mm for 20 hours and the resultant dispersion was mixed with 100 parts of methyl ethyl ketone, thereby obtaining a coating liquid for disporsing the charge generating layer.

With the above-obtained coating liquid, the above-noted undercoating layer was coated and the resultant coating was dried, thereby disposing the charge generating layer having a thickness of 0.12 μm. Next, 10 parts of a compound represented by the following structural formula was dissolved in a mixture of 12 parts of a polycarbonate resin Z having a weight average molecular weight (Mw) of 28,000 and 60 parts of monochlorobenzene, thereby obtaining coating liquid for disposing the charge transportable layer. With the above-obtained coating liquid, the charge generating layer was coated, thereby disposing the charge transportable layer having a thickness of 20 μm.

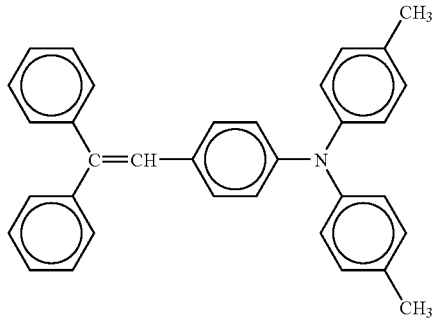

The above-disposed charge transportable layer was coated according to a spray coating, with a coating liquid for disposing the cross-linked charge transportable layer, which comprises 100 parts of trimethylolpropanetriacrylate (manufactured and sold by Nippon Kayaku Co., Ltd.; trade name: KARAYAD TMPTA, having a molecular weight of 296, a functionality of trifunctional and the ratio (molecular weight/functionality) of 99) as a trifunctional or more functional radical-polymerizable monomer having no charge transportable structure, 10 parts of amonofunctional radical-polymerizable monomer having a charge transportable structure (Compound No. 54), 1 part of 1-hydroxy-cyclohexyl-phenyl-ketone (manufactured and sold by Cyba Specialty Chemicals Corporation; trade name: Irgaqure 184) as a photopolymerization initiator and 100 parts of tetrahydrofuran and the resultant coating was dried naturally for 20 minutes, thereby obtaining a coating. Thereafter, to the obtained coating, a light was irradiated using a metal halide lamp under the conditions, such as a irradiating distance of 120 mm, a irradiating strength of 500 mW/cm$^2$ and the irradiating time of 60 sec, thereby curing the coating. Next, the coating was dried at 130° C. for 20 minutes, thereby disposing the cross-linked charge transportable layer having a thickness of 5.0 μm. As noted above, the photoconductive body for the electrophotography of Production Example 11.

PRODUCTION EXAMPLE 12

Production of Electrostatic Latent Imge Carrier

The photoconductive body for the electrophotography of Production Example 12 was produced in substantially the same manner as in Production Example 11, except that the cross-linked charge transportable layer having a thickness of 3.0 μm was disposed.

PRODUCTION EXAMPLE 13

—Production of Electrostatic Latent Imge Carrier—

The photoconductive body for the electrophotography of Production Example 13 was produced in substantially the same manner as in Production Example 11, except that the cross-linked charge transportable layer having a thickness of 2.0 μm was disposed.

PRODUCTION EXAMPLE 14

—Production of Electrostatic Latent Imge Carrier—

The photoconductive body for the electrophotography of Production Example 14 was produced in substantially the same manner as in Production Example 11, except that as a trifunctional or more functional radical-polymerizable monomer having no charge transportable structure, pentaerythritoltetraacrylate (manufactured and sold by Kayaku Sartomer Co. Ltd.; trade name: SR-295, having a molecular weight of 352, a functionality of tetrafunctional and the ratio (molecular weight/functionality of 88)) was used; as amonofunctional radical-polymerizable monomer having a charge transportable structure, Compound No. 138 was used; and the cross-linked charge transportable layer having a thickness of 8.0 μm was disposed.

PRODUCTION EXAMPLE 15

—Production of Electrostatic Latent Imge Carrier—

The photoconductive body for the electrophotography of Production Example 15 was produced in substantially the same manner as in Production Example 14, except that the cross-linked charge transportable layer having a thickness of 5.0 μm was disposed.

PRODUCTION EXAMPLE 16

Production of Electrostatic Latent Imge Carrier

The photoconductive body for the electrophotography of Production Example 16 was produced in substantially the same manner as in Production Example 14, except that the cross-linked charge transportable layer having a thickness of 1.2 μm was disposed.

PRODUCTION EXAMPLE 17

—Production of Electrostatic Latent Imge Carrier—

An aluminum support having a surface roughness Rz (ten-point average roughness) of 1.5 μm, a diameter of 80 mm and a length of 355 mm was coated according to a dip coating, with a coating liquid for disposing the intermediate layer, which comprises 30 parts of a titanium chelate compound (manufactured and sold by Matsumoto Chemical Industry Co. Ltd.; trade name: TC-750), 17 part of a silane coupling agent and 150 parts of 2-propanol which are mixed and dissolved and the resultant coating was dried at 120° C. for one hour, thereby disposing the intermediate layer.

Next, the disposed intermediate layer was coated according to a dip coating, with a coating liquid produced by mixing 60 g of titanylphthalocyanine, 700 g of a 15% by mass silicone resin xylene-butanol solution (manufactured and sold by Shin-Etsu Chemical Co., Ltd.; trade name: KR5240) and 2,000 ml of 2-butanone; and dispersing the resultant mixture using a sand mill for 10 hours, thereby disposing the charge generating layer having a thickness of 0.2 μm.

The disposed charge generating layer was coated according to a dip coating, with a coating liquid for disposing the charge transportable layer, which is produced by mixing 200 g of 4-methoxy-4'-(4-methyl-phenylstyryl)triphenylamine as a charge transportable substance, 300 g of a bisphenol Z polycarbonate (manufactured and sold by Mitsubishi Gas Chemical Company, Inc.; trade name: Iupilon Z 300) and 2,000 ml of 1,2-dichloroethane; and dispersing the resultant mixture, thereby disposing the charge transportable layer having a thickness of 25 μm.

The disposed charge transportable layer was coated with a coating liquid for disposing the resin layer, which is produced by mixing 180 g of trimethoxysilane, 280 ml of 1-butanol and 106 ml of 1% by mass aqueous solution of acetic acid; stirring the resultant mixture; mixing the resultant mixture with 370 ml of 1-butanol; stirring the resultant mixture for 48 hours; and mixing the resultant mixture with 67.5 g of dihydroxymethyltrephenylamine (difunctional compound having a charge transportable structure), 1.7 g of an antioxidant (manufactured and sold by Sankyo Co., Ltd.; trade name: Sanol LS2626) and 4.5 g of dibutyl tin acetate and the resultant coating was cured at 120° C. for one hour, thereby disposing the resin layer having a thickness of 1 μm. As mentioned above, the photoconductive body for the electrophotography of Production Example 17 was produced.

PRODUCTION EXAMPLE 18

—Production of Electrostatic Latent Imge Carrier—

The photoconductive body for the electrophotography of Production Example 18 was produced in substantially the same manner as in Production Example 11, except that the cross-linked charge transportable layer was not disposed, wherein the thickness of the photoconductive layer of the photoconductive body of Production Example 18 was 25 μm. Thus, the photoconductive body for electrophotography of Production Example 18 was produced.

EXAMPLES 1 TO 6 AND COMPARATIVE EXAMPLES 1 TO 6

As shown in Table 3 and 4, each combination of a photoconductive body and a developing agent was installed in the following digital printer and the photoconductive body and developing agent were evaluated with respect to the image printed using each combination of a photoconductive body and a developing agent as follows. The result of the evaluation is shown in Tables 3 and 4.

<Apparatus for Evaluation>

For the evaluation, a digital color printer (manufactured and sold by RICOH Company, Ltd.; trade name: IPSiO 8200 converted; tandem and reversing-developing system) having the process composition shown in FIG. 5 was used. In this printer, the electrifying unit, the exposing unit, the developing unit, the transferring unit and the cleaning unit are are arranged in the near of the photoconductive body. As the developing bias, −850V was applied. The cleaning was performed under the condition where a polyurethane blade having a gum hardness JISA of 70°, an impact regilience of 25, a thickness of 2 mm and a free length of 9 mm was touched to the photoconductive body in the counter direction against the rotating direction of the photoconductive body with a touching angle of 20° and a linear pressure of 20 g/cm.

<Evaluation of Durability>

Using a letter-image data having a printing area ratio of 7% (A4 oblong size), the printing was performed under the condition of a high temperature and a high humidity, such as at 30° C. and in 90% RH in such an intermittent mode that the printing was stopped by every printing of one sheet in an amount of 100,000 sheets. By every printing of 10,000 sheets, the printer was caused to stand to rest for 12 hours.

<Evaluation of Image Quality>

As the evaluation of the image quality, at the time when the printing in an amout of 10,000 was completed and at the time when the time of 12 hours for standing-to-rest of the printer has passed by, the background optical density and a solid black image were output by the printer and the maximum density and the presence of the fog or image deletion were evaluated. As the evaluation of the cleaning properties, the presence of the image failure (a stripe, white dot or black dot having a diameter of 0.3 mm or more) and the presence of the deposit and pinhole on the surface of the photoconductive body were evaluated. The image deletion is caused frequently due to a thin deposit of foreign matters (filming) on the surface of the photoconductive body and when the image deletion is caused, the image deletion cannot be recovered frequently. Since the image blur (which is sometimes caused at a part directly under the electrifying unit, after the standing-to-rest time of the printer of 12 hours) which can be recovered in a short period becomes frequently unassuming after the printing in an amount of 100 sheets, a slight image blur which can be recovered was evaluated as no problem.

The image density was measured at five points in a solid black image using a reflection density meter (manufactured and sold by Gretag Macbeth AG; trade name: RD-918) in terms of the absolute reflection density and indicated as an average value of the above-measured five values. The fog density was measured by subjecting a solid white image to a reflection density meter (manufactured and sold by Gretag Macbeth AG; trade name: RD-918) in terms of the relative reflection density which was converted from the maximum density among measured reflection densities which were measured at 10 points in a solid white image, relative to "0" of the reflection density of the paper.

<Measuring of Wear Degree>

In the above-noted evaluation of the durability, the difference between an initial thickness of the photoconductive body and a thickness of the photoconductive body after the printing in an amount of 100,000 sheets and the difference was evaluated as the wearing degree. The wearing degree was indicated as the average value of the measured values which were measured at 10 points in the lengthwise direction of the photoconductive body.

TABLE 3

| | | | Image Density | | | Fog Density | | |
|---|---|---|---|---|---|---|---|---|
| | Photoconductive Body | Developing Agent | Initial | After Printing of 50,000 sheets | After Printing of 100,000 sheets | Initial | After Printing of 50,000 sheets | After Printing of 100,000 sheets |
| Ex. 1 | Production Example 11 | Production Example 1 | 1.41 | 1.45 | 1.41 | 0.001 | 0.003 | 0.003 |
| Ex. 2 | Production Example 12 | Production Example 2 | 1.38 | 1.4 | 1.41 | 0.001 | 0.001 | 0.002 |
| Ex. 3 | Production Example 13 | Production Example 3 | 1.36 | 1.38 | 1.38 | 0.001 | 0.001 | 0.001 |
| Comp. Ex. 1 | Production Example 11 | Production Example 10 (ground toner) | 1.39 | 1.35 | 1.33 | 0.001 | 0.01 | 0.05 |
| Ex. 4 | Production Example 14 | Production Example 4 | 1.44 | 1.46 | 1.43 | 0.001 | 0.003 | 0.003 |
| Ex. 5 | Production Example 15 | Production Example 5 | 1.48 | 1.45 | 1.43 | 0.001 | 0.001 | 0.002 |
| Ex. 6 | Production Example 16 | Production Example 6 | 1.38 | 1.32 | 1.33 | 0.001 | 0.001 | 0.001 |
| Comp. Ex. 2 | Production Example 14 | Production Example 10 (ground toner) | 1.39 | 1.37 | 1.37 | 0.001 | 0.05 | 0.05 |
| Comp. Ex. 3 | Production Example 17 | Production Example 7 | 1.41 | 1.38 | 1.39 | 0.001 | 0.003 | 0.014 |
| Comp. Ex. 4 | Production Example 17 | Production Example 8 | 1.38 | 1.36 | 1.36 | 0.001 | 0.001 | 0.014 |
| Comp. Ex. 5 | Production Example 17 | Production Example 9 | 1.41 | 1.26 | 1.2 | 0.001 | 0.012 | 0.021 |
| Comp. Ex. 6 | Production Example 18 (without protective layer) | Production Example 10 (ground toner) | 1.31 | 1.26 | 1.29 | 0.032 | 0.18 | 0.25 |

TABLE 4

| | | | Image Failure, Surface of Photoconductive Body, Deposit | | | Wear Degree |
|---|---|---|---|---|---|---|
| | Photoconductive Body | Developing Agent | After Printing of 50,000 sheets | After Printing of 100,000 sheets | Image Deletion (*1) | after 100,000 sheets (μm) |
| Ex. 1 | Production Example 11 | Production Example 1 | No Problem | No Problem | No Problem untill 100,000 sheets | 0.9 |
| Ex. 2 | Production Example 12 | Production Example 2 | No Problem | No Problem | No Problem untill 100,000 sheets | 0.8 |
| Ex. 3 | Production Example 13 | Production Example 3 | No Problem | No Problem | No Problem untill 100,000 sheets | 0.8 |
| Comp. Ex. 1 | Production Example 11 | Production Example 10 (ground toner) | a small amount of fine deposit on photocoductive body | a large amount of fine deposit on photocoductive body | caused at printing of 70,000 sheets and not recovered | 1.1 |
| Ex. 4 | Production Example 14 | Production Example 4 | No Problem | No Problem | No Problem untill 100,000 sheets | 0.8 |
| Ex. 5 | Production Example 15 | Production Example 5 | No Problem | No Problem | No Problem untill 100,000 sheets | 0.8 |
| Ex. 6 | Production Example 16 | Production Example 6 | No Problem | No Problem | No Problem untill 100,000 sheets | 0.8 |
| Comp. Ex. 2 | Production Example 14 | Production Example 10 (ground toner) | a small amount of fine deposit on photocoductive body | a large amount of fine deposit on photocoductive body | caused at printing of 70,000 sheets and not recovered | 1.3 |
| Comp. Ex. 3 | Production Example 17 | Production Example 7 | No Problem | a large amount of black dot in image and pinhole on photocoductive body | caused at printing of 50,000 sheets and not recovered | 0.3 |
| Comp. Ex. 4 | Production Example 17 | Production Example 8 | No Problem | a large amount of black dot in image and deposit on photocoductive body | caused at printing of 60,000 sheets and not recovered | 0.3 |
| Comp. Ex. 5 | Production Example 17 | Production Example 9 | fine deposit on photocoductive body | a large amount of fine deposit and pinhole on photocoductive body | caused at printing of 20,000 sheets and not recovered | 0.2 |

TABLE 4-continued

| | Photoconductive Body | Developing Agent | Image Failure, Surface of Photoconductive Body, Deposit: After Printing of 50,000 sheets | Image Failure, Surface of Photoconductive Body, Deposit: After Printing of 100,000 sheets | Image Deletion (*1) | Wear Degree after 100,000 sheets (μm) |
|---|---|---|---|---|---|---|
| Comp. Ex. 6 | Production Example 18 (without protective layer) | Production Example 10 (ground toner) | fine deposit on photoconductive body | (*2) | (*2) | (*2) |

(*1) A caused image-deletion which can be recovered within the printing of 100 sheets was evaluated as "no problem".
(*2) Since the wear degree was too large and an injury was caused on the photoconductive body, the evaluation was stopped.

As the result of evaluation shown in Tables 3 and 4, it is confirmed that in the output examination of 100,000 sheets using the photoconductive body and developing agent according to the present invention, even under the condition of high temperature-high humidity, the image quality, such as the image density or the fog density is advantageous and the image blur and the image failure due to the cleaning failure (deposit in the form of a stripe or dot) are remarkably improved, so that an excellent image can be obtained. It is also confirmed that even in the long termed durability examination, an excellent photoconductive body in which substantially no pinhole is caused on the photoconductive body can be obtained.

Accoding to the present invention, by using the combination of a photoconductive body for the electrophotography comprising a photoconductive layer which comprises a trifunctional or more radical polymerizable compound having no charge transportable structure and a monofunctional radical polymerizable compound having a charge transportable structure and has an extremely small wear degree; and a toner which is produced in the form of particles by producing an adhesive base material by reacting a compound having an active hydrogen group with a polymer which is reactive with the compound having an active hydrogen group in an aqueous medium, an image forming process and apparatus by which even under the condition of high temperature and high humidity, the causing of the image blur and image failure in the form of a stripe or dot can be prevented can be provided. Also, an image forming process and apparatus which are used for forming an image maintaining high durability, high minuteness and high image quality for a long period; and in which a hinhole is not caused on the photoconductive body during the long-termed repeated image forming under the condition of high temperature and high humidity,

What is claimed is:

1. An image forming process comprising:

forming an electrostatic latent image on an electrostatic latent image carrier, developing the electrostatic latent image using a toner, thereby forming a visible image, transferring the visible image to a recording medium, and cleaning the electrostatic latent image carrier using a cleaning unit, wherein the electrostatic latent image carrier comprises:

a support, and a photoconductive layer which comprises a charge generating layer, a charge transportable layer, and a cross-linked charge transportable layer which are disposed on the support in this order and the cross-linked charge transportable layer comprises a compound produced by the reaction between a trifunctional or more functional radical-polymerizable compound having no charge transportable structure, and a monofunctional radical-polymerizable compound having a charge transportable structure, and the toner is produced in the form of particles by producing an adhesive base material through reacting a compound having an active hydrogen group with a polymer which can be reacted with the compound having an active hydrogen group in an aqueous medium.

2. The image forming process according to claim 1, wherein the cross-linked charge transportable layer has a thickness of 1 μm to 10 μm.

3. The image forming process according to claim 1, wherein the cross-linked charge transportable layer has a thickness of 2 μm to 8 μm.

4. The image forming process according to claim 1, wherein the radical-polymerizable functional group of the trifunctional or more functional radical-polymerizable compound and monofunctional radical-polymerizable compound is at least one of an acryloyloxy group and a methacryloyloxy group.

5. A process cartridge comprising:

an electrostatic latent image carrier, and a developing unit configured to form a visible image by developing an electrostatic latent image formed on the electrostatic latent image carrier using a toner, wherein the electrostatic latent image carrier comprises:

a support, and a photoconductive layer which comprises a charge generating layer, a charge transportable layer, and a cross-linked charge transportable layer which are disposed on the support in this order and the cross-linked charge transportable layer comprises a compound produced by the reaction between a trifunctional or more functional radical-polymerizable compound having no charge transportable structure, and a monofunctional radical-polymerizable compound having a charge transportable structure, and the toner is produced in the form of particles by producing an adhesive base material through reacting a compound having an active hydrogen group with a polymer which can be reacted with the compound having an active hydrogen group in an aqueous medium.

6. The process cartridge according to claim 5, wherein the cross-linked charge transportable layer has a thickness of 1 μm to 10 μm.

7. The process cartridge according to claim 5, wherein the cross-linked charge transportable layer has a thickness of 2 μm to 8 μm.

8. The process cartridge according to claim 5, wherein the radical-polymerizable functional group of the trifunctional or more functional radical-polymerizable compound and monofunctional radical-polymerizable compound is at least one of an acryloyloxy group and a methacryloyloxy group.

9. An image forming apparatus comprising:

an electrostatic latent image carrier, an electrostatic latent image forming unit configured to form an electrostatic latent image on the electrostatic latent image carrier, a developing unit configured to form a visible image by developing the electrostatic latent image using a toner, a transferring unit configured to transfer the visible image to a recording medium, and a cleaning unit cleaning the electrostatic latent image carrier, wherein the electrostatic latent image carrier comprises:

a support, and a photoconductive layer which comprises a charge generating layer, a charge transportable layer, and a cross-linked charge transportable layer which are disposed on the support in this order and the cross-linked charge transportable layer comprises a compound produced by the reaction between a trifunctional or more functional radical-polymerizable compound having no charge transportable structure, and a monofunctional radical-polymerizable compound having a charge transportable structure, and the toner is produced in the form of particles by producing an adhesive base material through reacting a compound having an active hydrogen group with a polymer which can be reacted with the compound having an active hydrogen group in an aqueous medium.

10. The image forming apparatus according to claim 9, wherein the cross-linked charge transportable layer has a thickness of 1 μm to 10 μm.

11. The image forming apparatus according to claim 9, wherein the cross-linked charge transportable layer has a thickness of 2 μm to 8 μm.

12. The image forming apparatus according to claim 9, wherein the radical-polymerizable functional group of the trifunctional or more functional radical-polymerizable compound and monofunctional radical-polymerizable compound is at least one of an acryloyloxy group and a methacryloyloxy group.

* * * * *